US010902997B2

(12) United States Patent
Yogeeswaran et al.

(10) Patent No.: US 10,902,997 B2
(45) Date of Patent: Jan. 26, 2021

(54) IN-SITU WOUND CURRENT TRANSFORMER CORE

(71) Applicant: Google Inc., Mountain View, CA (US)

(72) Inventors: Karthik Yogeeswaran, Mountain View, CA (US); James A. Mass, North Royalton, OH (US)

(73) Assignee: Google LLC, Mountain View, CA (US)

( * ) Notice: Subject to any disclaimer, the term of this patent is extended or adjusted under 35 U.S.C. 154(b) by 468 days.

(21) Appl. No.: 15/645,507

(22) Filed: Jul. 10, 2017

(65) Prior Publication Data

US 2018/0019057 A1 Jan. 18, 2018

Related U.S. Application Data

(60) Provisional application No. 62/361,075, filed on Jul. 12, 2016, provisional application No. 62/361,064, filed on Jul. 12, 2016.

(51) Int. Cl.
*H01F 27/32* (2006.01)
*H01F 27/28* (2006.01)
(Continued)

(52) U.S. Cl.
CPC ..... *H01F 27/325* (2013.01); *H01F 27/2895* (2013.01); *H01F 38/30* (2013.01); *H01F 41/022* (2013.01); *H01F 41/08* (2013.01); *H01F 41/096* (2016.01); *H01F 2038/305* (2013.01); *Y10T 29/4902* (2015.01); *Y10T 29/49071* (2015.01)

(58) Field of Classification Search
CPC .... H01F 27/26; H01F 27/266; H01F 27/2895; H01F 27/30; H01F 27/303; H01F 27/306; H01F 27/325; H01F 38/30; H01F 2038/305; H01F 41/022; H01F 41/06; H01F 41/061; H01F 41/064; H01F 41/08; H01F 41/096; Y10T 29/4902; Y10T 29/49071; G01R 15/18; G01R 15/188
See application file for complete search history.

(56) References Cited

U.S. PATENT DOCUMENTS 4,617,543 A * 10/1986 Akachi ..... H01F 27/29 336/192
5,515,597 A 5/1996 Herbst et al.
(Continued)

*Primary Examiner* — Peter Dungba Vo
*Assistant Examiner* — Joshua D Anderson
(74) *Attorney, Agent, or Firm* — Honigman LLP; Brett A. Krueger

(57) ABSTRACT

A current transformer includes first and second bobbins, and a secondary winding. The first bobbin includes a first tube defining a first longitudinal axis. First and second flanges are disposed on first and second ends of the first tube. The first tube, the first and second flanges collectively define a first slit along the first longitudinal axis. The first slit allows receipt of a primary conductor into the first tube. The second bobbin includes a second tube rotatably received about the first tube. The second tube defines a second slit along the second longitudinal axis. The second slit allows receipt of the primary conductor into the first and second tubes. The secondary winding is wound about the first bobbin and extends along the first longitudinal axis, passing through the first tube and over the first and second flanges. The second tube rotates about the second longitudinal axis relative to the first tube.

4 Claims, 44 Drawing Sheets

(51) Int. Cl.

| | |
|---|---|
| ***H01F 38/30*** | (2006.01) |
| ***H01F 41/08*** | (2006.01) |
| ***H01F 41/096*** | (2016.01) |
| ***H01F 41/02*** | (2006.01) |

(56) References Cited

U.S. PATENT DOCUMENTS 8,665,048 B2 * 3/2014 Crocker ..... H01F 17/04
336/69
9,843,176 B2 * 12/2017 Gibson ..... H02G 1/04

* cited by examiner

750

IN-SITU WOUND CURRENT TRANSFORMER CORE

CROSS REFERENCE TO RELATED APPLICATIONS

This U.S. patent application claims priority under 35 U.S.C. § 119(e) to U.S. Provisional Application 62/361,075, filed on Jul. 12, 2016 and U.S. Provisional Application 62/361,064, filed on Jul. 12, 2016. The disclosures of these prior applications are considered part of the disclosure of this application and are hereby incorporated by reference in their entireties.

TECHNICAL FIELD

This disclosure relates to an in-situ wound current transformer core.

BACKGROUND

A transformer is an electrical device that transfers electrical energy between two or more circuits through electromagnetic induction. A current transformer (CT) 100, as shown in FIG. 1, is a type of transformer that produces an alternating current (AC) in its secondary winding from an alternating current in its primary winding. The CT 100 includes a core 110 and a secondary winding 112 wound around the core 110. The alternating primary current in the primary conductor 120 carrying the primary alternating current produces an alternating magnetic field in the core 110 of the CT 100. In some examples, a current $I_S$ in the secondary winding 112 is proportional to a current $I_P$ in the primary conductor 120 (i.e., primary current) divided by a number of turns of the secondary winding 112.

The CT 100 operates when the primary current IP flows on the primary wire 120, inducing a magnetic field around the primary wire 120. The magnetic field is concentrated in the core 110 of the CT 100, which may be anything from an air core with a relative permeability of one to a soft magnetic material, such as Supermalloy or Mu-metal with a relative permeability of 100,000. The relative permeability is proportional to the ratio of the magnetic flux density for a given magnetizing force. Supermalloy is an alloy composed of nickel (75%), iron (20%) and molybdenum (5%), and is known to be a magnetically soft material. The secondary winding 112 is wound around the core 110 and a secondary current $I_S$ is induced in this winding proportional to a flux in the core 110. A core material of the core 110 may have additional properties of coercivity, core loss, saturation flux. Various core materials are chosen based on the application of the current transformer.

In some examples, the primary wire conductor 120 carrying the primary current is already installed and a CT 100 having a toroid shape is impossible to install without cutting the primary conductor 120 to slide the toroid around the primary conductor 120. Traditionally, this problem is solved by using a split core current transformer, which includes two core halves 110*a*, 110*b* pressed together around the primary wire 120 to form the core 110. A secondary winding 112 is wound around one (as shown) or both (not shown) of the two core halves 110*a*, 110*b*. Even under conditions where both core halves 110*a*, 110*b* of the core 110 are evenly cut and polished extremely flat, only a fraction of the core halves 110*a*, 110*b* may be in contact with the other core half 110*a*, 110*b*, creating a gap. The gap drops the effective permeability of the material of the core 110 and changes a shape of the Magnetic Flux Density (B) versus the Magnetic Field Strength (H) curve, i.e., the BH curve. For example, for any practical gap width of around one mil (about 25 microns), the permeability may drop from 100,000 to only a few thousand. As such, although a split core current transformer may function, it does so while drastically changing the performance of the CT 100 compared to a CT 100 having solid core of the same dimensions.

SUMMARY

One aspect of the disclosure provides a transformer. The transformer includes a first bobbin, a second bobbin, and a secondary winding wound about the first bobbin. The first bobbin includes: a first tube having first and second ends and defining a first longitudinal axis; a first flange disposed on the first end of the first tube; and a second flange disposed on the second end of the first tube. The first tube, the first flange, and the second flange collectively define a first slit along the first longitudinal axis. The first slit is configured to allow receipt of a primary conductor into the first tube. The second bobbin includes a second tube rotatably received about the first tube. The second tube defines a second longitudinal axis substantially coincident with the first longitudinal axis and a second slit along the second longitudinal axis. The second slit is configured to allow receipt of the primary conductor into the first tube and the second tube when the first slit and the second slit are aligned. The secondary winding extends along the first longitudinal axis, passing through the first tube and over the first and second flanges. The second tube is configured to rotate about the second longitudinal axis relative to the first tube.

Implementations of the disclosure may include one or more of the following optional features. In some implementations, the first and second tubes are concentric. The second bobbin may be sized for receipt over the first tube and between the first and second flanges. The second bobbin may include a third flange disposed on the first end of the tube, and a fourth flange disposed on the second end of the tube. The second tube, the third flange, and the fourth flange may collectively define the second slit. In some examples, the transformer includes a core wrap wound about the second bobbin in a direction substantially perpendicular to the second longitudinal axis. The core wrap may have a length less than a length of the second bobbin. The secondary winding may pass through the first flange and/or the second flange.

Another aspect of the disclosure provides a method for operating the transformer. The method includes attaching a first flange to a first end of a first tube defining a first longitudinal axis and sliding a second tube over the first tube. The second tube defines a second longitudinal axis. The second longitudinal axis is arranged substantially coincident with the first longitudinal axis. The method also includes attaching a second flange to a second end of the first tube opposite of the first end of the first tube. The first tube, the first flange, and the second flange collectively form a first bobbin defining a first slit along the first longitudinal axis. The first slit is configured to allow receipt of a primary conductor into the first tube, and the second tube forms a second bobbin configured to rotate relative to the first bobbin. The second bobbin defines a second slit along the second longitudinal axis. The second slit is configured to allow receipt of the primary conductor into the first tube and the second tube when the first slit and the second slit are aligned. The method further includes winding a secondary winding about the first bobbin, wherein the secondary winding extends along the first longitudinal axis, passing through the first tube and over the first and second flanges.

Implementations of the disclosure may include one or more of the following optional features. In some implementations, the method includes wrapping a core wrap about the second bobbin in a direction substantially perpendicular to the second longitudinal axis by rotating the second bobbin relative to the first bobbin while feeding the core wrap onto the second bobbin. The second bobbin may be sized for receipt over the first tube and between the first and second flanges. In some examples, the second bobbin includes a third flange disposed on the first end of the second tube, and a fourth flange disposed on the second end of the second tube. The second tube, the third flange, and the fourth flange may collectively define the second slit. The secondary winding may pass through the first flange and/or the second flange.

Yet another aspect of the disclosure provides a method of installing a current transformer. The method includes disposing a first bobbin on an electric line and disposing a second bobbin on the first bobbin. The first bobbin includes: a first tube having first and second ends and defining a first longitudinal axis; a first flange disposed on the first end of the first tube; a second flange disposed on the second end of the first tube; and a secondary winding wound about the first bobbin. The first tube, the first flange, and the second flange collectively define a first slit along the first longitudinal axis. The first slit is configured to allow receipt of a primary conductor into the first tube. The secondary winding extends along the first longitudinal axis, passing through the first tube and over the first and second flanges. The second bobbin includes a second tube having first and second ends. The second tube defines a second longitudinal axis and a second slit along the second longitudinal axis. The second slit is configured to receive the first tube into the second tube, wherein when the first tube is received into the second tube. The first longitudinal axis is substantially coincident with the second longitudinal axis and the second bobbin can spin about the second longitudinal axis relative to the first bobbin. The method also includes winding a core wrap about the second bobbin in a direction substantially perpendicular to the second longitudinal axis by rotating the second bobbin relative to the first bobbin while feeding the primary conductor onto the second bobbin.

Implementations of the disclosure may include one or more of the following optional features. In some implementations, the second bobbin is sized for receipt over the first tube and between the first and second flanges. The second bobbin may include a third flange disposed on the first end of the second tube, and a fourth flange disposed on the second end of the second tube. The second tube, the third flange, and the fourth flange may collectively define the second slit. The secondary winding may pass through the first flange and/or the second flange.

Yet another aspect of the disclosure provides a foil dispenser for wrapping foil onto a bobbin. The foil dispenser includes a dispenser body, a bobbin drive, a supply reel and a clutch. The dispenser body defines a rotation limber configured to engage and limit rotation of a first bobbin. The first bobbin includes: a first tube having first and second ends and defining a first longitudinal axis; a first flange disposed on the first end of the first tube; and a second flange disposed on the second end of the first tube. The bobbin drive is configured to engage and rotate a second bobbin relative to the first bobbin. The second bobbin includes a second tube rotatably received about the first tube. The second tube defines a second longitudinal axis substantially coincident with the first longitudinal axis. The supply reel is rotatably supported by the dispenser body and configured to carry a wrapping of foil. The clutch is coupled to the supply reel and configured to resist rotation of the supply reel.

Implementations of the disclosure may include one or more of the following optional features. In some implementations, the dispenser body defines first and second portions. The first portion may define the rotation limiter. The second portion may rotatably support the supply reel. The dispenser body may include a first side plate and a second side plate spaced from and substantially parallel to the first side plate. The supply reel may be rotatably supported between the first and second side plates. One of the first or second side plates may define the rotation limiter. The rotation limiter may include a protrusion configured for receipt by a dent or slot defined by one of the flanges of the first bobbin.

In some examples, the bobbin drive includes one or more gears and a crank rotatably disposed on the dispenser body. The crank may be configured to rotate the one or more gears when rotated. The second bobbin may include a third flange disposed on the first end of the second tube, and a fourth flange disposed on the second end of the second tube. Each flange may have a side surface. The bobbin drive may further include a drive gear having a side surface defining one or more engagement elements configured to engage the side surface of the third flange or the fourth flange. The engagement elements may include protrusions or recesses defined by the side surface of the drive gear. The dispenser body may define a first slot configured to receive a primary conductor axially received by the first and second bobbins. The drive gear may define a second slot configured to receive the primary conductor and allow substantially coaxial placement of drive gear relative to the second bobbin. The supply reel may include an axle rotatably supported by the dispenser body and the clutch may be configured to exert frictionally resistance to rotation of the axle.

Another aspect of the disclosure provides a current transformer including a housing base, a core wrap, and a housing cover. The housing body defines a base longitudinal axis, a transverse plane substantially perpendicular to the base longitudinal axis, and an opening along the base longitudinal axis. The housing base body is configured to receive a primary conductor through the opening. The housing base also includes a plurality of base conductors supported by the housing base body. Each base conductor is arranged about and radially spaced from the base longitudinal axis. The core wrap includes a length of magnetically permeable material wrapped around the housing base body along the transverse plane, the core wrap collectively forming a transformer core about the base longitudinal axis. The housing cover is releasably attached to the housing base to form a housing that houses the formed core. The housing cover includes a housing cover body defining a cover longitudinal axis, and a plurality of cover conductors supported by the housing cover body. Each cover conductor is arranged about and radially spaced from the cover longitudinal axis. When the housing cover is attached to the housing base, the plurality of base conductors align with and contact the plurality of cover conductors to form a continuous secondary winding around the core.

Implementations of this aspect of the disclosure may include one or more of the following optional features. In some implementations, the housing cover is attached to the housing base, and the base longitudinal axis coincides with the cover longitudinal axis. The plurality of base conductors may be circumferentially spaced about the base longitudinal axis and the plurality of cover conductors may be circumferentially spaced about the cover longitudinal axis. Each base conductor may include a linear rod arranged substantially parallel to the base longitudinal axis. At least one base conductor or cover conductor may define an arcuate shape. In some implementations, electrical connections between the outer housing conductors and base housing conductors are made with spring-loaded contacts. In other implementations, the electrical connections are implemented using magnet based contacts. Both of these implementations aim to reduce the contact resistance of these junctions, reducing the Ohmic resistance of the secondary winding.

In some examples, at least one of the housing base body or the housing cover body defines a core receptacle configured to at least partially receive the magnetically permeable wrapped transformer core. The opening may define a slot along the base longitudinal axis sized to receive the primary conductor into the opening. At least one of the housing base body or the housing cover body may include a first body portion having first and second ends, and a second body portion having first and second ends. The first end of the second body portion may be pivotably coupled to the first end of the first body portion. The first body portion and the second body portion may be moveable between: an open position, wherein the second end of the first body portion is rotated away from the second end of the second body portion; and a closed position, wherein the second end of the first body portion contacts the second end of the second body portion.

Another aspect of the disclosure provides a method of installing a current transformer. The method includes disposing a housing base on a primary conductor, wrapping a length of magnetically permeable material around the housing base body along a transverse plane substantially perpendicular to the base longitudinal axis, and mating a housing cover to the housing base to form a housing that houses a formed transformer core (i.e., magnetically permeable wrapped transformer core). The housing base body defines a base longitudinal axis and an opening along the base longitudinal axis. The primary conductor is received through the opening. Moreover, a plurality of base conductors is supported by the housing base body. Each base conductor is arranged about and radially spaced from the base longitudinal axis. The wrapped magnetically permeable material collectively forms the transformer core about the base longitudinal axis. The housing cover includes a housing cover body defining a cover longitudinal axis and a plurality of cover conductors supported by the housing cover body. Each cover conductor is arranged about and radially spaced from the cover longitudinal axis. When the housing cover is mated to the housing base, the plurality of base conductors align with and contact the plurality of cover conductors to form a continuous secondary winding around the transformer core.

This aspect may include one or more of the following optional features. In some implementations, the housing cover is mated to the housing base, and the base longitudinal axis coincides with the cover longitudinal axis. The plurality of base conductors may be circumferentially spaced about the base longitudinal axis and the plurality of cover conductors may be circumferentially spaced about the cover longitudinal axis. Each base conductor may include a linear rod arranged substantially parallel to the base longitudinal axis. At least one base conductor or cover conductor may define an arcuate shape.

In some examples, at least one of the housing base body or the housing cover body defines a core receptacle configured to at leak partially receive the formed wrapped transformer core. Disposing the housing base on the primary conductor may include receiving the primary conductor through a slot defined along the base longitudinal axis of the housing base body and into the opening. At least one of the housing base body or the housing cover body may include a first body portion having first and second ends and a second body portion having first and second ends. The first end of the second body portion may be pivotably coupled to the first end of the first body portion. The first body portion and the second body portion may be moveable between: an open position, wherein the second end of the first body portion is rotated away from the second end of the second body portion; and a closed position, wherein the second end of the first body portion contacts the second end of the second body portion.

The details of one or more implementations of the disclosure are set forth in the accompanying drawings and the description below. Other aspects, features, and advantages will be apparent from the description and drawings, and from the claims.

DESCRIPTION OF DRAWINGS

FIG. 3O is a rear view of the exemplary material foil wrapped about the second bobbin of FIG. 3N.

Like reference symbols in the various drawings indicate like elements.

DETAILED DESCRIPTION

Figure 1:
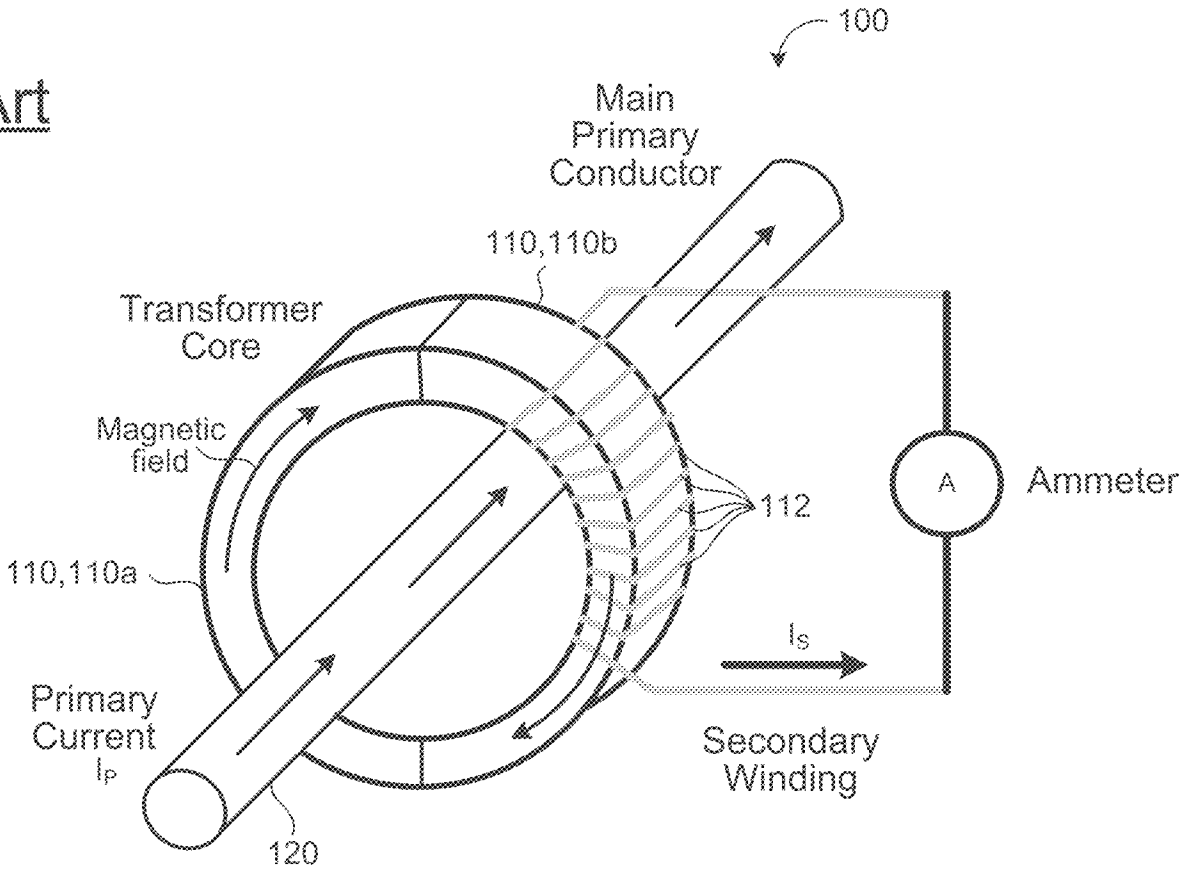
Prior Art FIG. 1
FIG. 1 is a perspective view of a prior art current transformer.
Figure 2A:
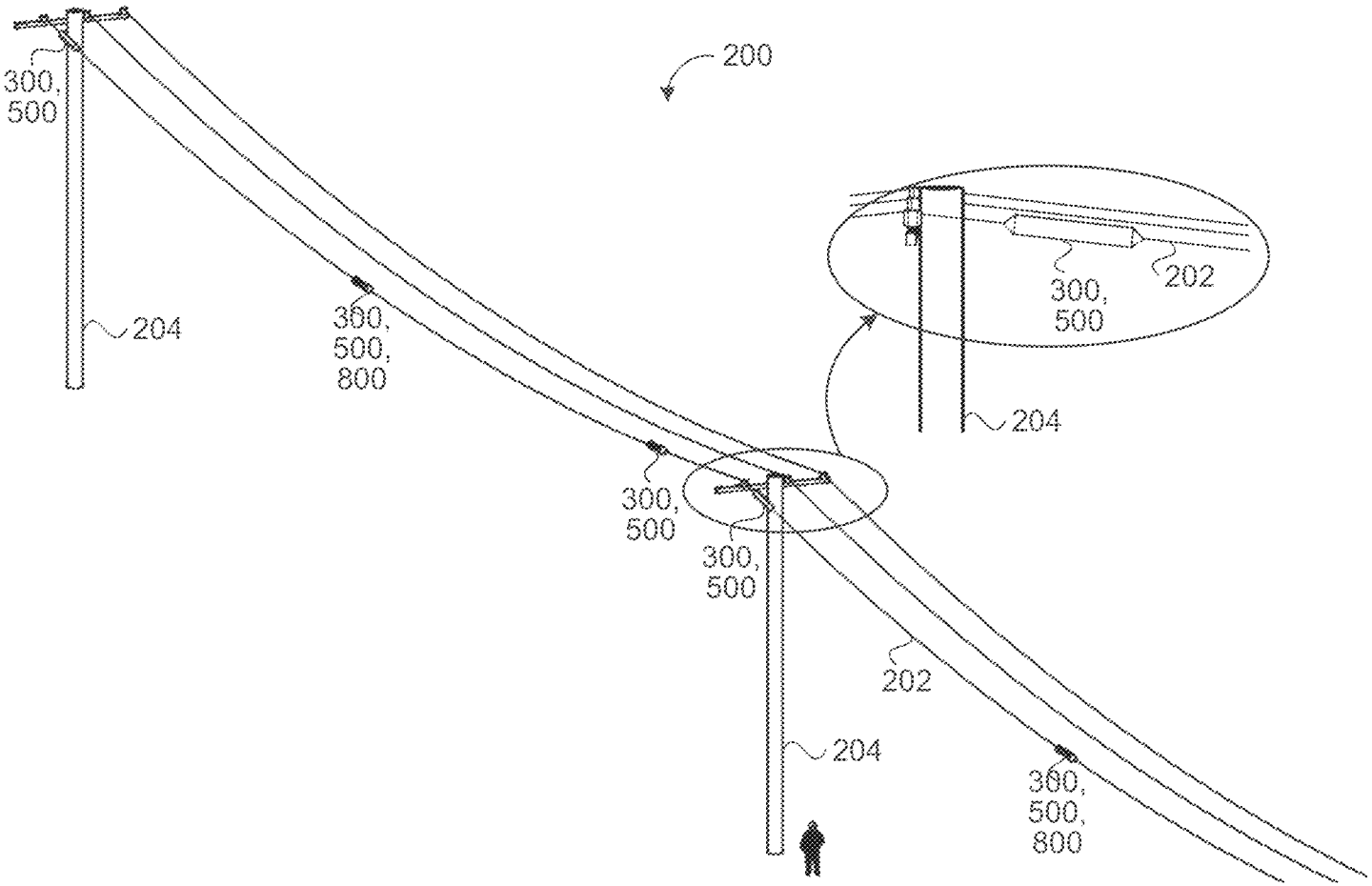
FIG. 2*a* is a schematic view of a utility network having an exemplary current transformer.

This disclosure describes a current transformer (CT). As illustrated in FIG. 2A, in some examples, a CT 300, 500 harvests energy from a power network 200, more specifically, power lines 202 or electrical lines/wires 202 of the power network 200. Utility poles 204 support the power lines 202 allowing the power lines 202 to extend from a first location to a second location and provide power to the second location. CTs 300, 500 may be used to power sensors installed at each utility pole, for example. Other uses of CTs 300, 500 are possible as well. It is desirable to design a CT 300, 500 that is installed on existing primary conductor 202 without compromising the performance and efficiency of the CT 300, 500. As such, the CT 300, 500 described, overcomes the problem where one side of a primary conductor 202 cannot be accessed to insert the cable as the primary conductor 202 within a core of the CT 300, 500, while maintaining the performance of the core material by avoiding the effect of gaps in a traditional split core CT 100 (FIG. 1). The design of the CT 300, 500 avoids breaks in the core (body) by using a foil dispenser 700 (FIGS. 7A-7C) to wrap a continuous roll of thin annealed and laminated soft magnetic material around the primary conductor and a body cover containing the secondary winding around the core.

Figure 2C:
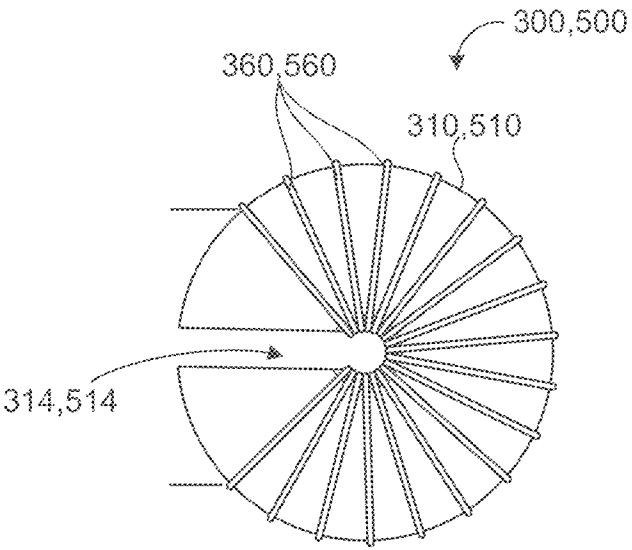
FIG. 2C is a front view of the exemplary secondary winding about first and second bobbins.
Figure 2B:
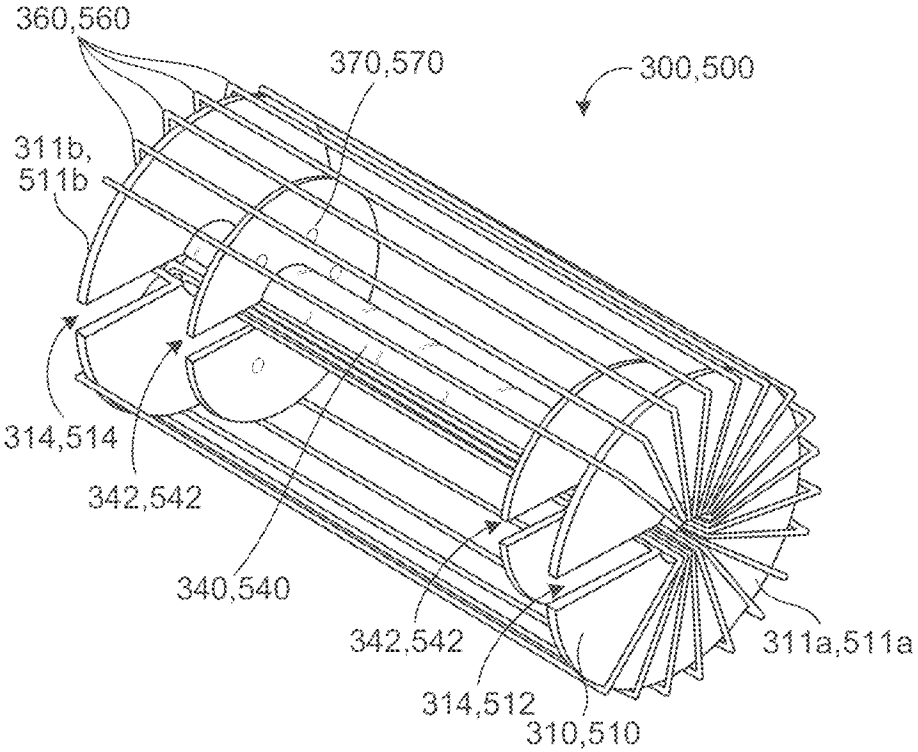
FIG. 2B is a perspective view of the exemplary secondary winding about first and second bobbins.

Referring to FIGS. 2B and 2C, in some implementations, a CT 300, 500 includes a first bobbin 310, 510 and a second bobbin 340, 540. Each of the first and second bobbins 310, 340, 510, 540 includes flanges. A secondary winding 360 is wound about the flanges associated with the first bobbin.

Figure 3B:
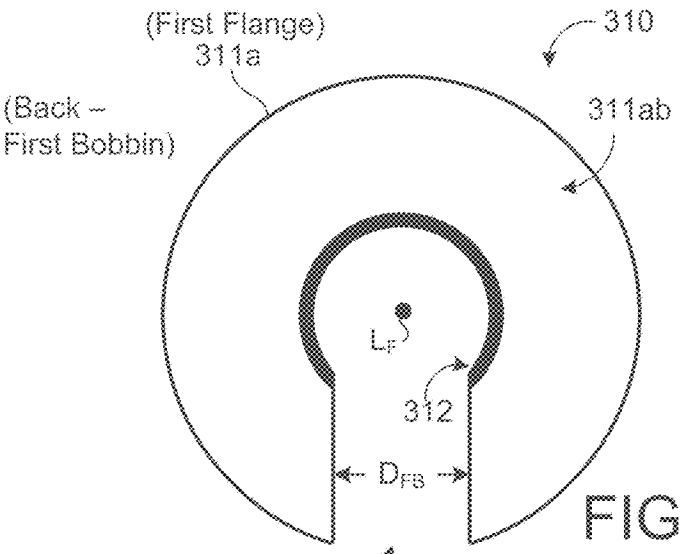
FIG. 3B is a schematic rear view of the exemplary first bobbin of the current transformer of FIG. 3A.
Figure 3A:
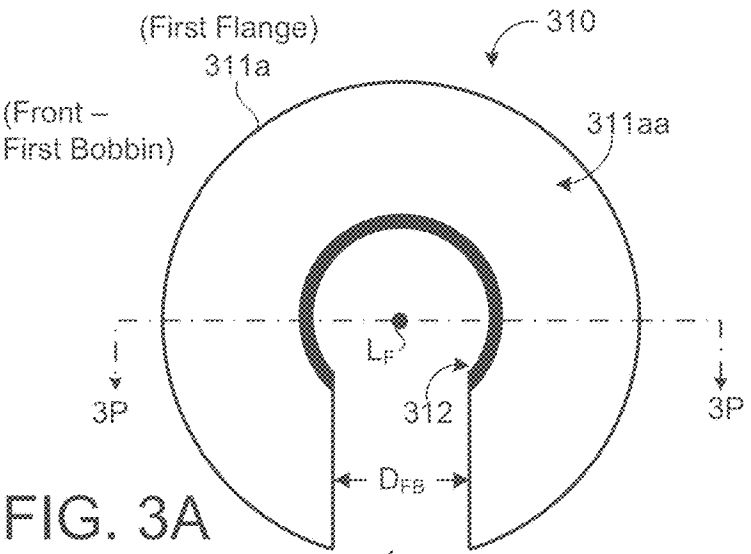
FIG. 3A is a schematic front view of an exemplary first bobbin of a current transformer.
Figure 3C:
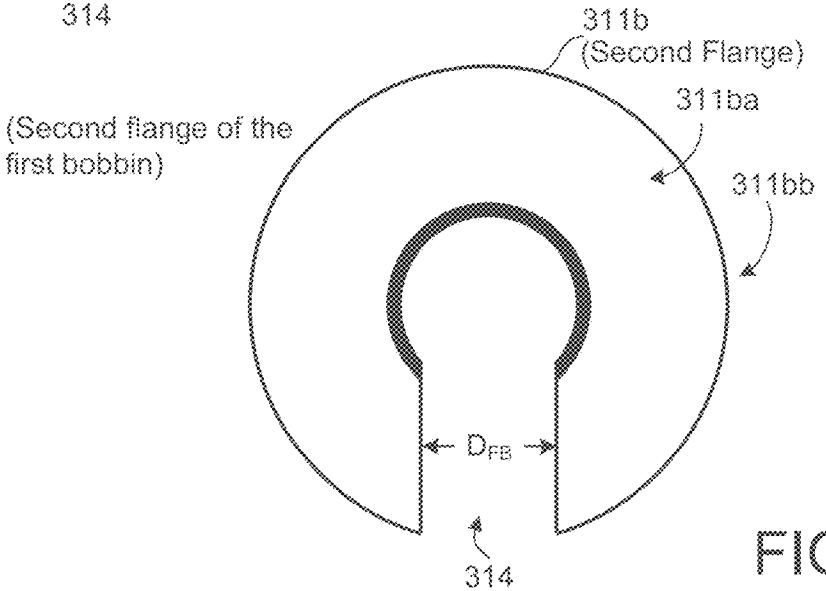
FIG. 3C is a schematic front view of the exemplary flange of the first bobbin.
Figure 3E:
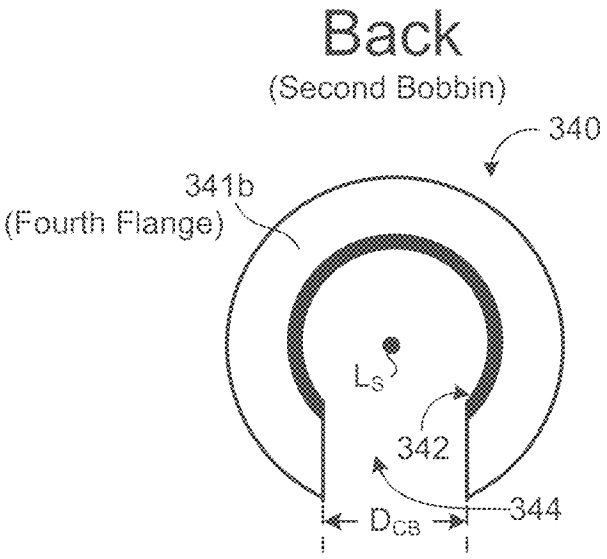
FIG. 3E is a schematic rear view of the exemplary second bobbin of the current transformer of FIG. 3D.
Figure 3D:
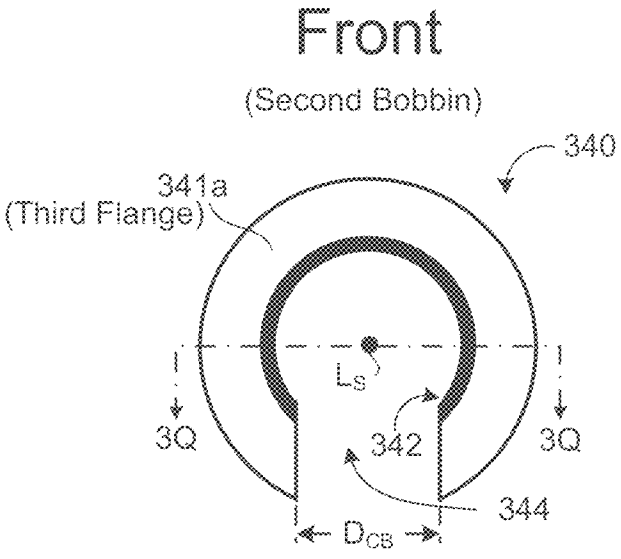
FIG. 3D is a schematic front view of an exemplary second bobbin of a current transformer.
Figure 3G:
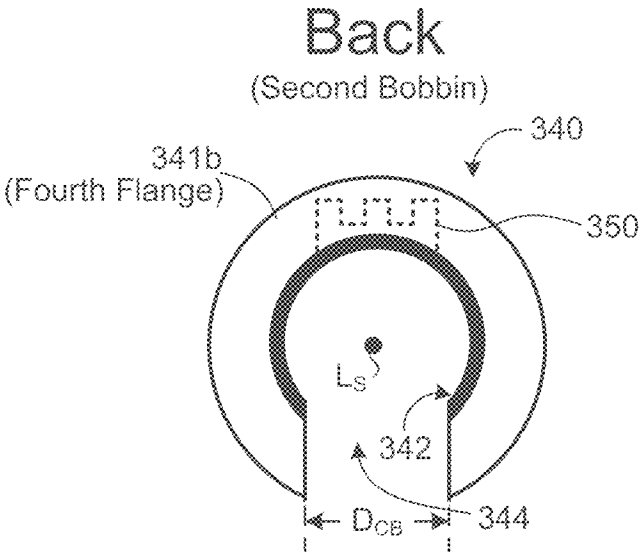
FIG. 3G is a schematic rear view of the exemplary second bobbin rotatably received about the first bobbin of FIG. 3F.
Figure 3F:
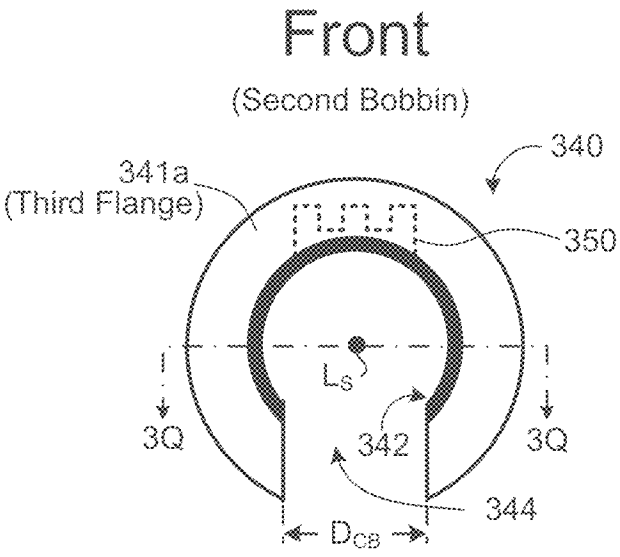
FIG. 3F is a schematic front view of an exemplary second bobbin rotatably received about a first bobbin.
Figure 3I:
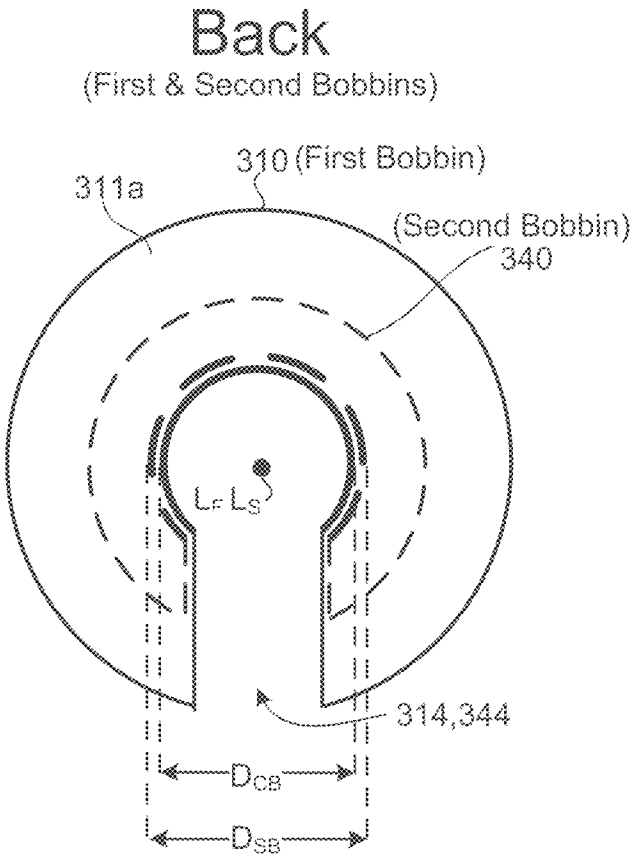
FIG. 3I is a schematic rear view of the exemplary second bobbin rotatably received about the first bobbin of FIG. 3H and having partial gears.
Figure 3H:
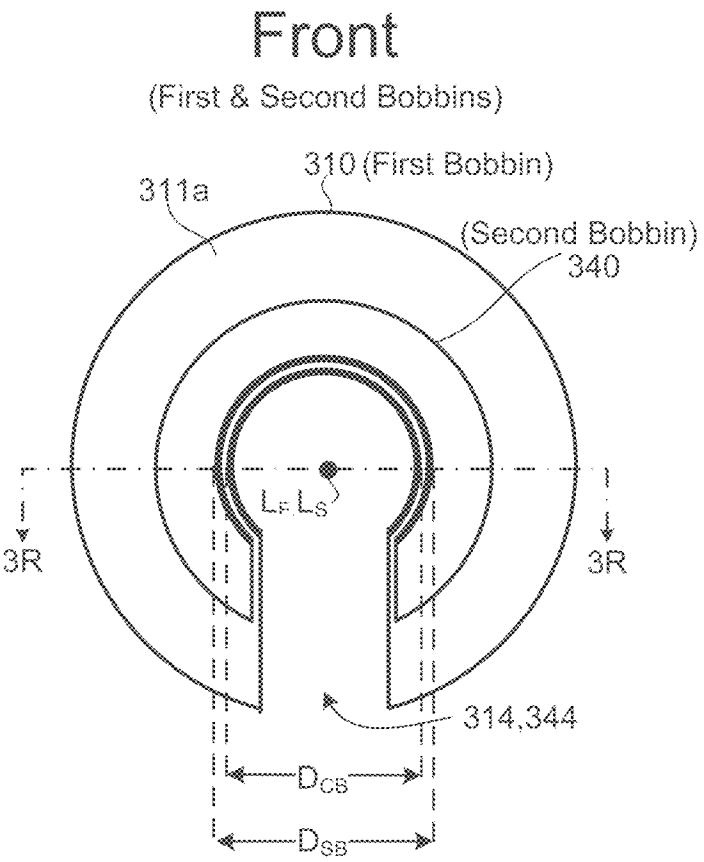
FIG. 3H is a schematic front view of an exemplary second bobbin rotatably received about a first bobbin and having partial gears.
Figure 3K:
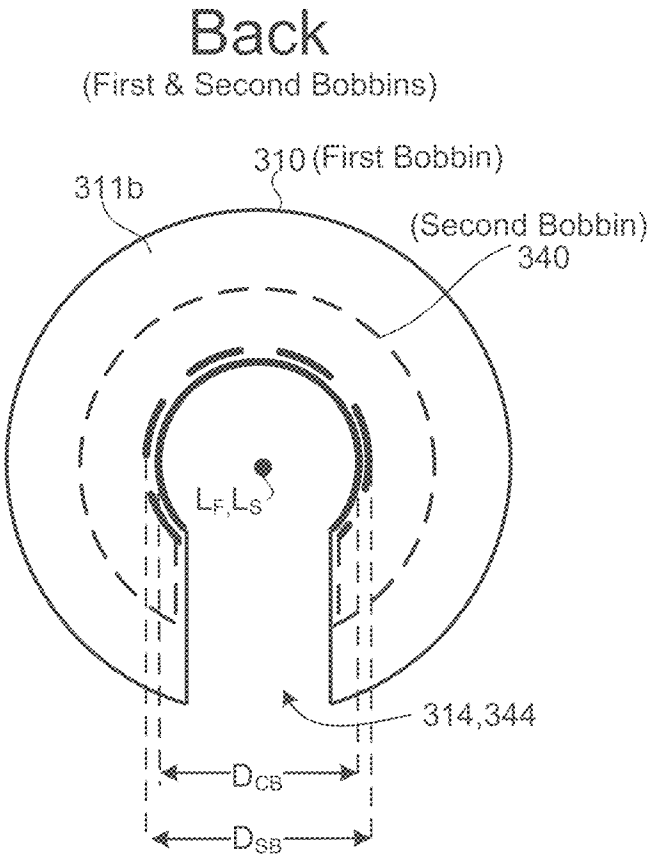
FIG. 3K is a schematic rear view of the exemplary second bobbin rotatably received about the first bobbin of FIG. 3F, where the first bobbin has two flanges.
Figure 3J:
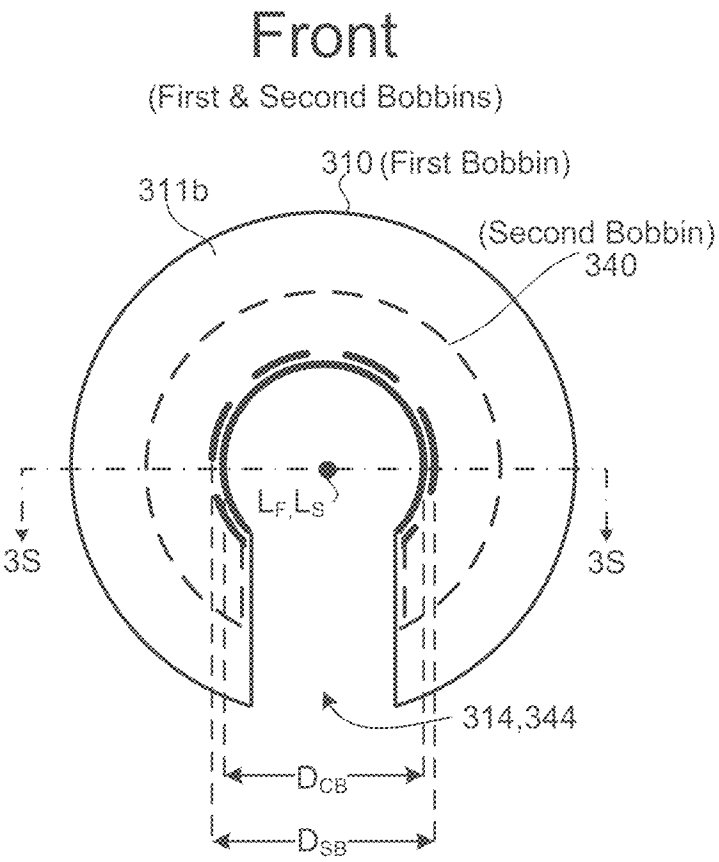
FIG. 3J is a schematic front view of an exemplary second bobbin rotatably received about a first bobbin, where the first bobbin has two flanges.
Figure 3M:
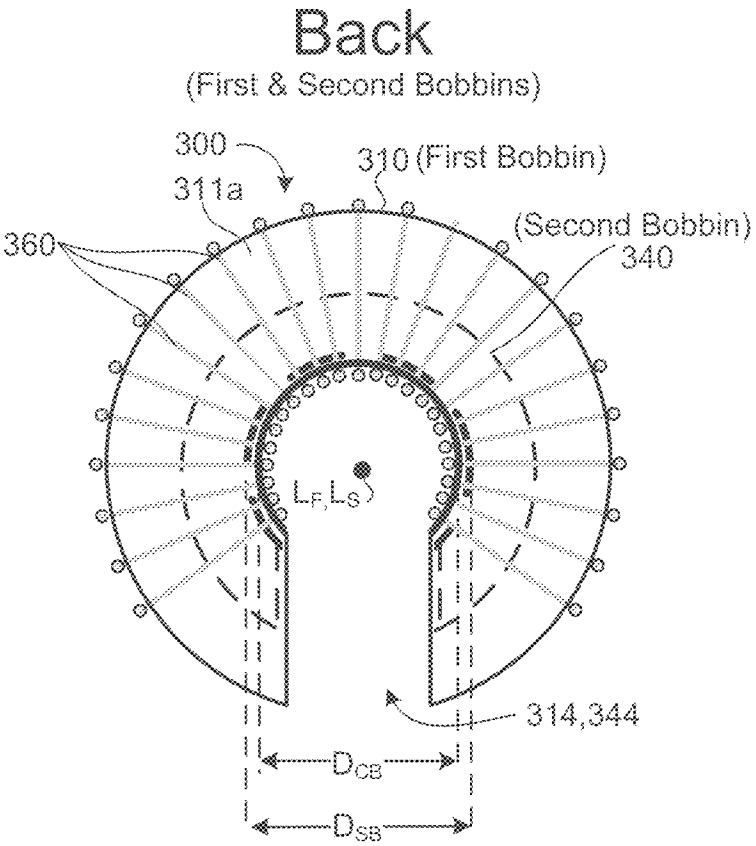
FIG. 3M is a rear view of the exemplary secondary winding about first and second bobbins of FIG. 3L.
Figure 3L:
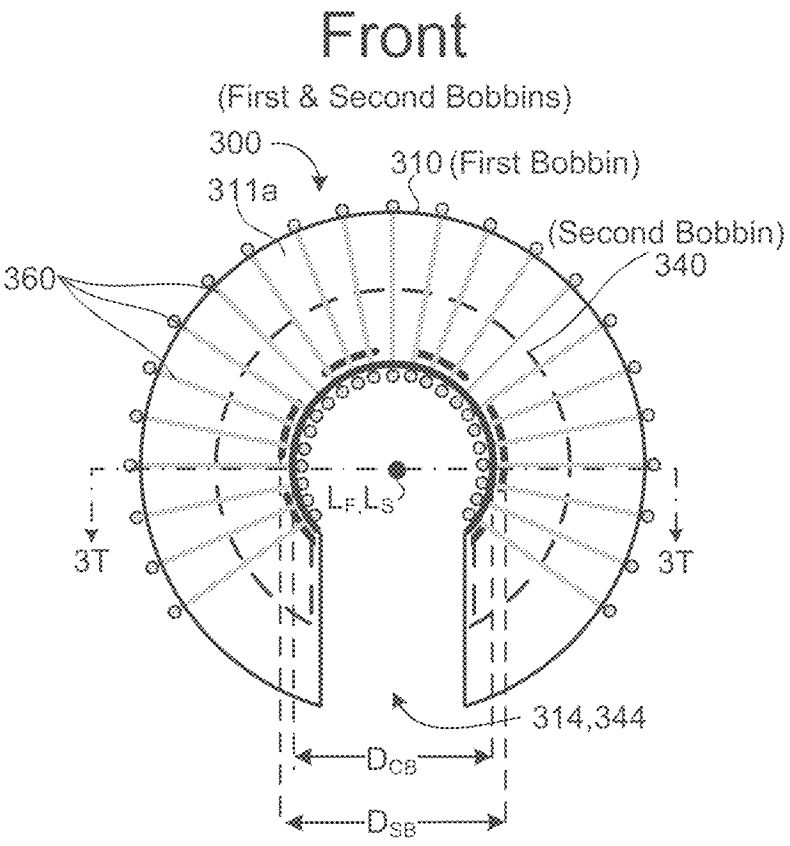
FIG. 3L is a front view of an exemplary secondary winding about first and second bobbins.
Figure 30:
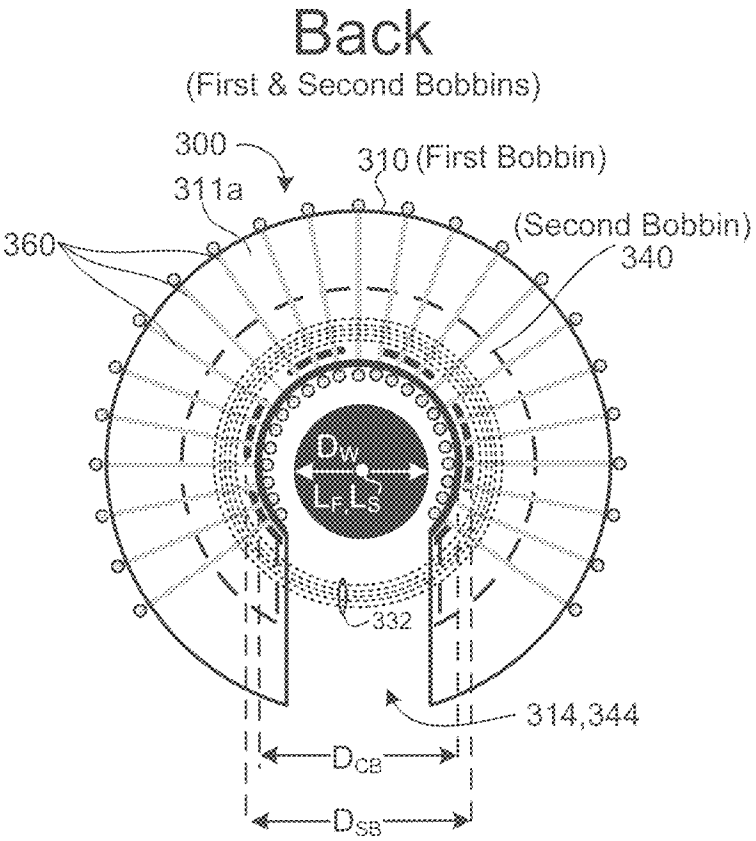
Figure 3N:
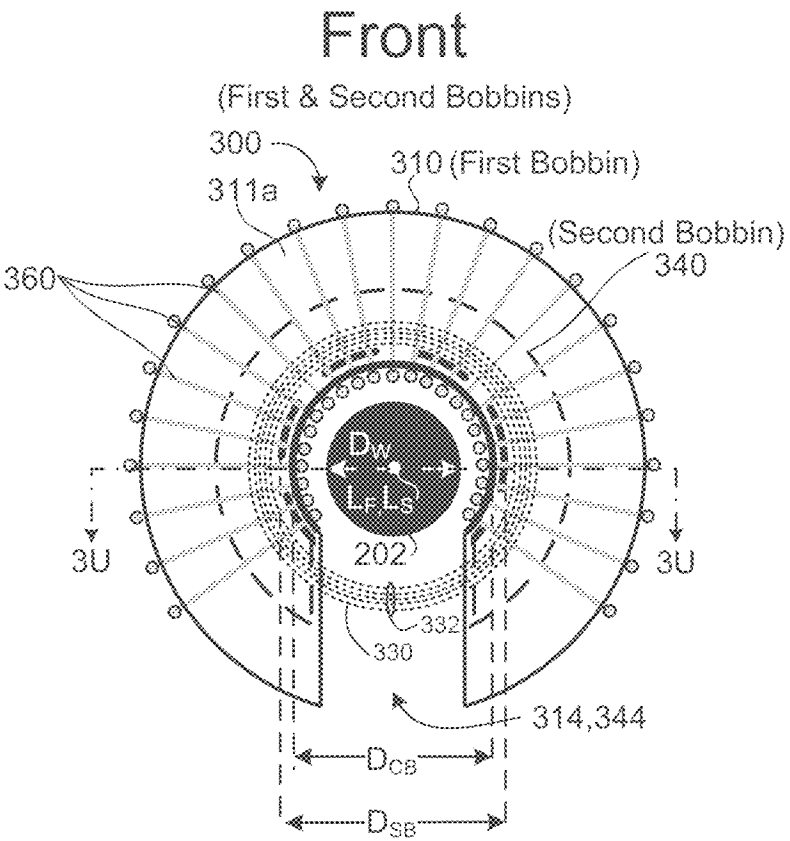
FIG. 3N is a front view of an exemplary material foil wrapped about the second bobbin.
Figures 3P, 3Q, 3R:
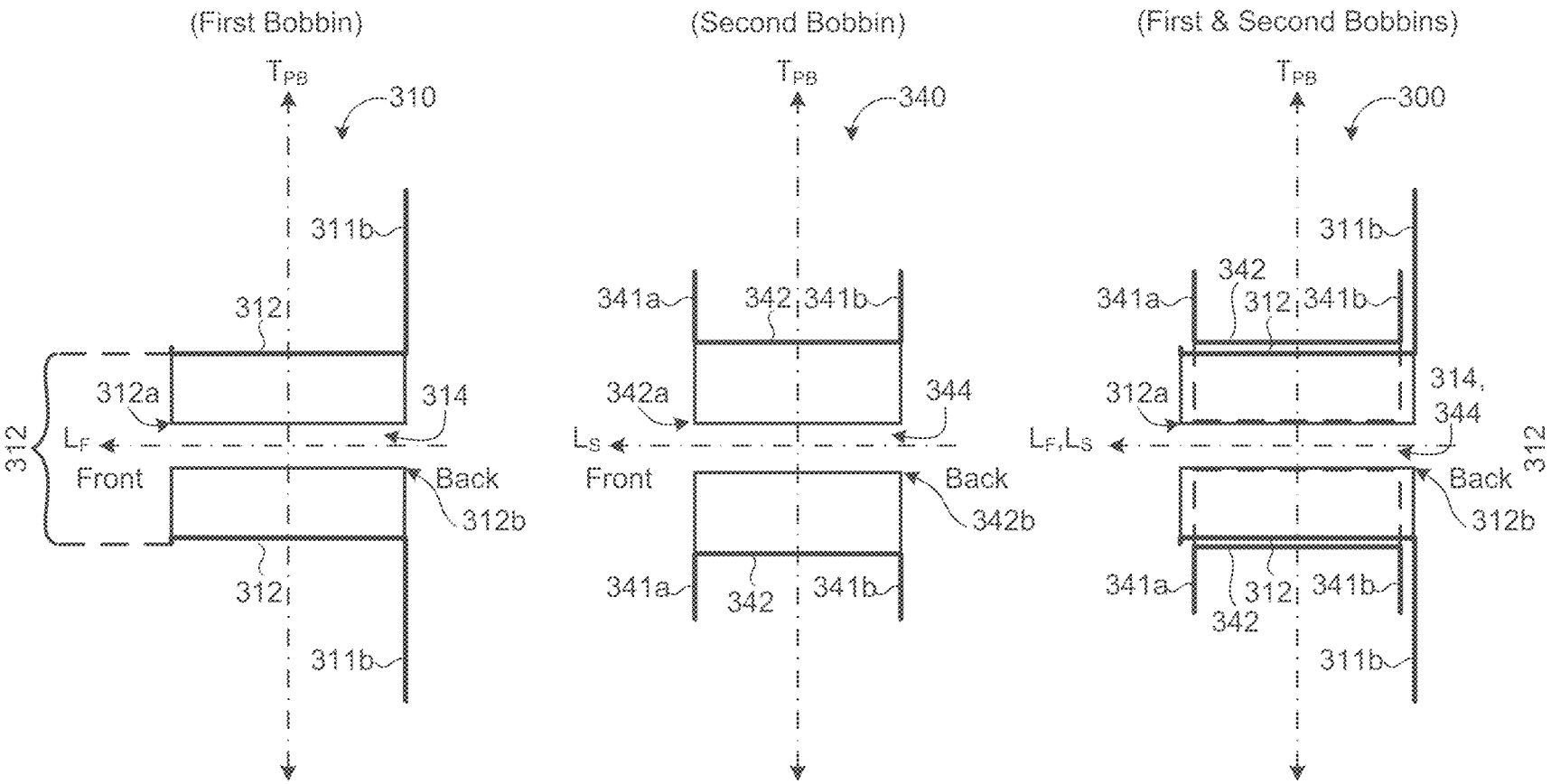
FIG. 3P is a side view of an exemplary first bobbin.
FIG. 3Q is a side view of an exemplary second bobbin.
FIG. 3R is a side view of the exemplary second bobbin of FIG. 3O rotatably received about the first bobbin of FIG. 3N.
Figure 3U:
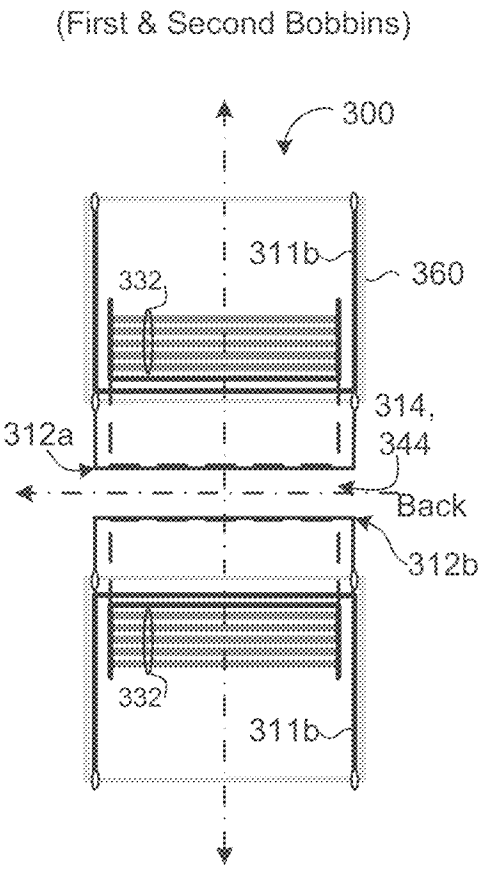
FIG. 3U is a side view of the exemplary second bobbin of FIG. 3O rotatably received about the first bobbin of FIG. 3N having a secondary winding about the first bobbin and a magnetic foil about the second bobbin.

Referring to FIGS. 3A-3U, in some examples, a CT 300 includes a first bobbin 310 and a second bobbin 340, where the second bobbin 340 slides over a first tube 312 of the first bobbin 310 before attaching a second flange 311*b* of the first bobbin 310. The first bobbin 310 includes a first tube 312 having first and second ends 312*a*, 312*b* respectively. The tube defines a first longitudinal axis $L_F$ that extends from the first to the second end 312*a*, 312*b* of the first tube 312. A first flange 511*a* is disposed on the first end 312*a* of the first tube 312. A second flange 511*b* is disposed on the second end 312*b* after the second bobbin 340 slides over the first tube 312 of the first bobbin 310. As such, the second flange 511*b* prevents the second bobbin 340 from sliding off of the first tube 312 of the first bobbin 310. The first tube 312, the first flange 311*a*, and the second flange 311*b* define a first slit 314 along the first longitudinal axis $L_F$. As will be shown, the first slit 314 is configured to allow receipt of a cable 202 (e.g., a primary conductor) into the first tube 312 of the first bobbin 310. As such, the first slit 314 along the first longitudinal axis $L_F$ has a slit distance $D_{FB}$ greater than a diameter $D_W$ of a primary conductor 202.

FIG. 3A illustrates a front view of the first bobbin 310 of the CT 300 showing the first flange 311*a* attached to the first tube 312; while FIG. 3R illustrates the associated side view. A first side 311*aa* of the first flange 311*a* and the inner tube 312 extends away from the first side 311*aa* of the first flange 311*a*. FIG. 3B illustrates a rear view of the first bobbin 310 shown in FIG. 3A. As shown, the first flange 311*a* includes a second side 311*ab* opposite the first side 311*aa*. FIG. 3C shows the second flange 311*b* of the first bobbin 310 before being attached to the first tube 312 of the first bobbin 310. The second flange 311*b* includes first and second sides 311*ba*, 311*bb*, where the first side 311*ba* of the second flange 311*b* is attached to the first tube 312 after the second bobbin 340 is inserted about the first tube 312.

FIGS. 3D and 3F, and FIGS. 3E and 3G illustrate a front and back view respectively of the second bobbin 340; while FIG. 3Q illustrates the associated side view. The second bobbin 340 includes a second tube 342 that is rotatably received about the first tube 312 of the first bobbin 310. The second tube 342 defines a second longitudinal axis $L_F$ that is substantially coincident with the first longitudinal axis $L_F$. The second tube 342 includes first and second ends 342*a*, 342*b* (FIGS. 3P-3U), each of the first and second ends 342*a*, 342*b* having third and fourth flanges 341*a*, 341*b* respectively. The second tube 340 defines a second slit 344 along the second longitudinal axis $L_S$. The second slit 344 allows receipt of the primary conductor 202 into the first tube 312 and the second tube 340 when the first and second slits 314, 344 are aligned. As such, the second tube 340 is configured to rotate about the second longitudinal axis $L_S$ relative to the first tube 312 allowing the first slit 314 to align with the second slit 344, resulting in receipt of the primary conductor 202. In some examples, the second bobbin 340 may include magnets, an adhesive or other attachment mechanism to allow a leader film 334*a* of the transformer core 332 to attach to it.

Referring to FIGS. 3F and 3G, in some examples, the third flange 341*a* and/or the fourth flange 341*b* includes a gear portion 350 to interlock with a slot (not shown) in a drive gear 732 of a foil dispenser 700 (discussed further in FIGS. 7A-7F). As such, when interlocked, the gear portion 350 of the third and/or fourth flange 341*a*, 341*b* is operable to rotate the third and/or fourth flange 341*a*, 341*b*, which also rotates the second bobbin 340. The third and/or fourth flange 341*a*, 341*b* may include first engagement elements 370 disposed on an outer surface of the third and/or fourth flange 341*a*, 341*b*. As such, each first engagement element 370 interlocks with a second engagement element 736 of a foil dispenser 700. In other examples, the second bobbin 340, 540 does not include flanges for supporting the first engagement element 370, 570, as such, other means for rotating the second bobbin 340, 540 with respect to the first bobbin 310, 510 may be used.

FIGS. 3F and 3G illustrate front and rear views of the second bobbin 340 after being slid over the first tube 312 of the first bobbin 310; while FIG. 3R illustrates the associated side view. As such, an inner diameter $D_{SB}$ of the second tube 342 is greater than an inner diameter $D_{CB}$ of the first tube 312 allowing the second tube 342 to slide about the first tube 312. Referring to FIGS. 3H, 3I, and 3S, when the second tube 342 is slid over the first tube 312, the second flange 311*b* of the first bobbin 310 is attached to an end of the first tube 312 that the second tube 342 used to slide there through.

Figure 3T:
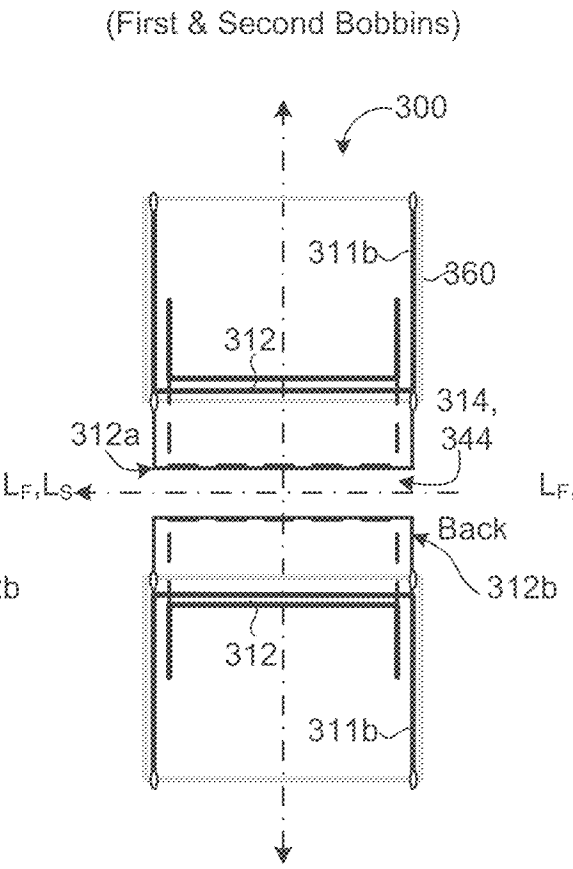
FIG. 3T is a side view of the exemplary second bobbin of FIG. 3O rotatably received about the first bobbin of FIG. 3N having a secondary winding about the first bobbin.
Figure 3S:
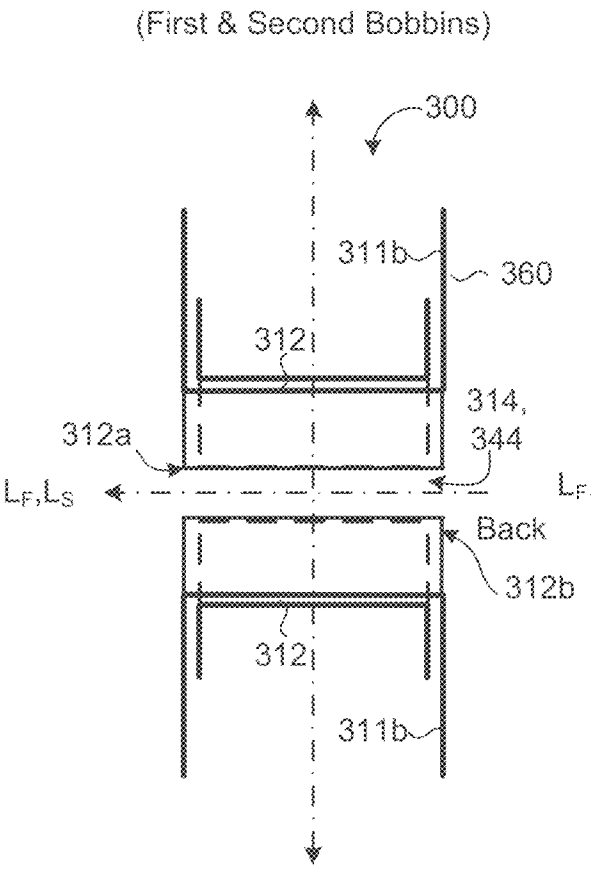
FIG. 3S is a side view of the exemplary second bobbin of FIG. 3O rotatably received about the first bobbin of FIG. 3N, where the second bobbin includes two flanges.

Referring to FIGS. 3J, 3K, and 3T, the CT 300 includes a secondary winding 360 wound about the first bobbin 310. The secondary winding 360 extends along the first longitudinal axis $L_F$ passing through the first tube 312 of the first bobbin 310 and over the first and second flanges 311*a*, 311*b* of the first bobbin 310. In some examples, the first and second longitudinal axis $L_F$, $L_S$ are substantially coincident.

Referring to FIGS. 3L, 3M, and 3U, the CT 300 includes a core wrap 330 (that includes a foil material 331) wound about the second bobbin 340 in a direction substantially perpendicular to the second longitudinal axis $L_S$. The core wrap 330 may include a magnetically permeable foil material 331. The core wrap 330 collectively forms a transformer core 332 about the first and second longitudinal axes $L_F$, $L_S$. As such, the transformer core 332 forms a continuous core for the CT 300, which prevents the problem of using the split core CT described above, preventing the distortion of the core material properties. The transformer core 332 may include a 100-turn of a one-mil (about 25 micron) thick supermalloy foil material 331. Other numbers of turns are possible as well. The core wrap 330 is wrapped about the second bobbin 340 after the first and second tubes 312, 342 receive the primary conductor 202.

Figure 4A:
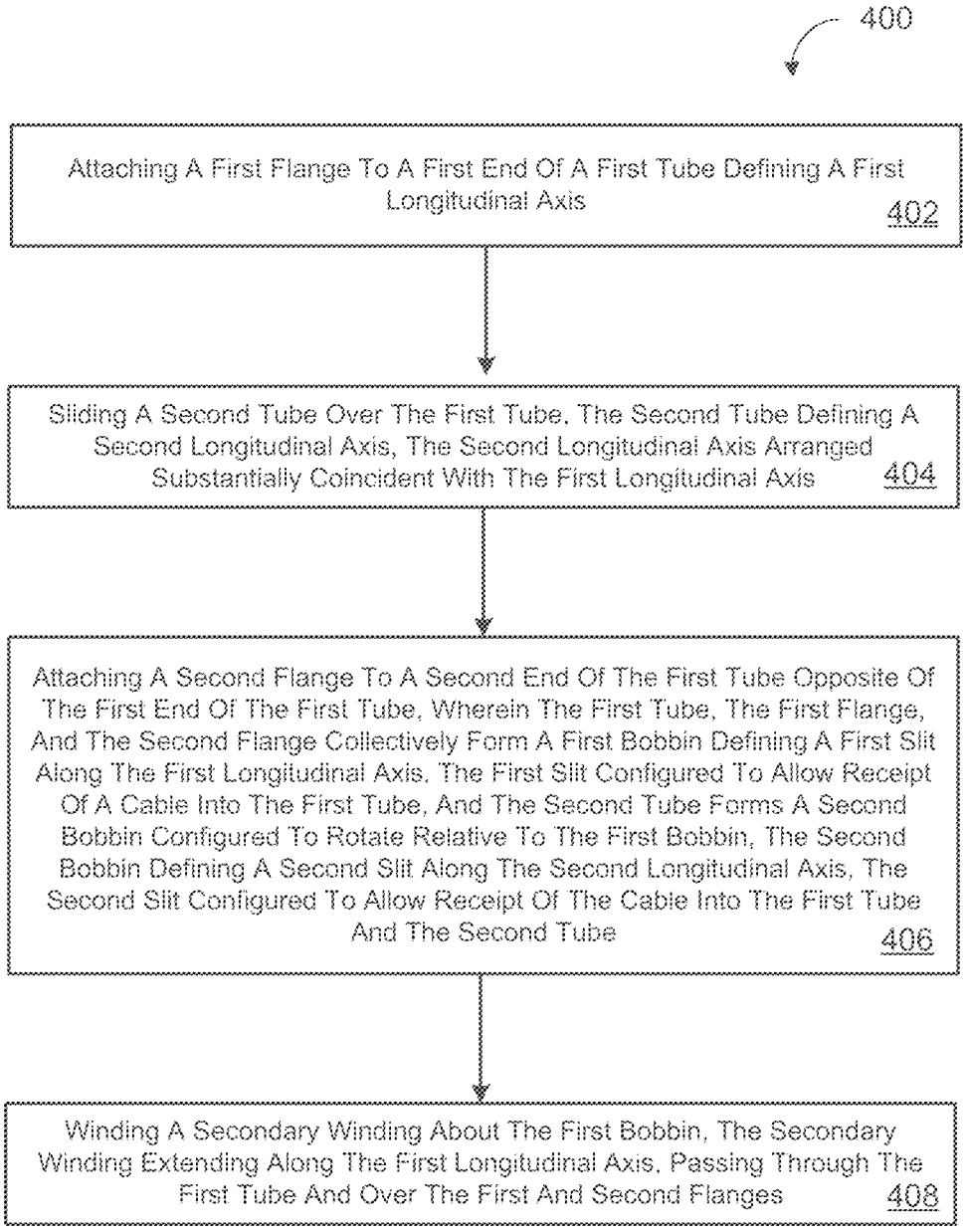
FIG. 4A provides an exemplary arrangement of operations for a method of installing a current transformer on a primary conductor.
Figure 4B:
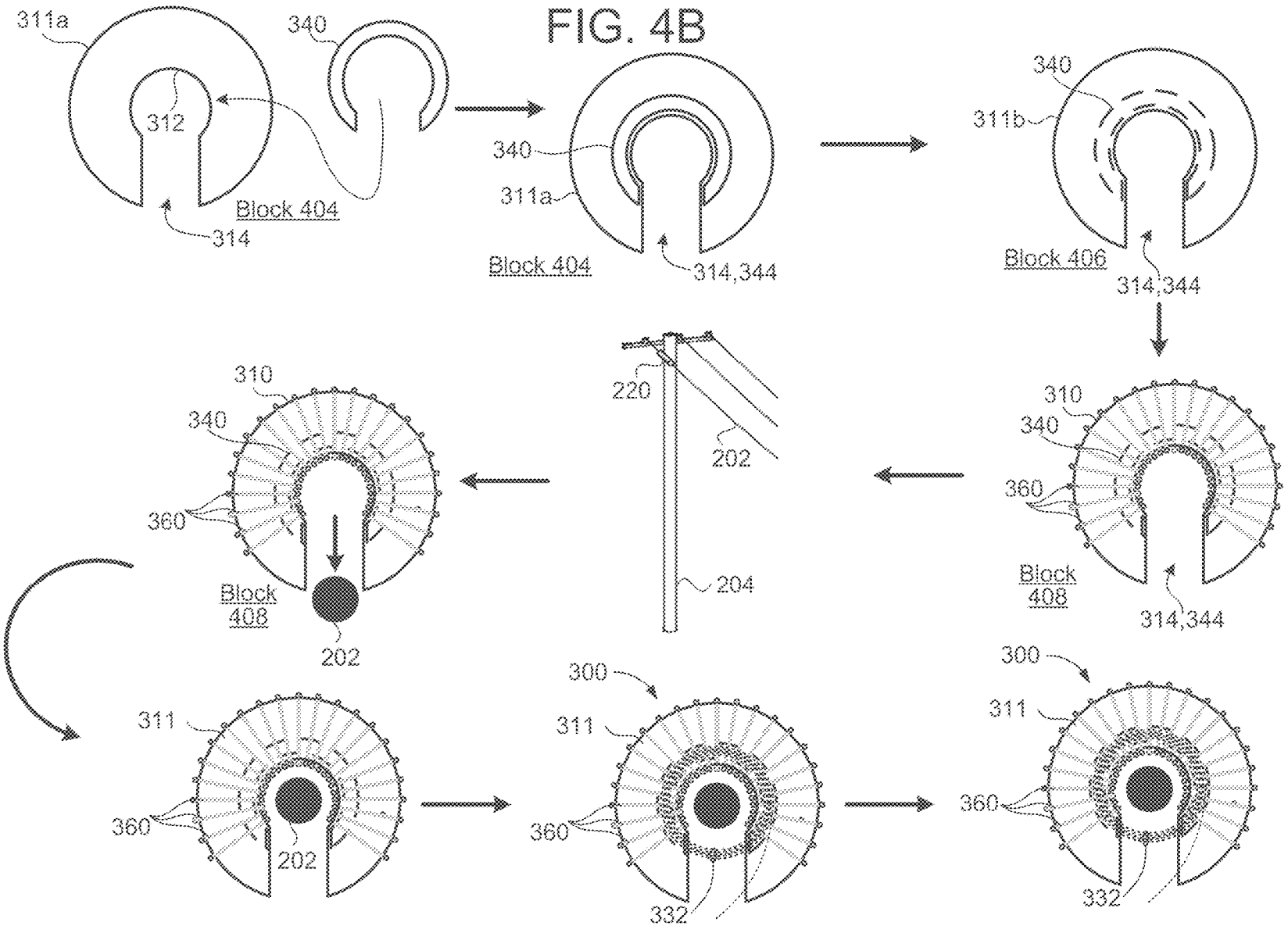
FIG. 4B is a perspective view of the current transformer being installed on a primary conductor as described in the method of FIG. 4A.

FIGS. 4A and 4B illustrate a method 400 of installing the CT 300 on a primary conductor 202, which may be supported by one or more utility poles as described with respect to FIGS. 3A-3U. At block 402, the method 400 includes attaching a first flange 311*a* to a first end 312*a* of a first tube 312. The first tube 312 defines a first longitudinal axis $L_F$. At block 404, the method 400 includes sliding a second tube 342 over the first tube 312. The second tube 342 defines a second longitudinal axis $L_S$. The second longitudinal axis $L_S$ is arranged substantially coincident with the first longitudinal axis $L_F$. At block 406, the method 400 includes attaching a second flange 311*b* to a second end 312*b* of the first tube 312 opposite of the first end 312*a* of the first tube 312. The first tube 312, the first flange 311*a*, and the second flange 311*b* collectively form a first bobbin 310 defining a first slit 314 along the first longitudinal axis $L_F$. The first slit 314 is configured to allow receipt of a primary conductor 202 into the first tube 312. The second tube 342 forms a second bobbin 340 configured to rotate relative to the first bobbin 310. The second bobbin 340 defines a second slit 344 along the second longitudinal axis $L_S$. The second slit 344 is configured to allow receipt of the cable 202 into the first tube 312 and the second tube 342 when the first slit 314 and the second slit 344 are aligned. At block 408, the method 400 includes winding a secondary winding 360 about the first bobbin 310. The secondary winding 360 extends along the first longitudinal axis $L_F$, passing through the first tube 312 and over the first and second flanges 311*a*, 311*b*.

In some examples, the method 400 includes wrapping a core wrap 330 about the second bobbin 340 in a direction substantially perpendicular to the second longitudinal axis $L_S$ by rotating the second bobbin 340 relative to the first bobbin 310 while feeding the core wrap 330 onto the second bobbin 340. The second bobbin 340 may be sized for receipt over the first tube 312 and between the first and second flanges 311*a*, 311*b*. In some examples, the second bobbin 340 includes a third flange 341*a* disposed on the first end 342*a* of the second tube 342, and a fourth flange 341*b* disposed on the second end 342*b* of the second tube 342. The second tube 342, the third flange 341*a*, and the fourth flange 341*b* may collectively define the second slit 344. The secondary winding 360 may pass through the first flange 311*a* and/or the second flange 311*b*.

Referring to FIGS. 5A-5I, in some implementations, a CT 500 includes a first bobbin 520 and a second bobbin 540, where the first bobbin 520 is received by the second bobbin 540. The first bobbin 510 includes a first tube 512 having first and second ends 512*a*, 512 respectively. The tube 512 defines a first longitudinal axis $L_F$. The first bobbin 510 includes a front portion 510*a* and a back portion 510*b*. In addition, the first bobbin 510 includes a first flange 511*a* disposed on the first end 512*a* of the tube 512, and a second flange 511*b* disposed on the second end 512*b* of the tube 512. As shown, the tube 512 is circular; however, other shapes may be possible as well. The first tube 512, the first flange 511*a*, and the second flange 511*b* collectively define a first slit 514 having a slit distance $D_{FB}$ greater than a diameter $D_W$ of the primary conductor 202. As such, the first slit 514 is configured to allow receipt of the primary conductor 202 into the first tube 512. The slit 514 is defined between a first wall 514*a* and a second wall 514*b* of each one of the first and second flanges 511*a*, 511*b* of the first bobbin 510. As such, the opening or slit 314 may have a distance $D_{FB}$ extending from each one of the first wall 514*a* to the corresponding second wall 514*b* that is greater than a diameter $D_W$ of the primary conductor 202.

The CT 500 includes a secondary winding 560 wound about the first bobbin 510. The secondary winding 560 extends along the first longitudinal axis $L_F$, passing through the first tube 512 and over the first and second flanges 511*a*, 511*b*. In some examples, the secondary winding 560 passes through the first flange 511*a* and/or the second flange 511*b*.

The CT 500 also includes a second bobbin 540 having a second tube 542. The second tube 540 has first and second end 542*a*, 542*b*. In addition, the second tube 542 defines a second longitudinal axis $L_S$ extending from the first end 542*a* to the second end 542*h* of the second tube 542. The second tube 542 also defines a second slit 544 configured to rotatably receive the first tube 512 into the second tube 542. As such, the slit 544 of the second tube 542 has a distance that is greater than the distance $D_{FB}$ of the opening 514 of the first tube 512. The second bobbin 540 is sized for receipt over the first tube 512 and between the first and second flanges 511*a*, 511*b*. When the first tube 512 is received into the second tube 542, the first longitudinal axis $L_F$ is substantially coincident with the second longitudinal axis $L_S$ and the second bobbin 540 may spin about the second longitudinal axis $L_S$ relative to the first bobbin 510. In some examples, the second bobbin 540 includes a third flange 541*a* and a fourth flange 541*b*. The third flange 541*a* is disposed on the first end 542*a* of the second tube 542, while the fourth flange 541*b* is disposed on the second end 542*b* of the second tube 542. The third and fourth flanges 541*a*, 541*b* are configured to maintain a position of the core wrap 330 when wound about the second bobbin 540. The third and/or fourth flange 541*a*, 541*b* may include first engagement elements 570 disposed on an outer surface of the third and/or fourth flange 541*a*, 541*b*. As such, each first engagement element 370, 570 interlocks with a second engagement element 736 of a foil dispenser 700.

Figure 5B:
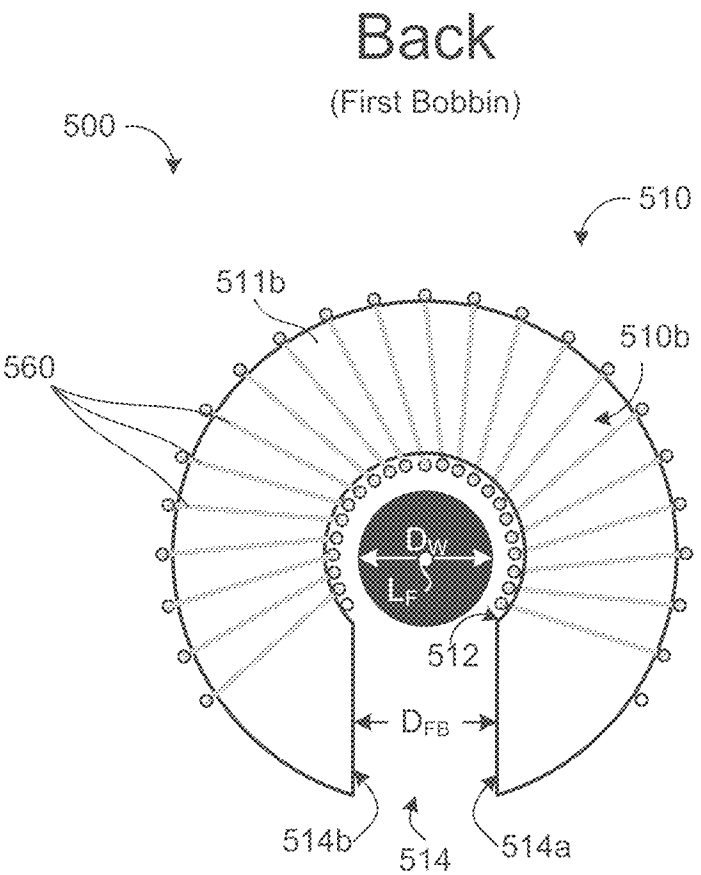
FIG. 5B is a schematic rear view of the exemplary first bobbin of the current transformer of FIG. 5A.
Figure 5A:
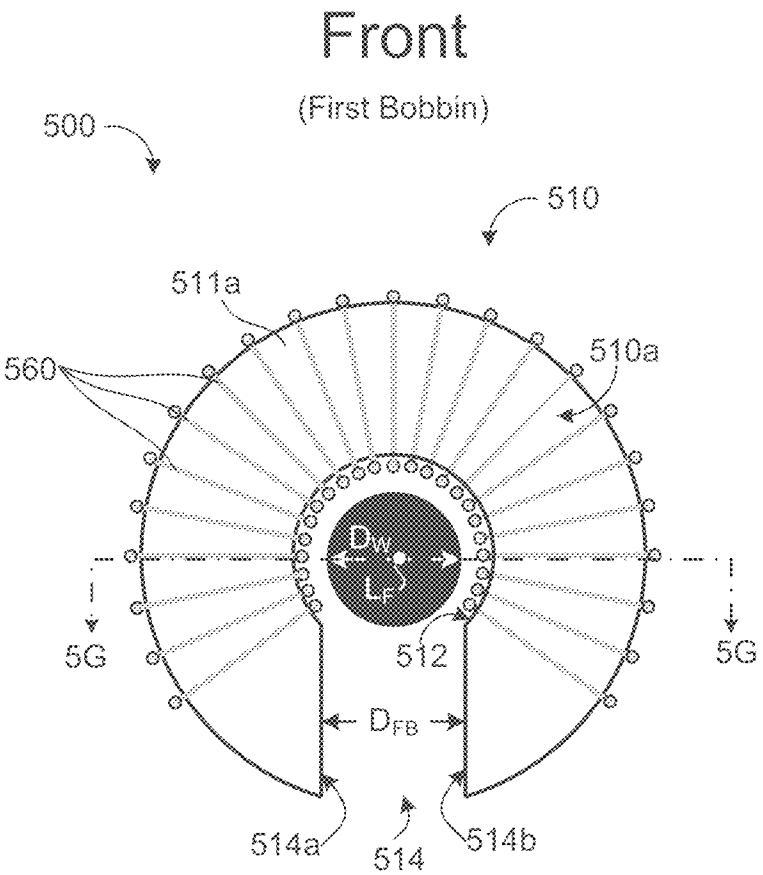
FIG. 5A is a schematic front view of an exemplary first bobbin of a current transformer.
Figure 5D:
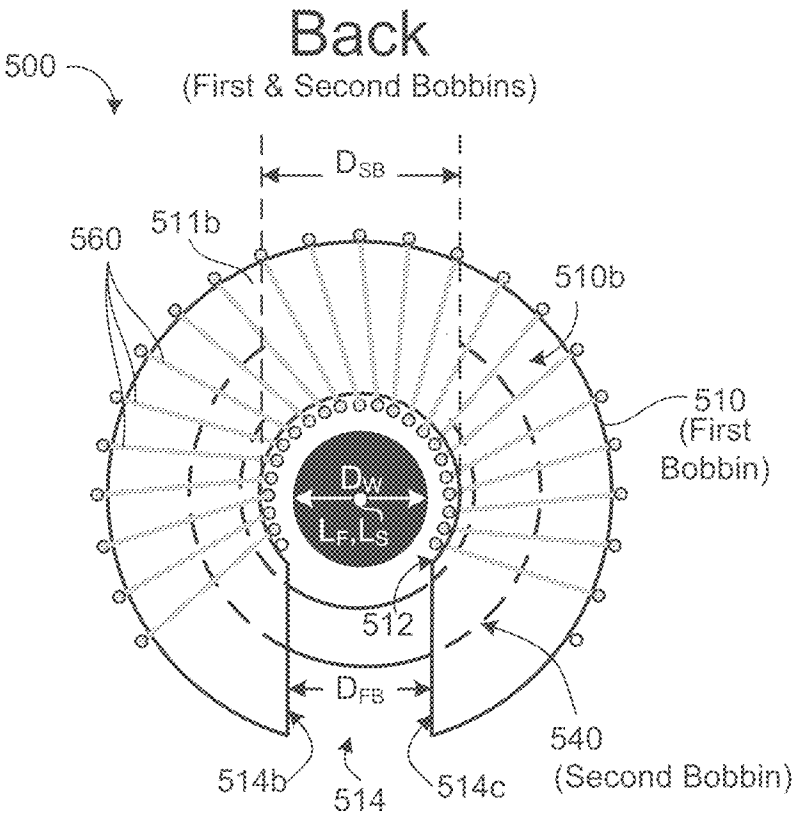
FIG. 5D is a schematic back view of the exemplary first and second bobbins of the current transformer of FIG. 5C.
Figure 5C:
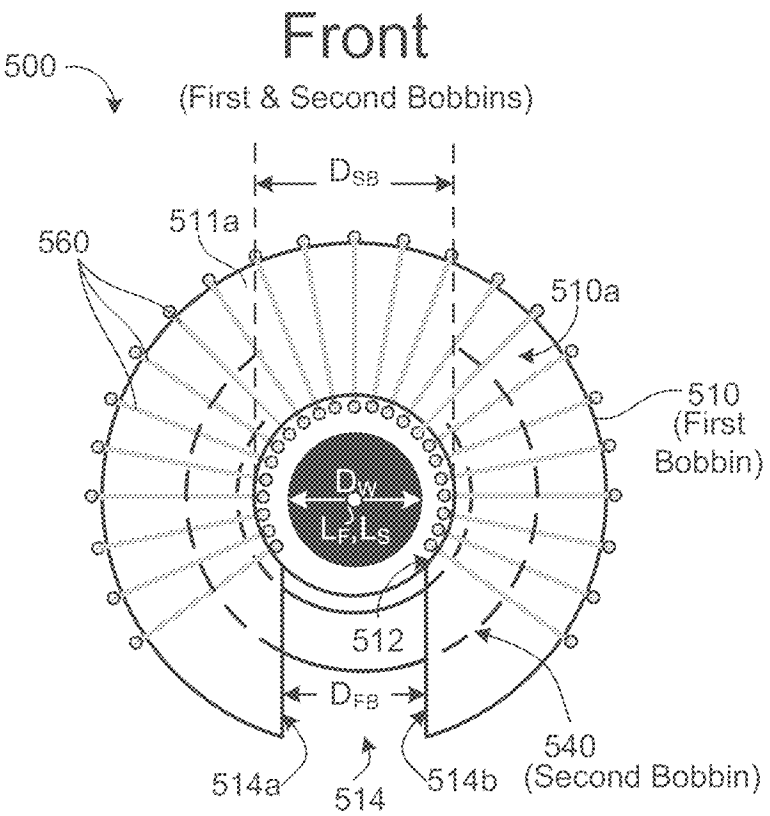
FIG. 5C is a schematic front view of the exemplary first and second bobbins.
Figure 5F:
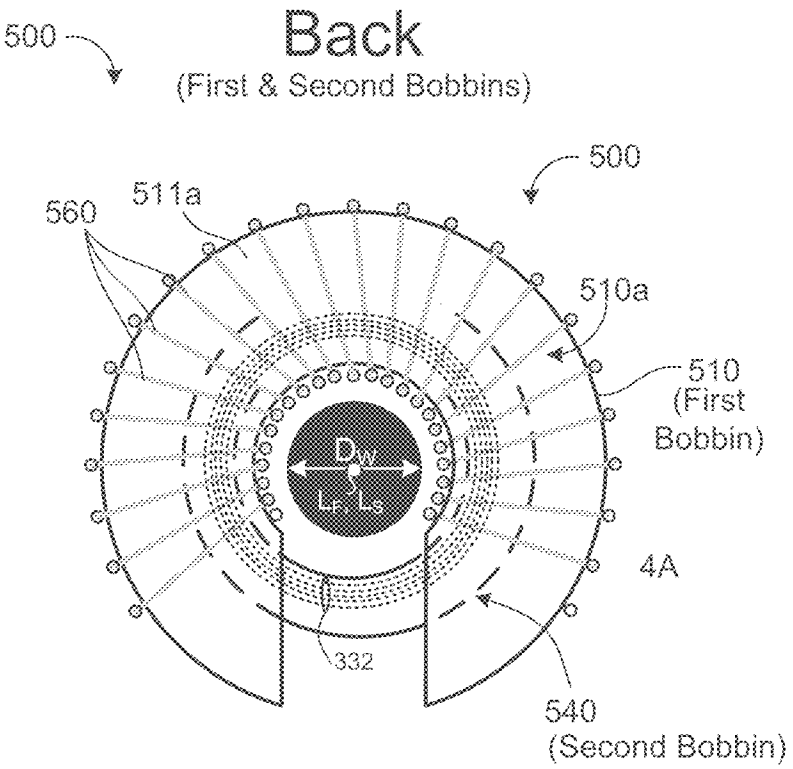
FIG. 5F is a schematic back view of the exemplary first and second bobbins with a wrapped magnetic foil of the current transformer of FIG. 5C.
Figure 5E:
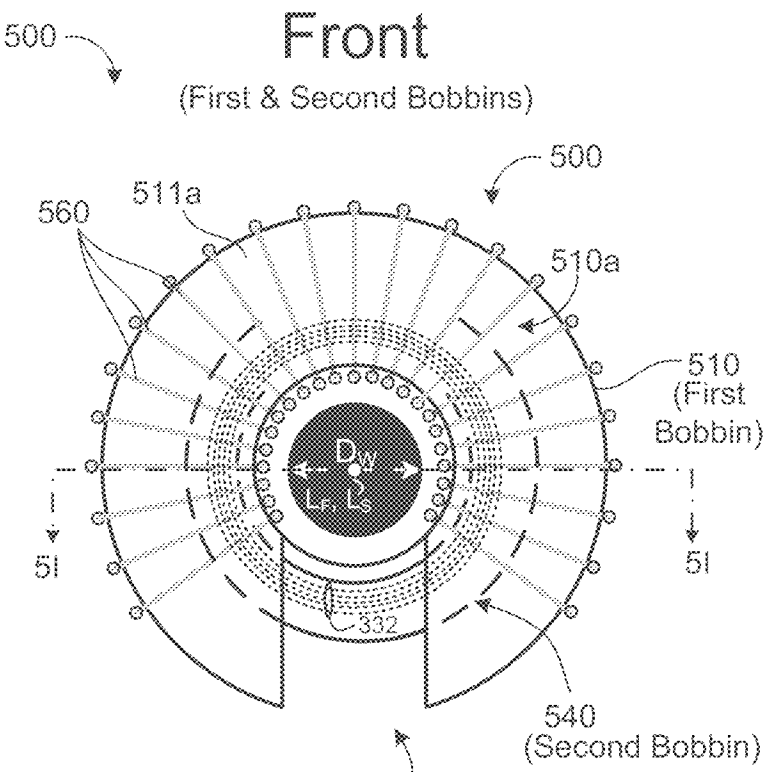
FIG. 5E is a schematic front view of exemplary first and second bobbins with a wrapped magnetic foil.
Figure 5I:
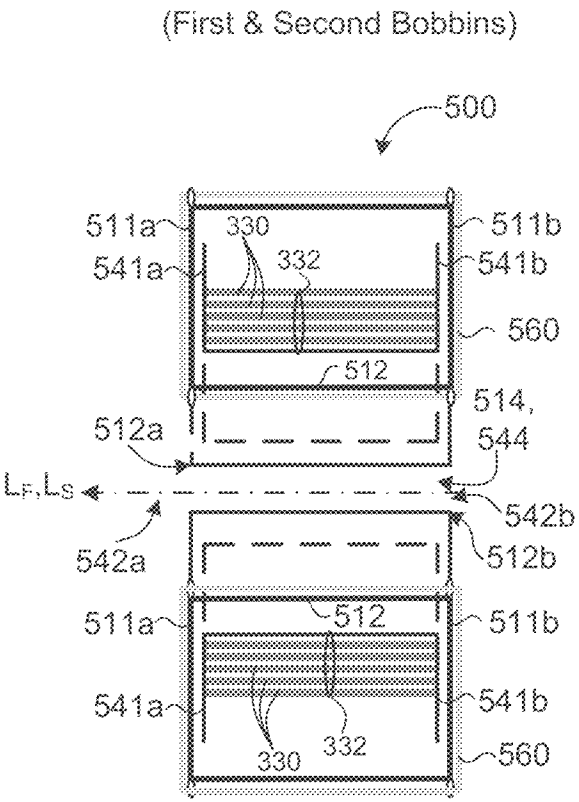
FIG. 5I is a side view of an exemplary current transformer.
Figure 5H:
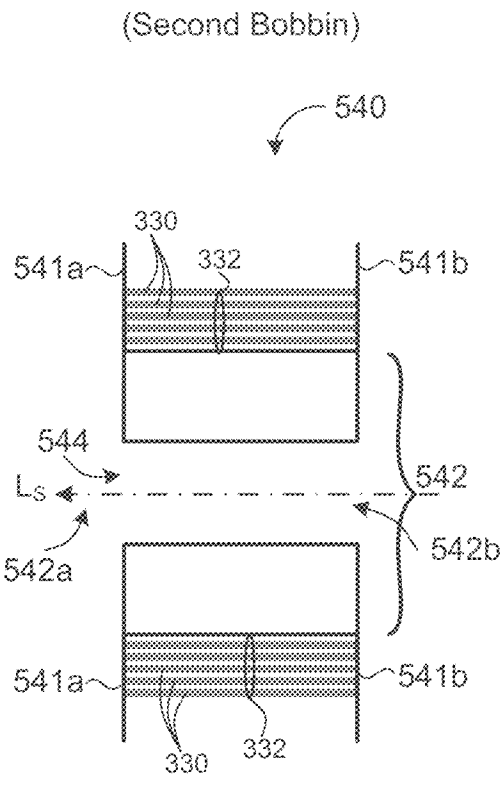
FIG. 5H is a side view of an exemplary second bobbin.
Figure 5G:
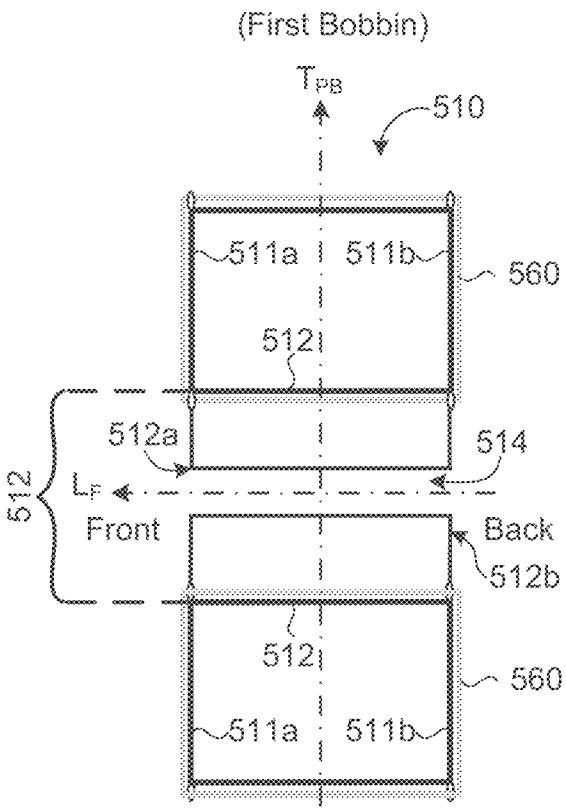
FIG. 5G is a side view of an exemplary first bobbin.

Referring to FIGS. 5E and 5F, a front and back view of the second bobbin 540 being received by the first bobbin 510 are shown. FIGS. 5G and 5H include a core wrap 330 about the second bobbin 540 in a direction substantially perpendicular to the second longitudinal axis $L_S$.

Figure 6A:
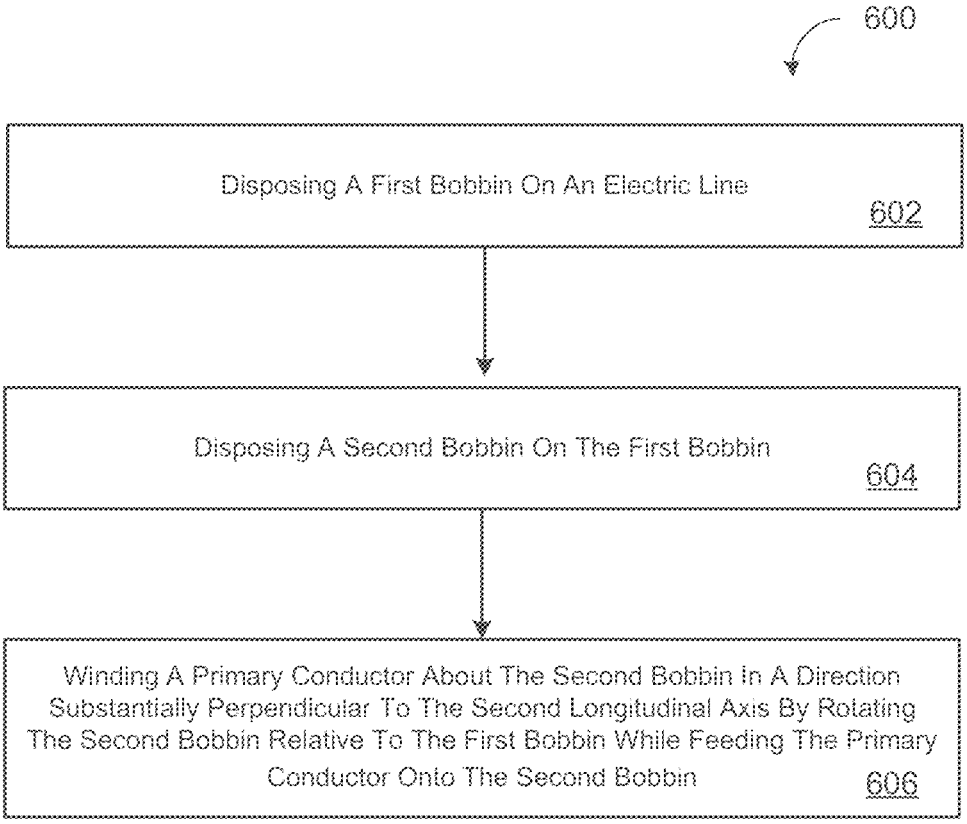
FIG. 6A provides an exemplary arrangement of operations for a method of installing a current transformer on a primary conductor.
Figure 6B:
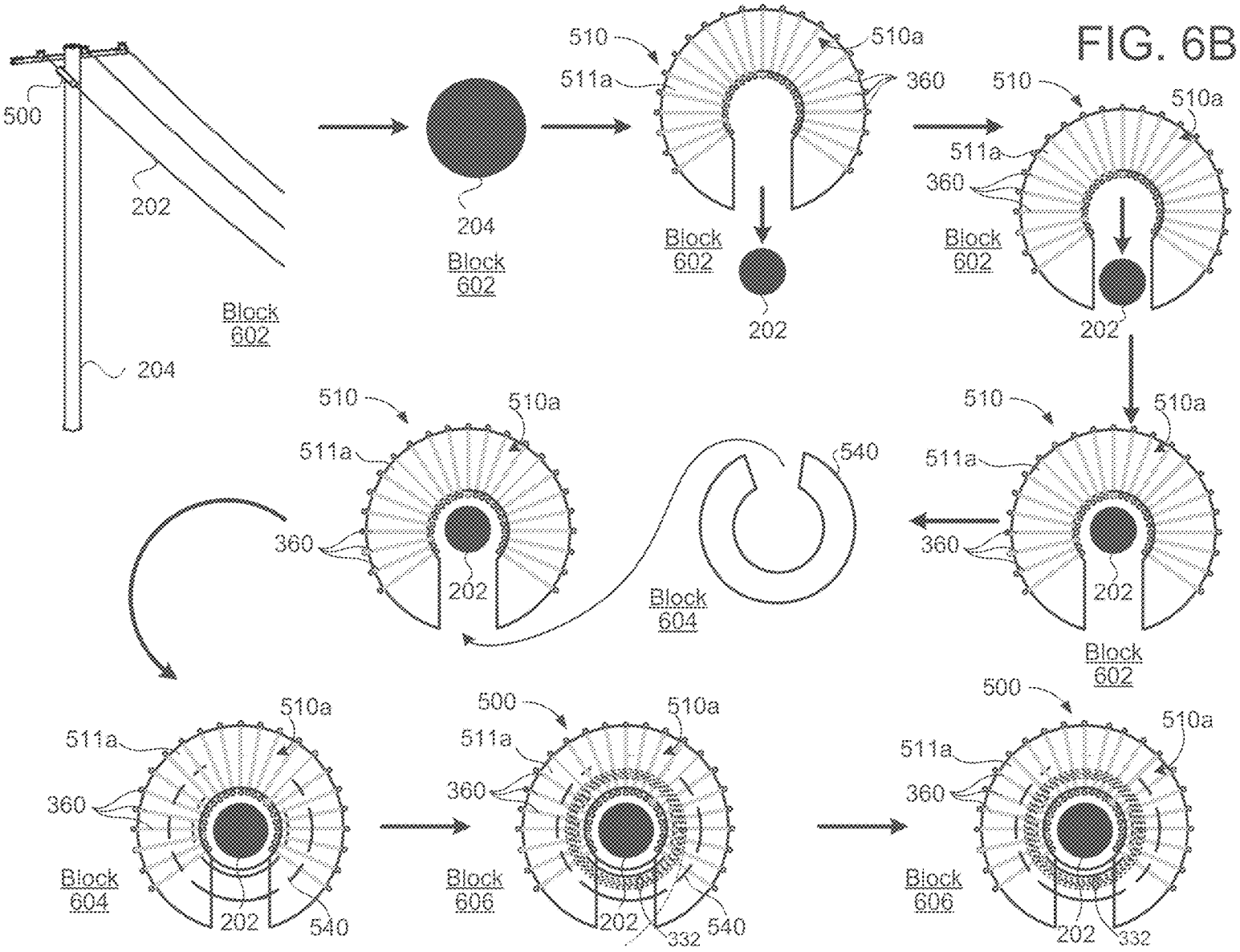
FIG. 6B is a perspective view of the current transformer as applying the method of FIG. 6A.

FIGS. 6A and 6B illustrate a method 600 of installing the CT 500 on a primary conductor 202 supported by one or more utility poles as described with respect to FIGS. 5A-5I. At block 602, the method 600 includes disposing a first bobbin 510 on a primary conductor 202. The first bobbin 510 includes a first tube 512 having first and second ends 512*a*, 512*b* and defining a first longitudinal axis $L_F$. A first flange 511*a* is disposed on the first end 512*a* of the first tube 512. In addition, a second flange 511*b* is disposed on the second end 512*b* of the first tube 512. The first tube 512, the first flange 511*a*, and the second flange 511*b* collectively define a first slit 514 along the first longitudinal axis $L_F$. The first slit 514 is configured to allow receipt of the primary conductor 202 into the first tube 512. A secondary winding 360 is wound about the first bobbin 510. The secondary winding 360 extends along the first longitudinal axis $L_F$, passing through the first tube 512 and over the first and second flanges 511*a*, 511*b*. At block 604, the method 600 includes disposing a second bobbin 540 on the first bobbin 510. The second bobbin 540 includes a second tube 542. At block 606, the method 600 includes winding a core wrap about the second bobbin 540 in a direction substantially perpendicular to the second longitudinal axis by rotating the second bobbin 540 relative to the first bobbin 510 while feeding the primary conductor onto the second bobbin 540. In some examples, the second bobbin 340 may include magnets, an adhesive or other attachment mechanism to allow a leader film 334*a* of the transformer core 332 to attach to it.

The second tube 542 has first and second ends 542*a*, 542*b*. In addition, the second tube 542 defines a second longitudinal axis $L_S$ extending from the first end 542*a* to the second end 542*b* of the second tube 542. The second tube 542 also defines a second slit 544 configured to rotatably receive the first tube 512 into the second tube 542. As such, the slit 544 of the second tube 542 has a distance that is greater than the distance $D_{FB}$ of the opening 514 of the first tube 512. The second bobbin 540 is sized for receipt over the first tube 512 and between the first and second flanges 511*a*, 511*b*. When the first tube 512 is received into the second tube 542, the first longitudinal axis $L_F$ is substantially coincident with the second longitudinal axis $L_S$ and the second bobbin 540 can spin about the second longitudinal axis $L_S$ relative to the first bobbin 510.

Figure 7A:
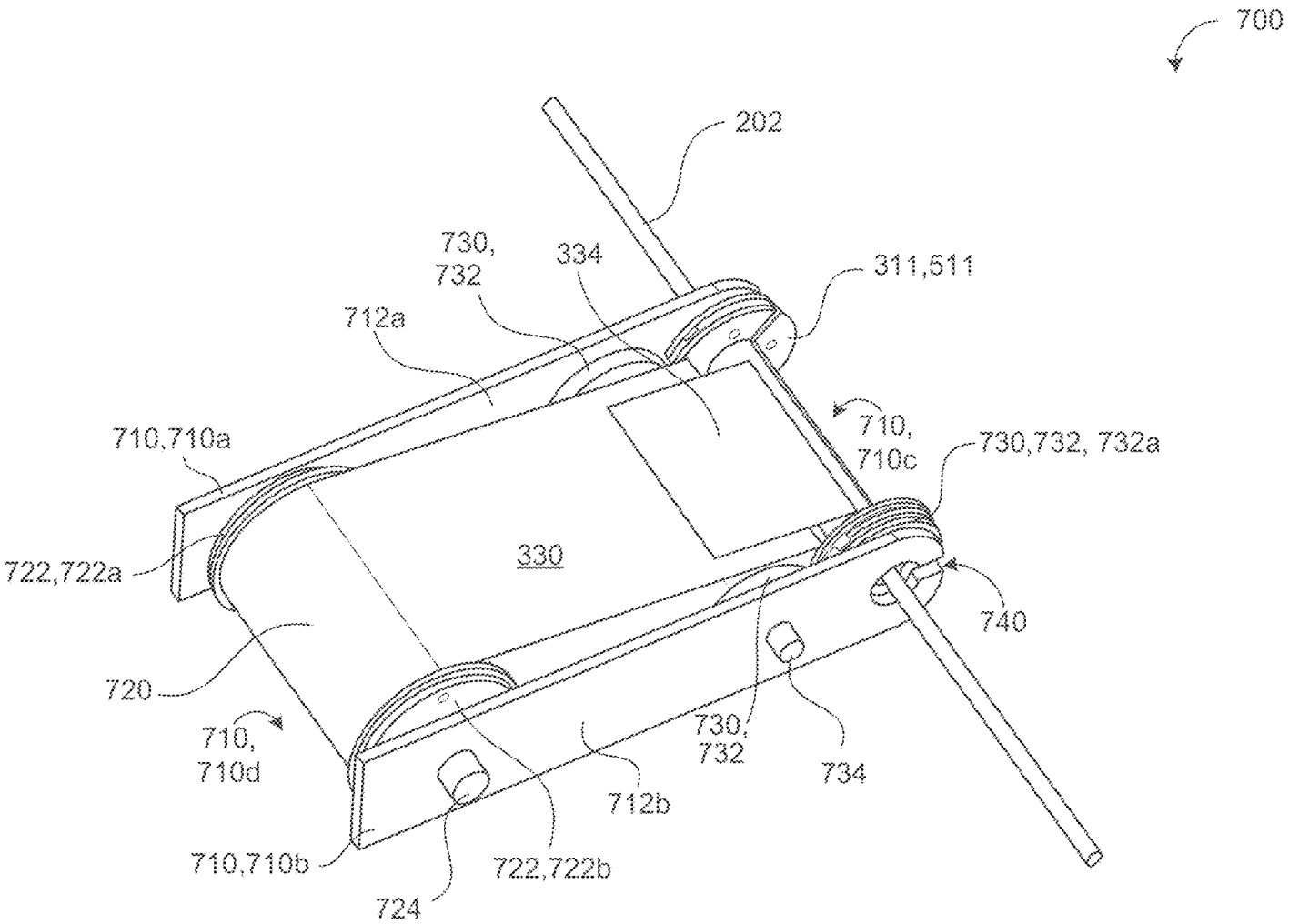
FIGS. 7A-7C are perspective views of an exemplary winding device.
Figure 7B:
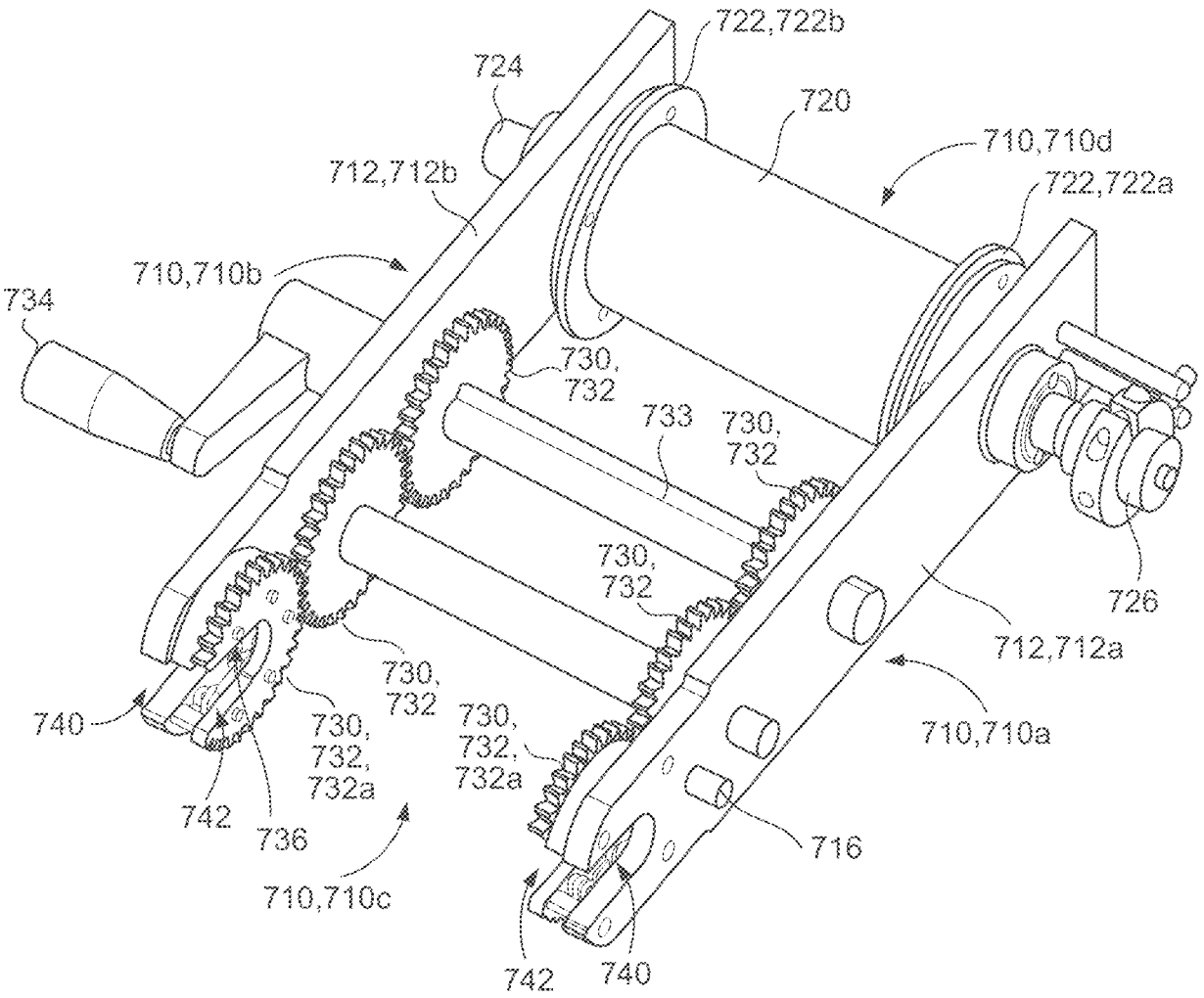
Figure 7C:
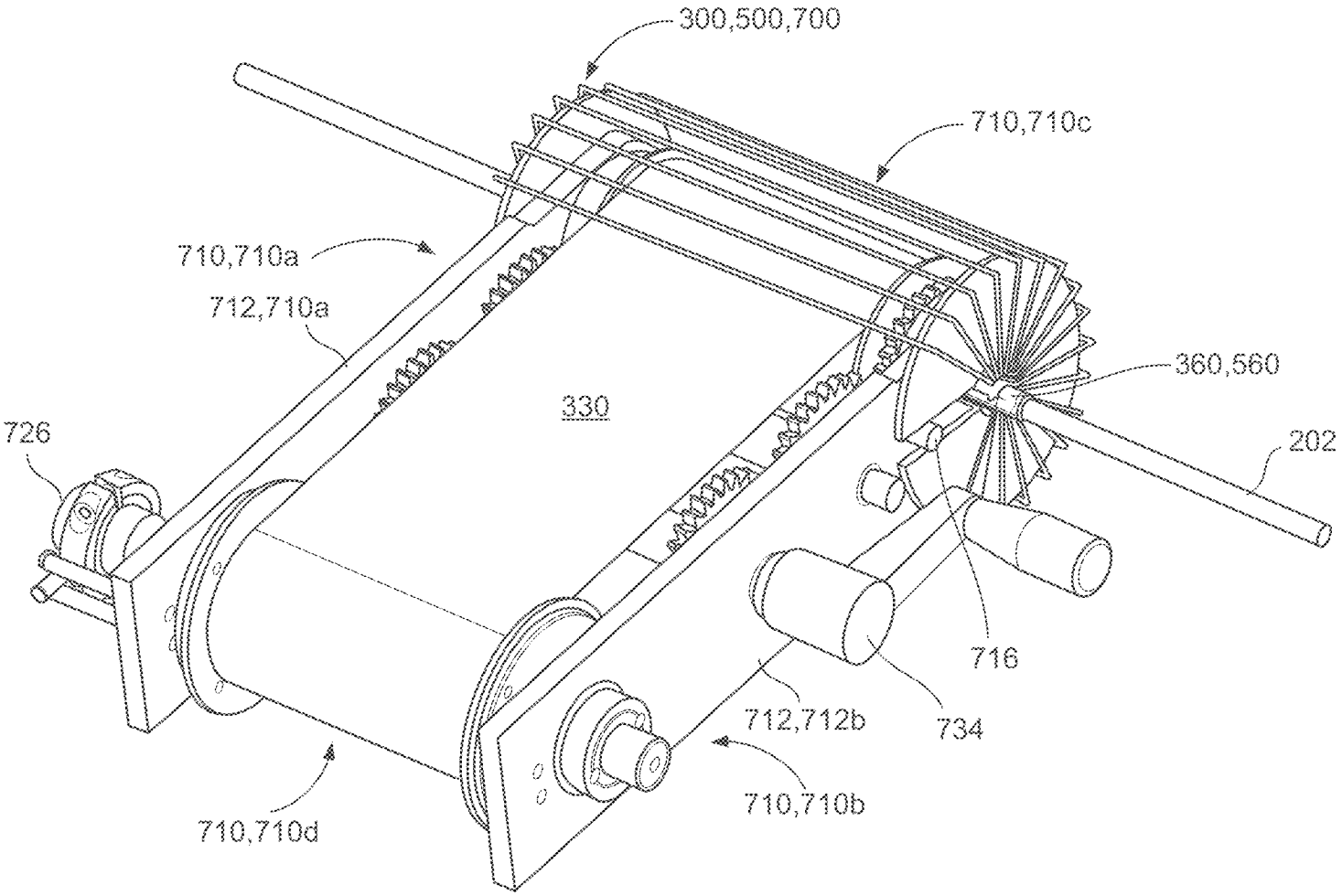

FIGS. 7A-7C illustrate a foil dispenser 700 for wrapping the magnetically permeable foil material 331 (e.g., core wrap 330) on a second bobbin 340, 540 of a CT 300, 500 as described above. Generally, transformer cores are made by stacking and gluing layers of thin soft magnetic foil materials 331 together to form a large core. In some examples, the magnetically permeable foil material 331 has a thickness (not shown) ranging from 1 mil (about 25 microns) to 12 mils (about 300 microns) depending on the desired performance of the CT 300, 500 and material used. More specifically, the magnetically permeable foil material 331 may have a thickness between 0.5 mils (about 12 microns) to 2 mils (about 50 microns). The permeable foil material 331 is used to limit eddy currents forming in the transformer core 332. Eddy currents are loops of electrical current that are induced within conductors by a changing magnetic field in the conductor, due to Faraday's law of induction. The foil dispenser 700 wraps the magnetically permeable foil material 331 onto the second bobbin 340, 540, then seals it. The foil material 331 is carried by a supply reel 720 of the foil dispenser 700 and is annealed before it is wrapped onto the second bobbin 340, 540. The foil dispenser 700 is designed to minimize any stress on the permeable foil material 331 after annealing the permeable foil material 331 to prevent any change in its performance. Annealing is a heat treatment that alters the physical and sometimes chemical properties of a material. In the case of soft magnetic materials, annealing serves to change the lattice structure of the material, which changes parameters of the material, such as coercivity, core loss, and permeability. Annealing involves heating the material to above its re-crystallization temperature, maintaining a suitable temperature sometimes in the presence of gases, and then cooling. As such, the BH curve shape of the CT core is extremely dependent on the annealing done to the core. Stress induced slip anisotropy reduces performance.

The foil dispenser 700 includes a dispenser body 710. In the example shown, the dispenser body 710 has left and right sides 710*a*, 710*b* as well as a leading end 710*c* and a tailing end 710*d*. The dispenser body 710 may include left and right side plates 712, 712*a*, 712*b*, The left and right side plates 712*a*, 712*b* may be spaced from and substantially parallel to one another, where the supply reel 720 is supported between the left and right side plates 712*a*, 712*b*. In other examples, the dispenser body 710 has other shapes. In some examples, at least one of the side plates 712, 712*a*, 712*b* is movable with respect to the other allowing the foil dispenser 700 to position the CT 300, 500 for dispensing the core wrap 330 on the second bobbin 340, 540 of the CT 300, 500.

The dispenser body 710 defines a rotation limiter 716 configured to engage and limit rotation of the first bobbin 310, 510 while rotating the second bobbin 340, 540. In some examples, the rotation limiter 716 is supported by one or both of the left and right side plates 712*a*, 712*b*. As shown, the rotation limiter 716 includes a protrusion configured for receipt by a dent or slit 314, 514 defined by one of the flanges 311, 511 of the first bobbin 310, 510.

The foil dispenser 700 includes a bobbin drive 730 configured to engage and rotate the second bobbin 340, 540 relative to the first bobbin 310, 510. In some examples, the bobbin drive 730 includes one or more gears 732 and a crank 734. The gear 732 may be supported by the right and left plates 712*a*, 712*b*. In some examples, the dispenser body 710 includes left and right gears 732 each supported by the corresponding left and right side plates 712*a*, 712*b*. A main gear 732*a* includes one or more second engagement elements 736 configured to engage the second bobbin 340, 540 and rotate the second bobbin 340, 540 with respect to the first bobbin 310, 510. The second engagement elements 736 may include protrusions or recesses defined by a side surface of the main drive gear 732*a*. In some examples, two main gears 732*a* on each side of the foil dispenser 700 include the second engagement elements 736, while in other examples, only one side includes the second engagement elements 736. As such, the second bobbin 340, 540 includes a complementary engagement element to receive the engagement element of the main gear 732*a*. In some examples, a winding shaft 733 extending between the drive gears 732 may be manually powered by a crank 734 or motorized (not shown), and is configured to rotate the drive gears 732, which results in rotation of the second bobbin 340, 540.

The foil dispenser 700 includes a releasable supply reel 720 configured to provide the core wrap 330 to be wound about the second bobbin 340, 540. In some examples, the foil dispenser 700 includes left and right mounting plates 722, 722*a*, 722*b* supported by the corresponding left and right side plates 712*a*, 712*b*.

In some examples, the foil dispenser 700 includes a torque limiter 726, such as a drag clutch or a clutch, configured to minimize the stress on the foil material 331. The torque limiter 726 is coupled to the supply reel 720 and configured to resist rotation of the supply reel 720. The torque limiter is an automatic device that protects the foil dispenser 700 from damage by mechanical overload. The torque limiter 726 limits the torque by slipping (as in a friction plate slip-clutch), or uncoupling the load entirely (as in a shear pin). In some examples, the supply reel includes an axle 724 rotatably supported by the dispenser body 710 and the clutch 726 is configured to exert frictional resistance to rotation of the axle 724. The axle 724 extends between the left and right mounting plates 722*a*, 722*b* and is configured to simultaneously rotate the left and right mounting plates 722*a*, 722*b* causing unwinding of the supply reel 720.

In some examples, the core wrap 330 includes a double-sided tape coil started strip 334 that is configured to attach to the second bobbin 340, 540 and prevent the foil material 331 from rolling off. In some examples, the strip 334 is a plastic wrap that forms an environmental seal over the transformer core 332.

In some examples, the dispenser body 710 defines a first slot 740 configured to receive a cable or primary conductor 202 axially received by the first and second bobbins 310, 340, 510, 540. In some examples, each of the left and right side plates 712*a*, 712*b* defines the slot 344 at their leading end 710*c*. The chive gear 732 defines a second slot 742 configured to receive the primary conductor 202 and allow substantially coaxial placement of the drive gear 732*a* relative to the second bobbin 340, 540.

An inner diameter of the roll of core wrap 330 on the supply reel 720 is based on a desired core inner diameter of the CT 300, 500, so that the process of unrolling the foil material 331 from the supply reel 720 onto the second bobbin 540 induces the least stress. In some examples, the foil material 331 is laminated. The core wrap 330 is annealed following the desired anneal profile to achieve the target BH curve after being placed on the supply reel 720.

The foil material 331 is laminated and then rolled onto the supply reel 720 and then the foil material 331 is annealed at an optimal temperature and environmental conditions to maximize the performance of the foil material 331, where the optimal temperature is based on the material. The supply foil material 331 may be connected to the second bobbin 340, 540 using a plastic wrap leader to form an environmental seal under the transformer core 332. In some examples, the annealing process includes a temperature profile in Hydrogen gas environment.

Figure 7D:
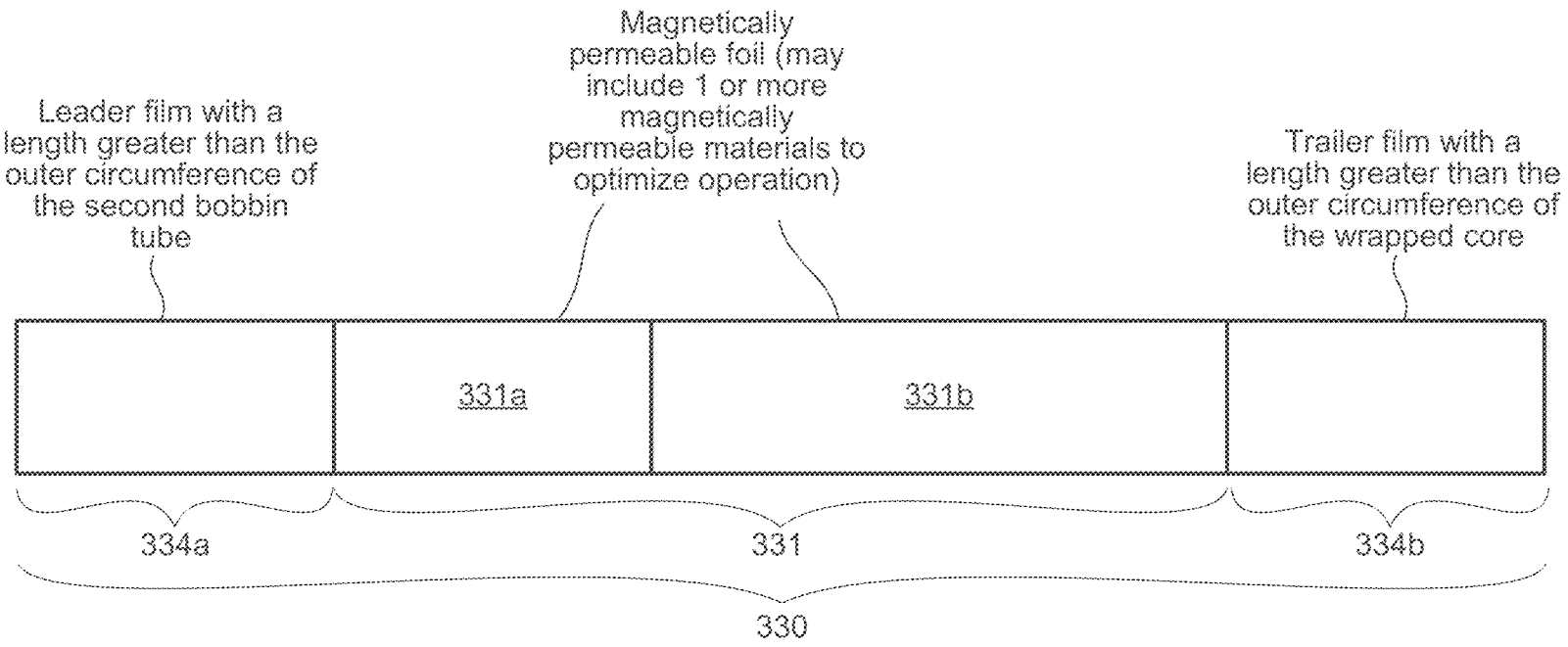
FIG. 7D is a side view of an example foil.
Figure 7E:
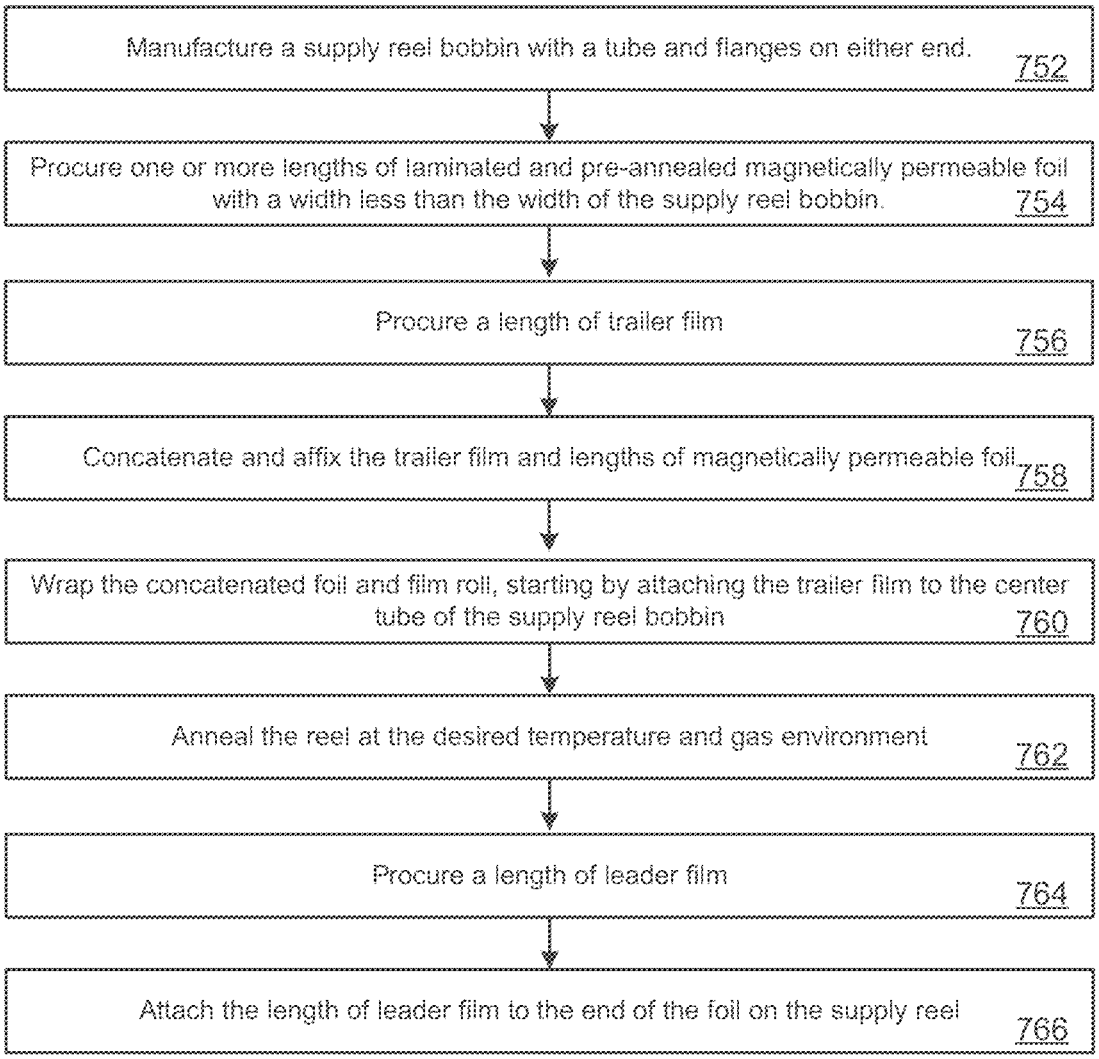
FIG. 7E is a schematic view of an exemplary arrangement of operations for a method of assembling a foil dispenser.

FIG. 7E illustrates a method 750 of assembling the foil dispenser 700 with additional reference to FIG. 7D. At block 752, the method 750 includes manufacturing a supply reel bobbin 720 with tube and flanges on either end. At block 754, the method 750 includes procuring one or more lengths of laminated and pre-annealed magnetically permeable foil material 331 with a width that is less than a width of the supply reel bobbin 720. At block 756, the method 750 includes procuring a length of trailer film 334*b* (FIG. 7D). The trailer film 334*b* is used to protect the outer surface of the core wrap 330 from the environment after the foil 331 has been wrapped onto the concentric bobbin assembly 300, 500 in the field. The foil material 331 along with the trailer film 334*b* is wrapped onto the supply reel 720 with the trailer film 334*b* first connected to the tube of the supply reel 720. At block 758, the method 750 includes concatenating and affixing the trailer file and lengths of the magnetically permeable foil material 331. In some examples, the magnetically permeable foil material 331 may be formed by concatenating two or more foil materials 331*a*, 331*b* of different magnetically permeable material. One such reason is to maximize a magnetic flux density in the core wrap 330 for a certain amount of current on the primary conductor 202 by using a material with a higher saturation flux but a higher coercive force (e.g., Orthogonal) as the first foil after the leader film 334*a* and using a magnetically permeable foil with a lower saturation flux (e.g., Supermalloy) but lower coercive force as the second foil before the trailer film 334*b*. At block 760, the method 750 includes wrapping the concatenated foil 331 and film roll 334, by attaching the trailer film 334*b* to the center tube of the supply reel bobbin 720. At block 762, the method 750 includes annealing the supply reel 720 at a desired temperature and gas environment. In some examples, this is done in hydrogen gas environment with a specific temperature profile. At block 764, the method 750 includes procuring a length of leader film 334*a*. Finally at block 766, the method 750 includes attaching the length of the leader film 334*a* to the end of the foil on the supply reel 720. The leader film 334*a* is used to protect the inner surface of the formed foil core and to attach the foil from the supply reel 720 to the second bobbin 340, 540. The leader film 334*a* may contain magnets or an adhesive to affix it to the second bobbin 340, 540 when being installed in the field. As described, the width of the foil material 331, leader and trailer films 334*a*, 334*b* are selected to have a width that is less than a width of the second bobbin 340, 540. An outer diameter of the supply reel 720 is selected to minimize the stress on the core wrap 330.

Figure 7F:
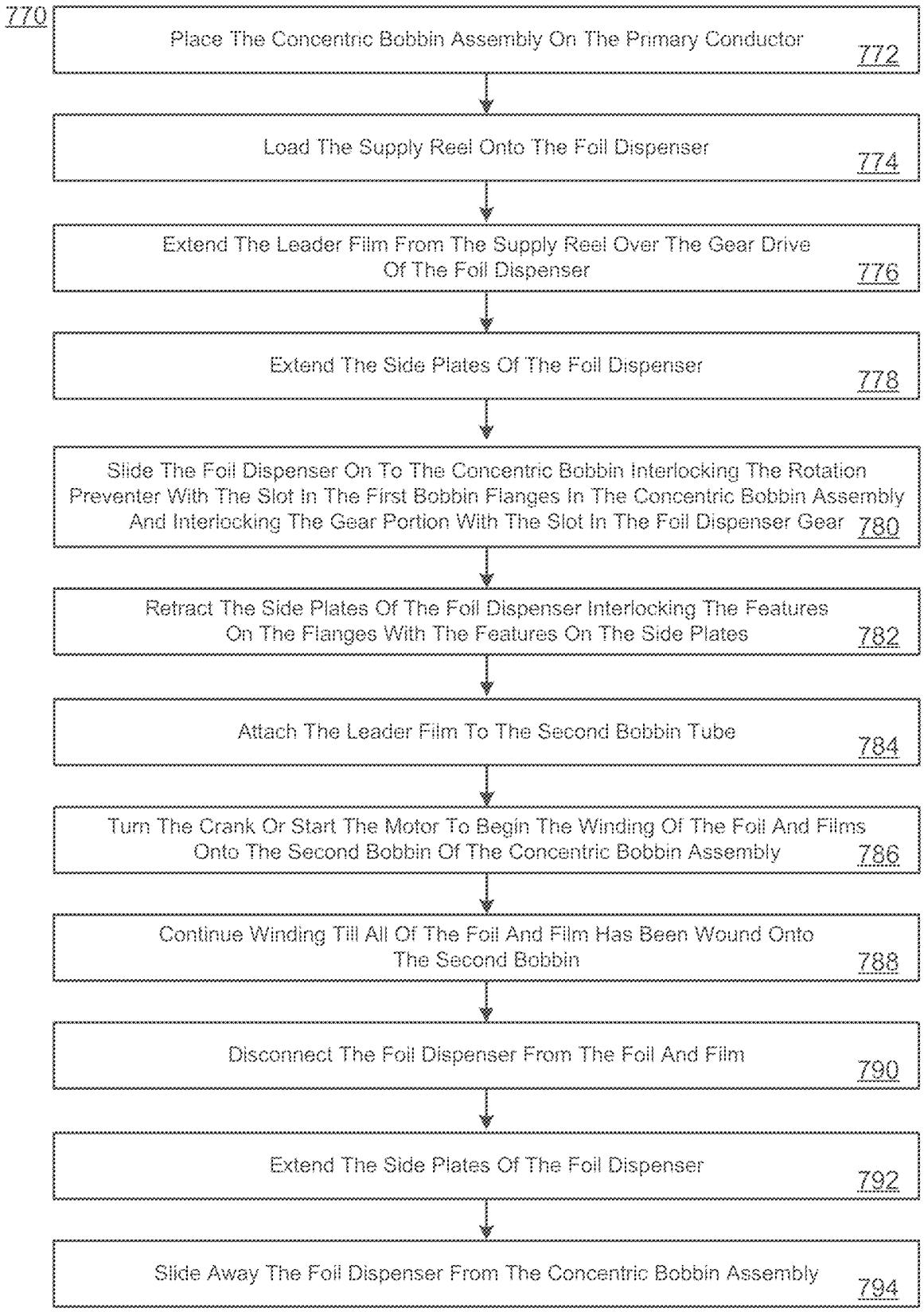
FIG. 7F is a schematic view of an exemplary arrangement of operations for a method of installing a current transformer on a primary conductor.

FIG. 7F illustrates a method 770 of installing the CT 300, 500 on a primary conductor 202 and using the foil dispenser to wrap a film 334*a*, 334*b* and foil material 331 onto the CT 300, 500. At block 772, the method 770 includes placing the CT 300, 500 (i.e., concentric bobbin assembly) on a primary conductor 202. The method includes rotating the first slit 314, 514 and second slit 344, 544 of the first and second tubes respectively until they are coincident before placing the CT 300, 500 onto the primary conductor 202. At block 774, the method 770 includes loading the supply reel 720 onto the foil dispenser 700. The foil dispenser 700 with a loaded supply reel 720 is setup such that a leader film 334*s* extends in the area of the CT 300, 500. At block 776, the method includes extending the leader film 334*a* from the supply reel 720 over the gear drive of the foil dispenser 700. The side walls of the foil dispenser 700 are extended to allow it to pass around the second bobbin 340, 540 of the CT 300, 500. At block 780, the method 770 includes sliding the foil dispenser 700 on to the CT 300, 500 interlocking the rotation preventer with the slot in the first bobbin flanges in the CT 300, 500 and interlocking the gear portion with the slot in the foil dispenser gear. At block 782, the method 770 includes retracting the side plates 710*a*, 710*b* of the foil dispenser 700 interlocking the features on the flanges with the features on the side plates 736. At block 784, the method 770 includes attaching the leader film 334*a* to the second tube of the second bobbin 340, 540. In some examples, magnets, adhesives, or other attachment mechanisms makes a connection to the matching adhesive or magnet on the second tube 340, 540. At block 786, the method 770 includes turning a crack or start motor to begin winding of the foil material 331 and films 334*a*, 334*b* onto the second bobbin 340, 540 of the CT 300, 500. At block 788, the method 770 includes continuing winding until all of the foil material 331*a* and film 334*a*, 334*b* has been wound onto the second bobbin 340, 540. At block 790, the method 770 includes disconnecting the foil dispenser 700 from the foil material 331 and films 334*a*, 334*b*. At block 792, the method includes extending the side plates 710*a*, 710*b* of the foil dispenser 700. At block 794, the method 770 includes sliding away the foil dispenser from the CT 300, 500.

Figure 8B:
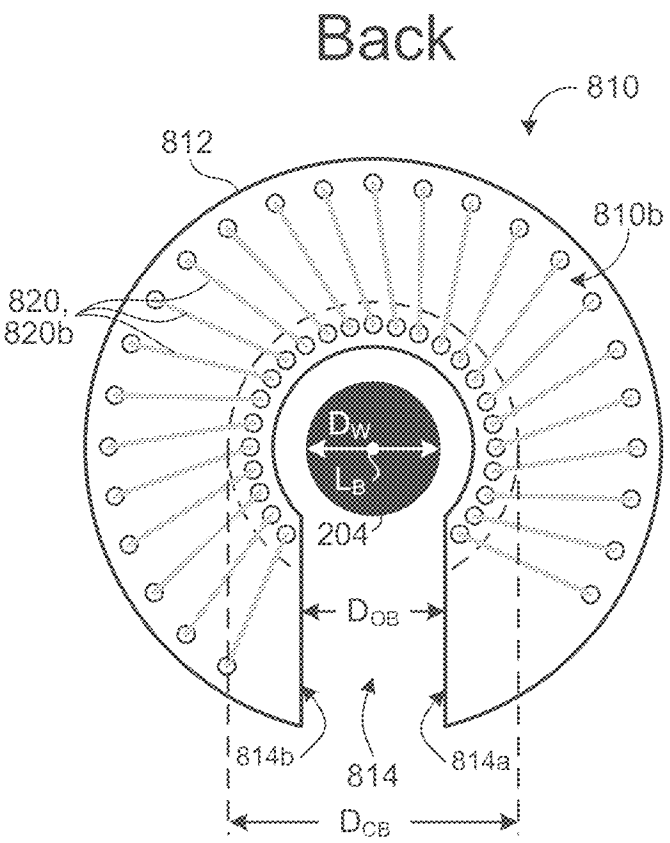
FIG. 8B is a schematic rear view of the exemplary housing base of the current transformer of FIG. 8A.
Figure 8A:
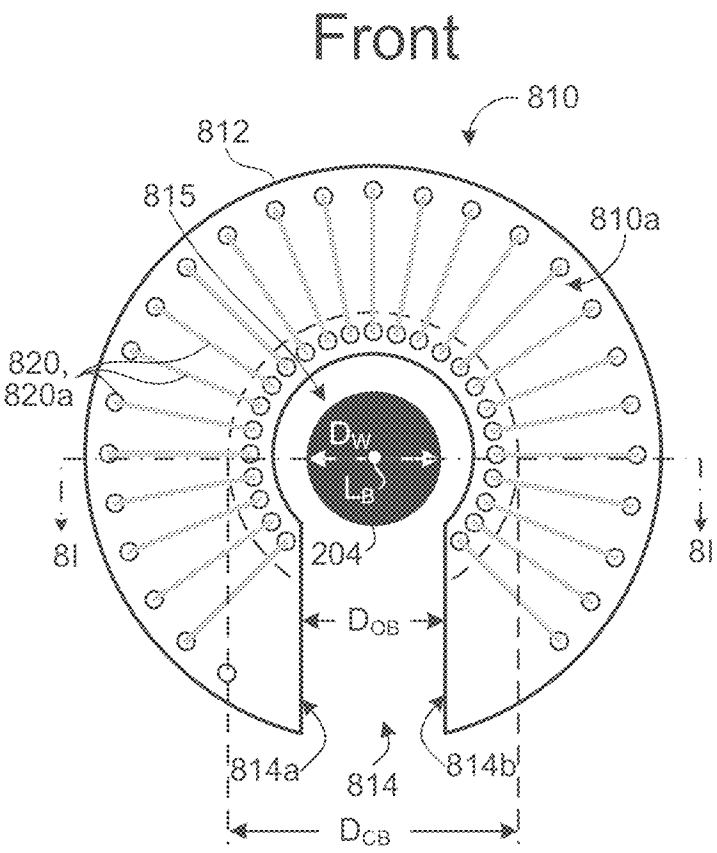
FIG. 8A is a schematic front view of an exemplary housing base of a current transformer.
Figure 8D:
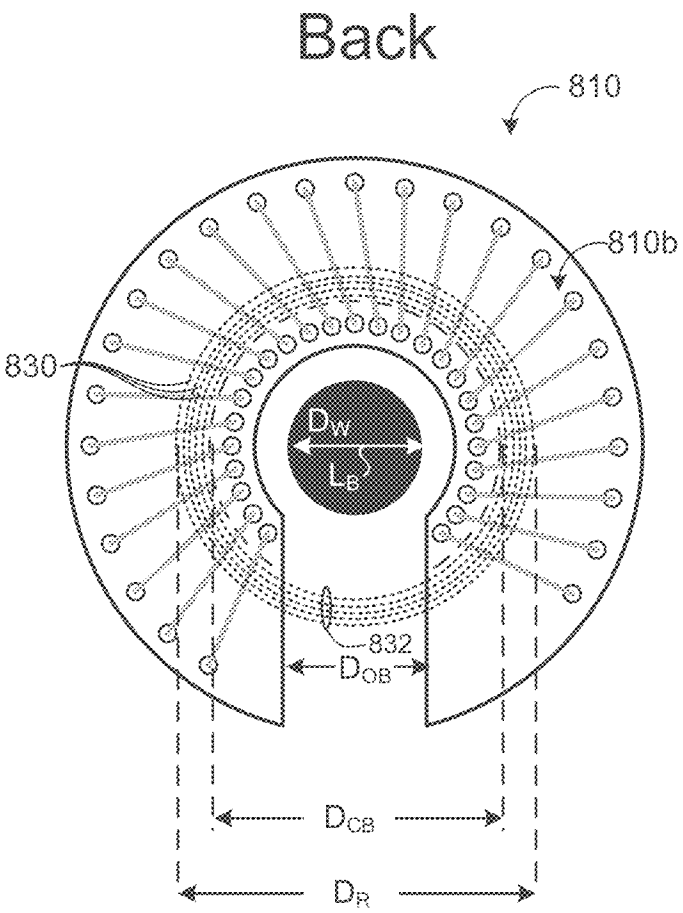
FIG. 8D is a schematic back view of the exemplary housing base and a core wrap of the current transformer of FIG. 8C.
Figure 8C:
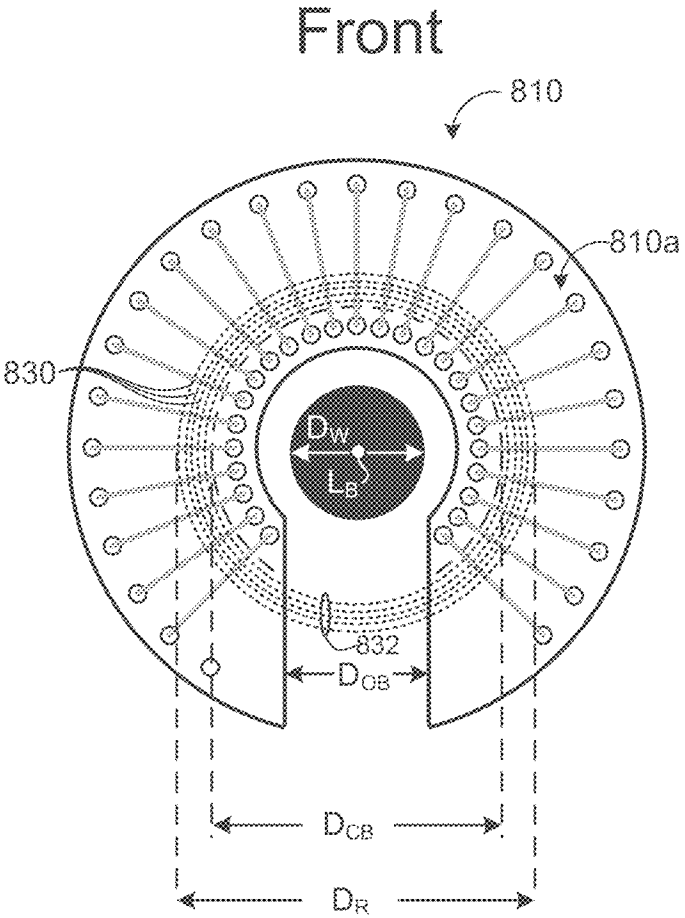
FIG. 8C is a schematic front view of an exemplary housing base and a core wrap.
Figure 8F:
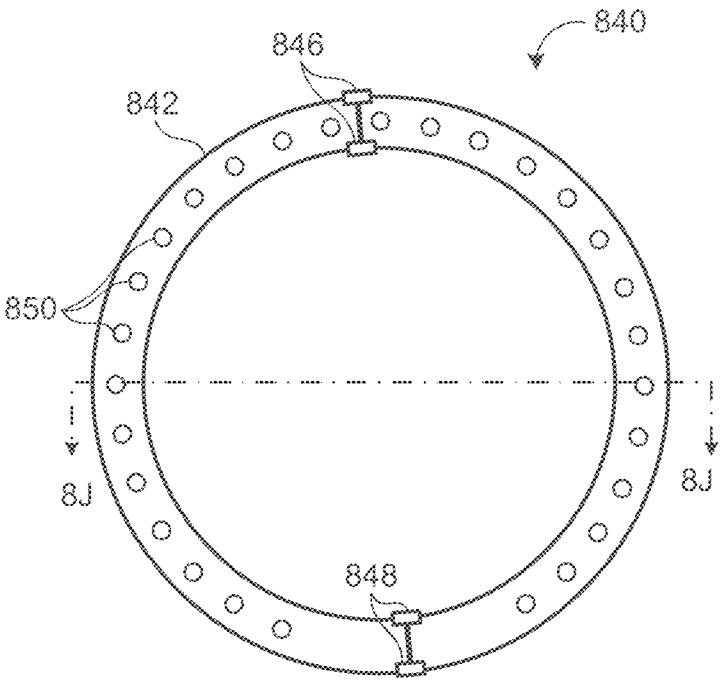
FIG. 8F is a schematic back view of the exemplary housing cover of the current transformer of FIG. 8E.
Figure 8E:
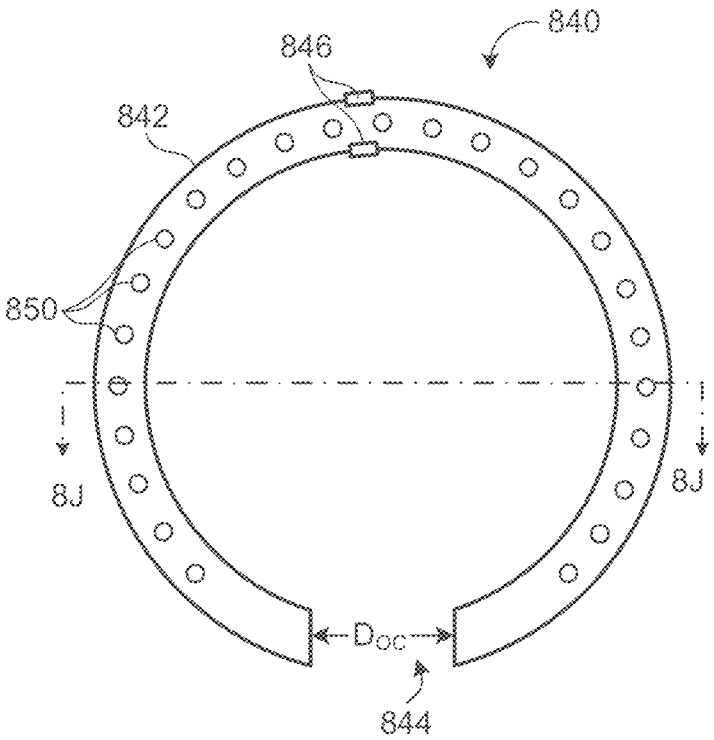
FIG. 8E is a schematic front view of an exemplary housing cover of a current transformer.
Figure 8H:
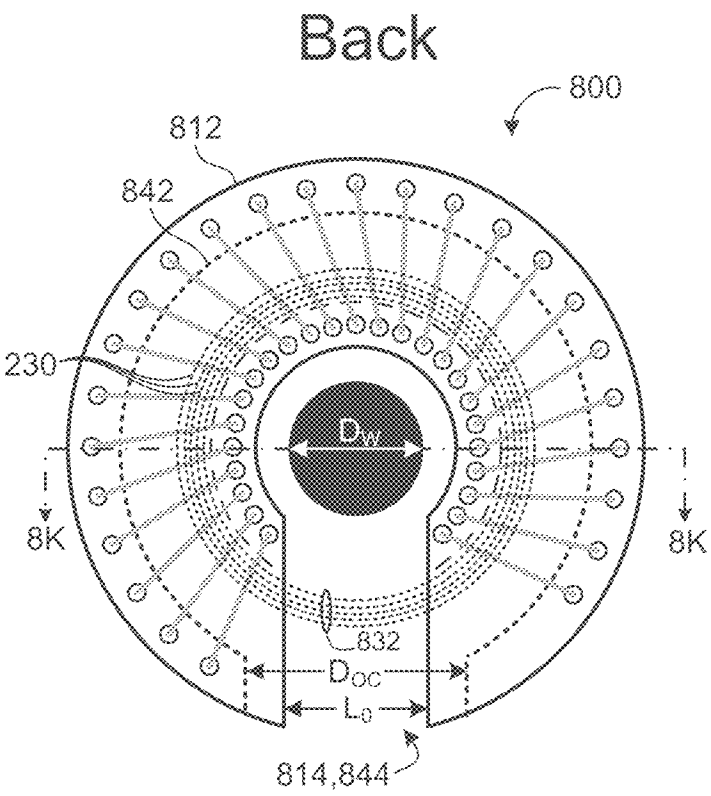
FIG. 8H is a schematic back view of the exemplary housing base, a core wrap, and a housing cover of the current transformer of FIG. 8G.
Figure 8G:
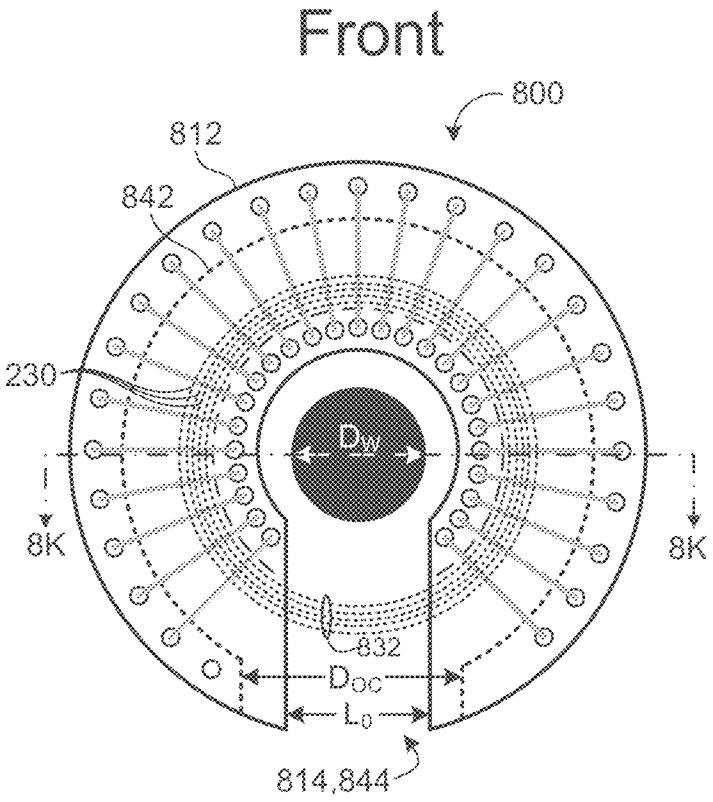
FIG. 8G is a schematic front view of the exemplary housing base, a core wrap, and a housing cover of a current transformer
Figure 8K:
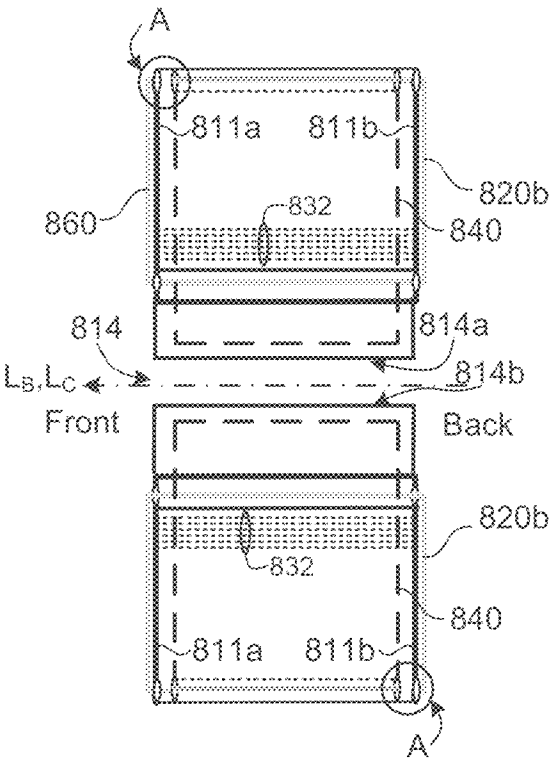
FIG. 8K is a side view of an exemplary current transformer.
Figure 8J:
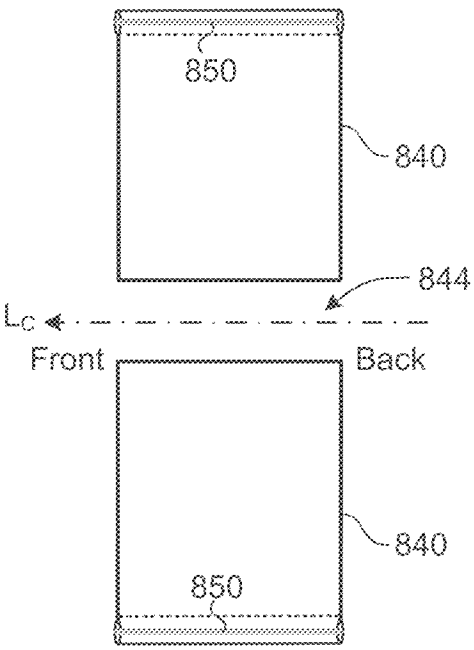
FIG. 8J is a side view of an exemplary housing cover.
Figure 8I:
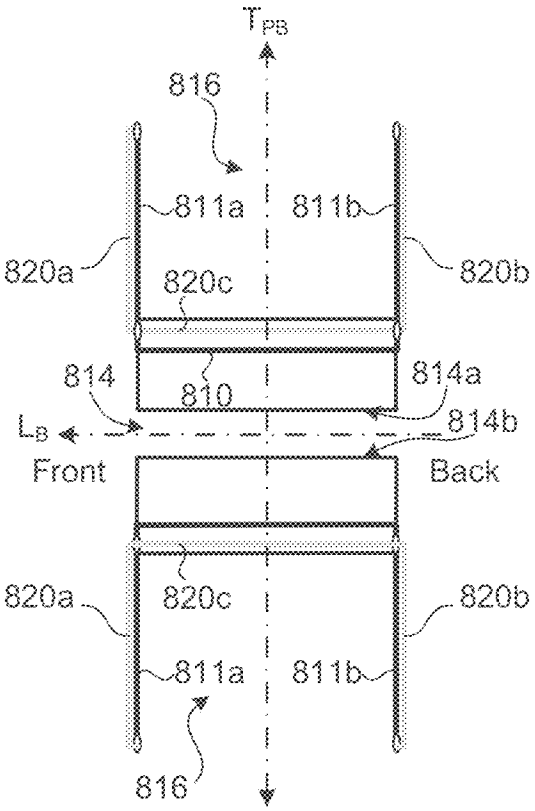
FIG. 8I is a side view of an exemplary housing base.
Figure 8L:
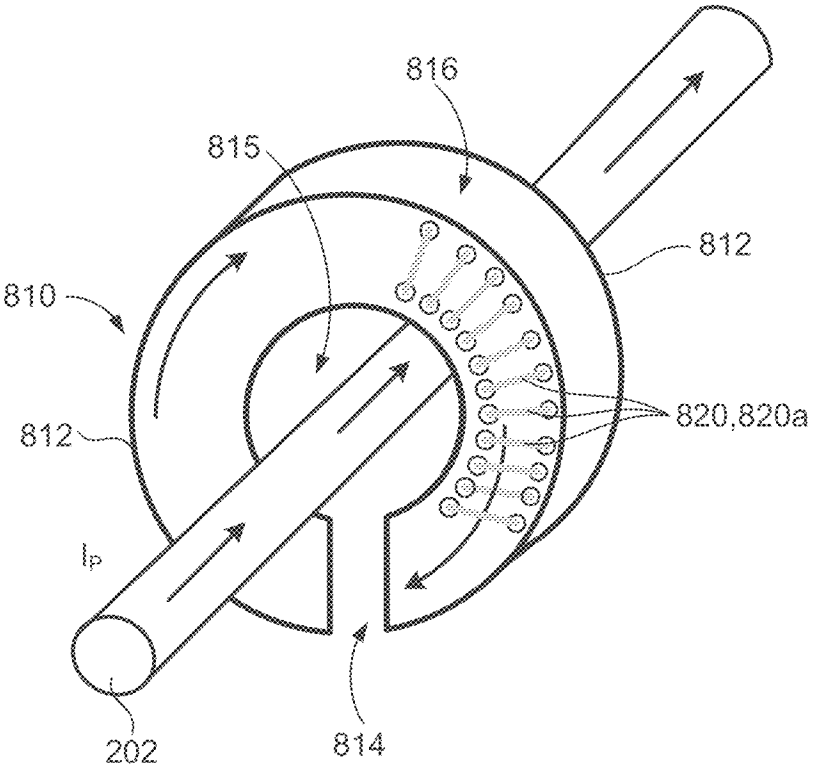
FIG. 8L is a perspective view of a housing base on a primary conductor.
Figure 8M:
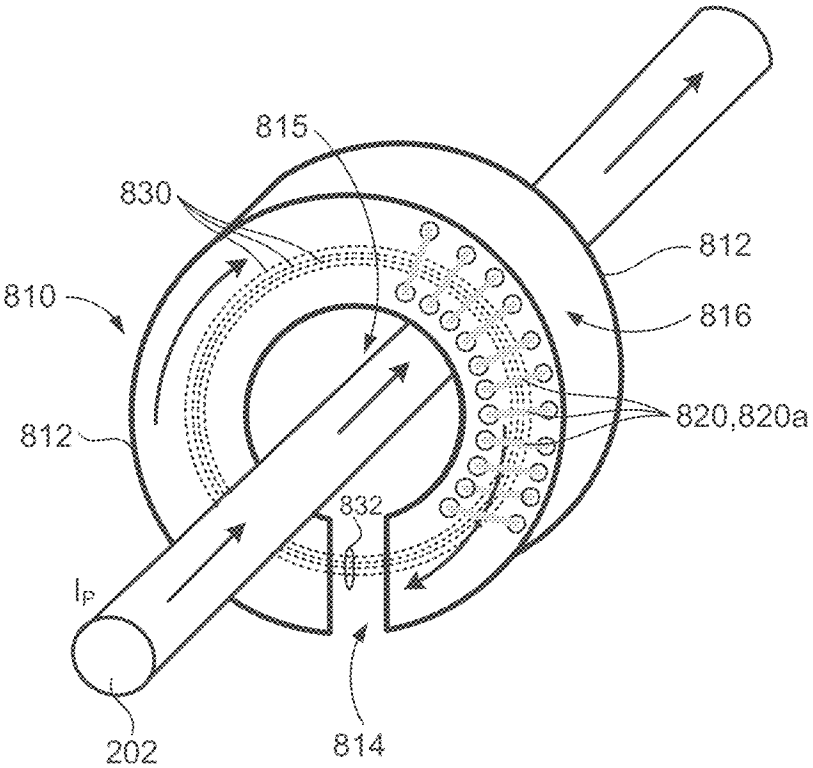
FIG. 8M is a perspective view of a housing base having a winding and on a primary conductor.
Figure 8N:
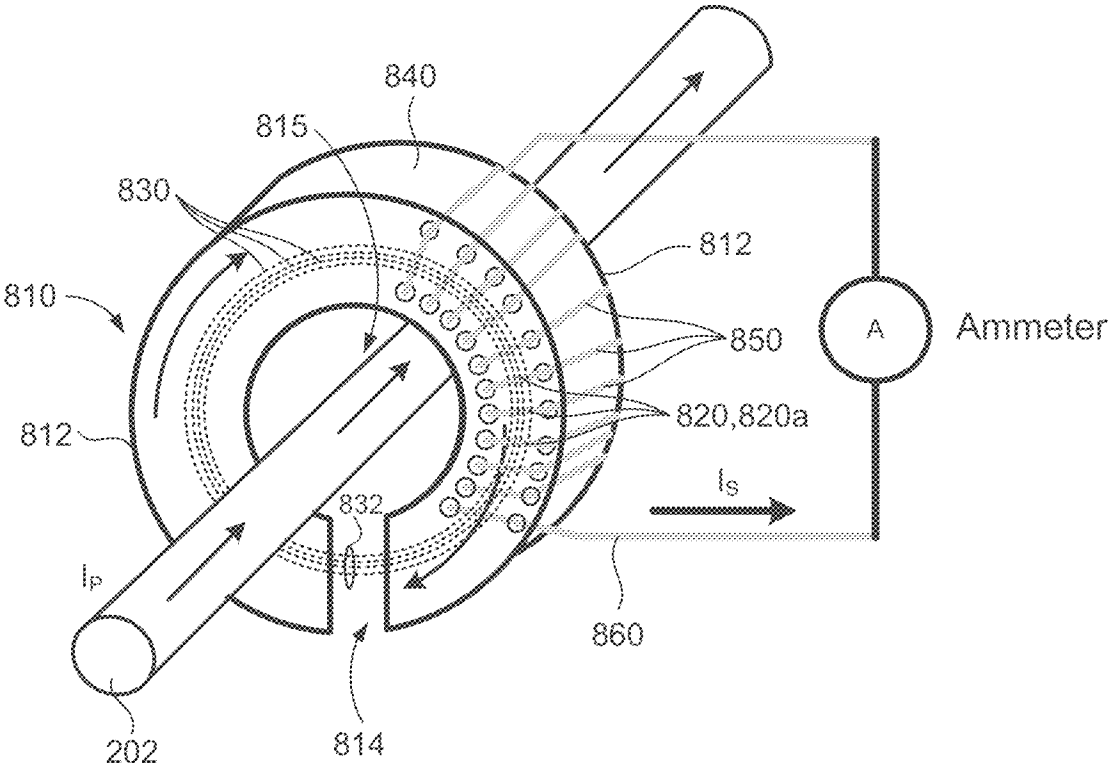
FIG. 8N is a perspective view of a housing base having a winding and a housing cover.

Referring to FIGS. 8A-8N, in some examples, the CT 800 includes a housing base 810 and a housing cover 840 (FIGS. 8E and 8F). The housing base 810 includes a housing base body 812 defining a base longitudinal axis LB extending from a front portion 810*a* of the housing base 810 to a back portion 810*b* of the housing base 810. The housing base body 812 defines a transverse plane TPB substantially perpendicular to the base longitudinal axis LB. The housing base body 812 also defines an opening 814 along the base longitudinal axis LB that is configured to receive a primary conductor 202 through the opening 814. The opening 814 defines a slot between a first wall 814*a* and a second wall 8114*b* of flanges 811*a*, 811*b* associated with each end 810*a*, 810*b* of the housing base 810. As such, the opening 814 may have a distance DOB extending from each one of the first wall 814*a* to the associated second wall 814*b* that is greater than a diameter DW of the primary conductor 202. The opening 814 defines a slot along the base longitudinal axis LB sized to receive the primary conductor 202 into the opening 814. The housing base 810 or the housing base body 812 defines a wire receptacle 815 configured to at least partially receive the primary conductor 202. As shown, the housing base body 812 has a generally circular shape, and the wire receptacle 814 has a complimentary generally circular shape. However, the shape of the housing base body 812 may be different from the shape of the wire receptacle 815. In addition, the shape of the housing base body 812 and/or the shape of the wire receptacle 815 may be any shape configured to receive the primary conductor 202.

As shown, the housing base 810 includes a plurality of base conductors 820 supported by the housing base body 812. Each base conductor 820 is arranged about and radially spaced from the base longitudinal axis LB. In some examples, each base conductor 820 includes a first, second, and third conductor portions 820*a*, 820*b*, 820*c*. The first and second conductor portions 820*a*, 820*b* extend radially outwardly from an end of the third body conductor portion 820. In some examples, the first, second, and third conductor portions 820*a*, 820*b*, 820*c* form a U-Shape, where the base of the U or the third conductor portion 820*c* is substantially parallel to the base longitudinal axis LB. In some examples, the first and second body conductor portions 820*a*, 820*b* are perpendicular to the third conductor portion 820*c*. Additionally or alternatively, the first and second body conductor portions 820*a*, 820*b*, may be parallel with respect to one another or may form an angle. As described, the base conductor 820 has three portions, however, the base conductor 820 may have other shapes forming more or less portions.

The CT 800 includes a core wrap 830 that includes a length of magnetically permeable material wound around the housing base body 812 along the transverse plane TP. Referring back to FIGS. 8A and 8B, in some implementations, the housing base body 812 is circular and has a housing base body diameter DCB greater than the opening diameter DOW The core wrap 830 is wound about the base body diameter DCB. The core wrap 830 collectively forms a transformer core 832 about the base longitudinal axis LB. As such, the wrapped transformer core 832 forms a continuous core for the CT 800, which prevents the problem of using the split core CT described above, preventing the distortion of the core material properties. In addition, the transformer core 832 has a core wrap inner diameter DR greater than or equal to the housing base body diameter DCIS. The transformer core 832 may include a 100-turn of a one-mil (~25 micron) thick supermalloy foil 830. Other numbers of turns are possible as well. A mean magnetic path is a closed path that follows the average magnetic field line around the interior of the transformer core 832. In some examples, a two-mil gap exists between the roll layers of the foil 830 to simulate a loose roll of foil 830. Other gap thicknesses are possible as well.

The CT 800 includes the housing cover 840 releasably attached to the housing base 810 to form a housing that houses the formed transformer core 832. The housing cover 840 includes a housing cover body 842 defining a cover longitudinal axis LC (shown in FIG. 8J). The housing cover 840 includes a plurality of cover conductors 850 supported by the housing cover 840. In some examples, each cover conductor 850 is arranged about and radially spaced from the cover longitudinal axis LC. In other examples, each cover conductor 850 extends along the cover longitudinal axis LC at an angle with respect to the longitudinal axis LC. The cover conductors 850 may be arranged in any manner as long as when the housing cover 840 is attached to the housing base 810, the plurality of base conductors 820 align with and contact the plurality of cover conductors to form a continuous secondary winding around the transformer core 832 allowing electricity to flow through the secondary winding. In addition, when the housing cover 840 is attached to the housing base 810, the base longitudinal axis LB coincides with the cover longitudinal axis LC. At the junction of the conductors on the housing and/or the base, connectors may be added to reduce the contact resistance of the junction between the conductors on the housing cover and on the base. In some instances, the connectors may use spring connections to minimize contact resistance. In other instances, magnets may be used to align the housing and the base and reduce contact resistance. As shown, the plurality of base conductors 820 are circumferentially spaced about the base longitudinal axis LB. In addition, the cover conductors 850 are circumferentially spaced about the cover longitudinal axis LC.

Referring to FIG. 8E, in some examples, the housing cover 840 includes an opening 844 having a diameter DOC greater than the housing base body diameter DCB allowing the housing cover 840 to releasably attach to the housing base 810, which together form the CT 800. The example shown may also include one or more hinges 846 that allow the housing cover 840 to increase its opening 844 when the housing cover 840 diameter DOC is less than the housing base body diameter DCB. In another example shown in FIG. 8F, the housing cover 840 includes a hinge 846 and a lock 848. The hinge 846 is configured to open the housing cover 840 allowing the housing cover 840 to releasably attach to the housing base 810. In addition, the locks 848 are configured to lock the housing cover 840 preventing the housing cover 840 from being released from the housing base body 812.

In some examples, at least one of the housing base body 812 and/or the housing cover body 842 (FIG. 8F) include first and second body portions separated by a pivoting mechanism, each having first and second ends. The first end of the second body portion is pivotally coupled to the first end of the first body portion, e.g., using one or more pivoting mechanisms, such as hinges 846. The first body portion and the second body portion are moveable between an open position and a closed position. When in the open position, the second end of the first body portion is rotated away from the second end of the second body portion. When in the closed position, the second end of the first body portion contacts the second end of the second body portion. In this case, the at least one of the housing base body 812 and/or the housing may not include an opening 814, 844 since the opening occurs in the open position.

FIGS. 8G and 8H illustrate a front and back view respectively of the CT 800 including the housing base body 812, the core wrap 830 forming the wrapped transformer core 832, and the housing cover 840 attached to the housing base body 812. As shown, the base conductors 820 and the cover conductors 850 form a secondary winding 860 around the transformer core 823. (See FIG. 8N)

FIG. 8I illustrates a cross sectional view of the housing base 810. As shown, the housing base 810 may have first and second flanges 811*a*, 811*b* extending outwardly from a portion of the housing base 810 that extends parallel to the cover body longitudinal axis LB. In this case, the base conductor 820 includes the first, second, and third conductor portions 820*a*, 820*b*, 820*c*, where the first and second conductor portions 820*a*, 820*b* extend adjacent the first and second flanges 811*a*, 811*b* of the housing base 810. As such, the conductor portions 820*a*, 820*b*, 820*c* form a U-Shape. The housing base body 812 forms a core receptacle 816 that is configured to at least partially receive the formed magnetically permeable wrapped transformer core 832.

FIG. 8J illustrates a cross sectional view of the housing cover 840 that includes a cover conductor 850 FIG. 8K illustrates a cross sectional view of the CT 800 that includes the housing base 810, the magnetically permeable wrapped transformer core 832, and the housing cover 840. Portion A shown in the figure illustrates that the base conductors 820 and the cover conductors 850 do not form a continuous loop, instead they form the second winding 860 around the transformer core 832. FIG. 8L illustrates a perspective view of the housing base 810, as shown in FIG. 8I. FIG. 8M illustrates a perspective view of the housing base 810 with the core wrap 830 forming the transformer core 832, as shown in FIG. 8J. FIG. 8N illustrates a perspective view of the housing base, the core wrap 830 forming the transformer core 832 and the housing cover 840 attached to the housing base 810 and forming the secondary windings 860 (i.e., when the cover conductors 850 connect with the cover conductors 850 forming the secondary windings 860, as shown in FIG. 8K).

Figure 9A:
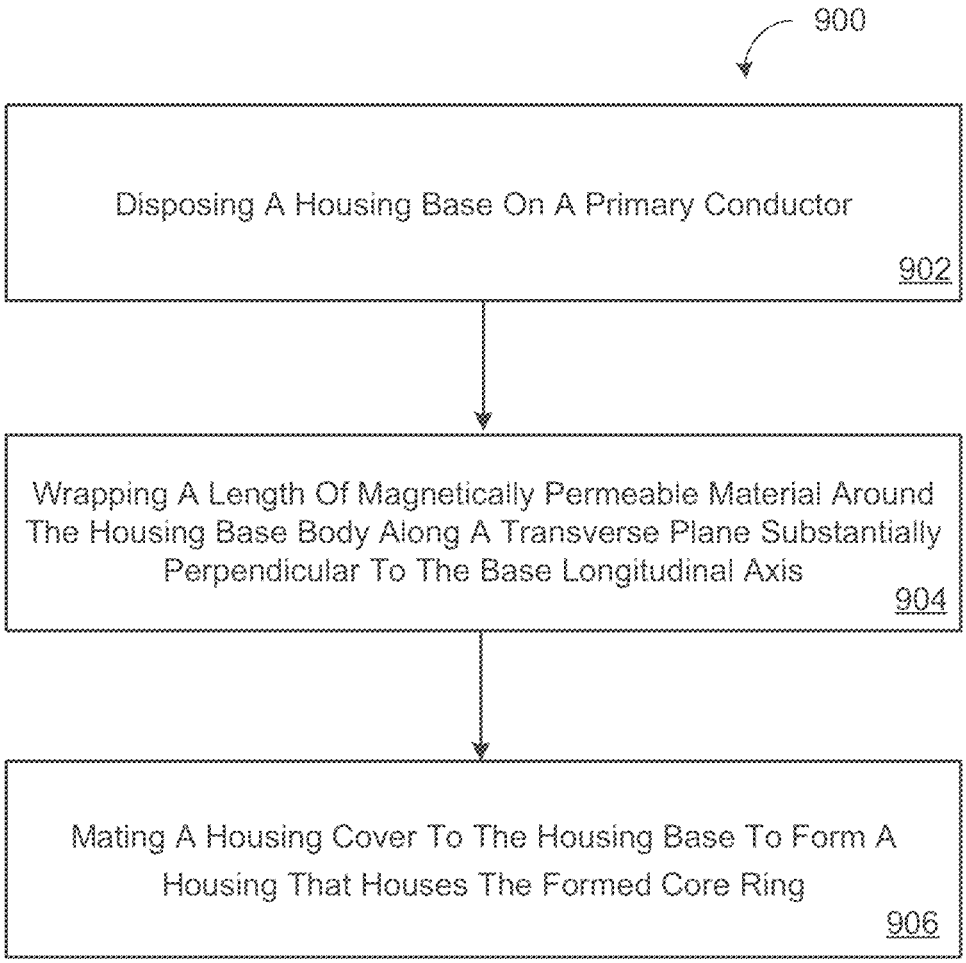
FIG. 9A provides an exemplary arrangement of operations for a method of installing a current transformer on a primary conductor.
Figure 9B:
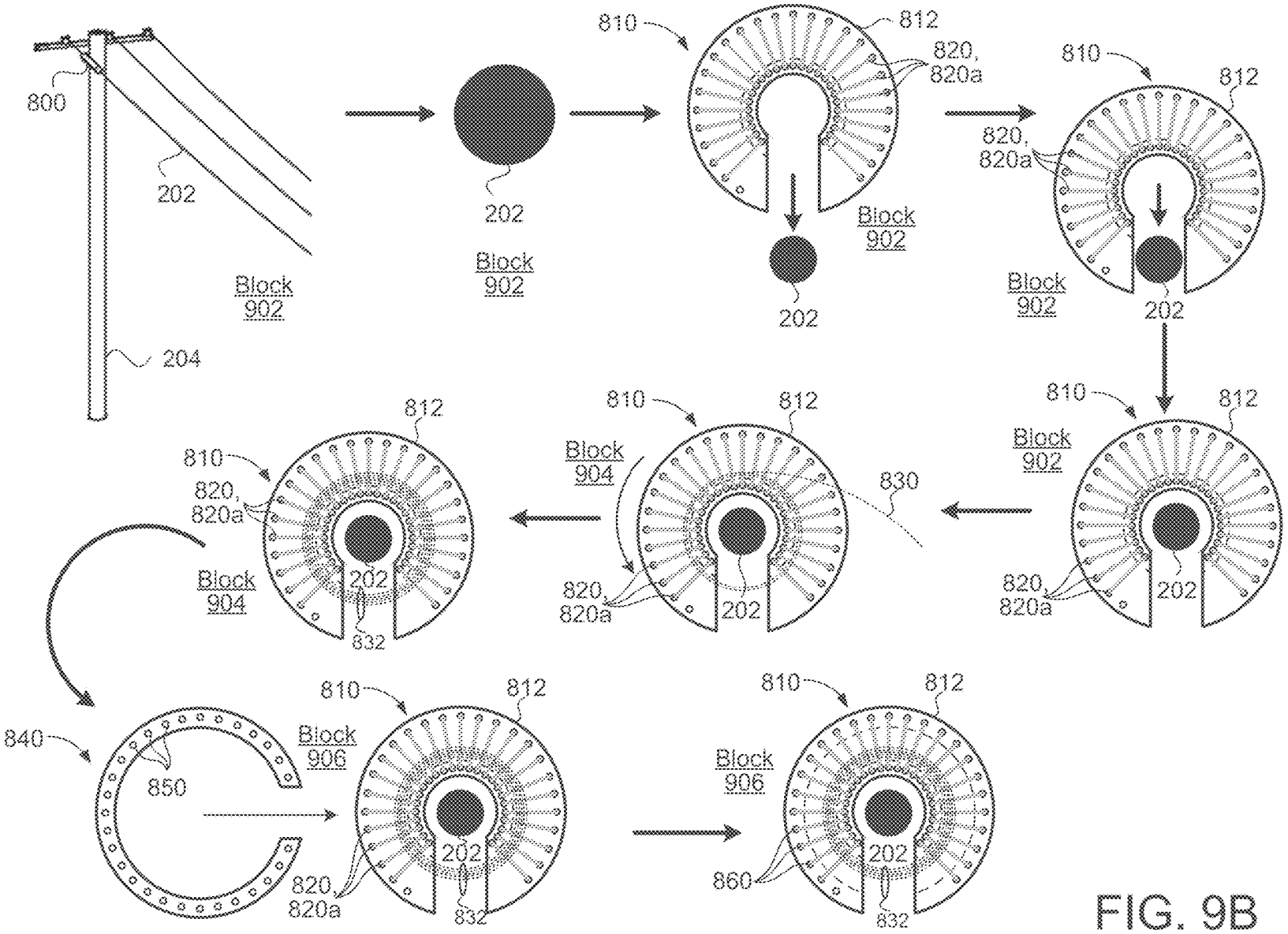
FIG. 9B is a perspective view of the current transformer as applying the method of FIG. 9A.

FIGS. 9A and 9B illustrate a method 900 of installing the CT 800 on a primary conductor 202, such as, but not limited to an electrical line supported by one or more utility poles as described with respect to FIG. 2A. At block 902 the method includes disposing a housing base 810 on the primary conductor 202. The housing base 810 includes a housing base body 812 and a plurality of base conductors 820 The housing base body 812 defines a base longitudinal axis LB and an opening 814 along the base longitudinal axis LB. The primary conductor 202 is received through the opening 814. The plurality of base conductors 820 is supported by the housing base body 812. In addition, each base conductor 820 is arranged about and radially spaced from the base longitudinal axis LB.

At block 904, the method 900 includes wrapping a length of magnetically permeable material 830 around the housing base body 812 along a transverse plane substantially perpendicular to the base longitudinal axis LB. The wrapped magnetically permeable material 830 collectively forms a transformer core 832 about the base longitudinal axis LB.

At block 906, the method includes mating a housing cover 840 to the housing base 810 to form a housing that houses the formed transformer core 832. The housing cover 840 includes a housing cover body 842 and a plurality of cover conductors 850. The housing cover body 842 defines a cover longitudinal axis. In addition, the plurality of cover conductors 850 is supported by the housing cover body 842. Each cover conductor 850 is arranged about and radially spaced from the cover longitudinal axis. When the housing cover 840 is mated to the housing base 810, the plurality of base conductors 820 align with and contact the plurality of cover conductors 850 to form a continuous secondary winding around the transformer core 832. When the housing cover 840 is mated to the housing base 810, the base longitudinal axis coincides with the cover longitudinal axis. The plurality of base conductors 820 are circumferentially spaced about the base longitudinal axis and the plurality of cover conductors 850 are circumferentially spaced about the cover longitudinal axis. Each base conductor 820 includes a linear rod arranged substantially parallel to the base longitudinal axis. At least one base conductor 820 or cover conductor 850 defines an arcuate shape. At least one of the housing base body 812 or the housing cover body 842 defines a core receptacle 816 configured to at least partially receive the formed transformer core 832. In some examples, disposing the housing base 810 on the primary conductor 202 includes receiving the primary conductor 202 through a slot define defined along the base longitudinal axis of the housing base body 812 and into the opening 814. At least one of the housing base body 812 or the housing cover body 842 includes a first body portion having first and second ends, and a second body portion having first and second ends. The first end of the second body portion is pivotably coupled to the first end of the first body portion. The first body portion and the second body portion are moveable between an open position and a closed position. During the open position, the second end of the first body portion is rotated away from the second end of the second body portion. In the closed position, the second end of the first body portion contacts the second end of the second body portion.

Figure 10A:
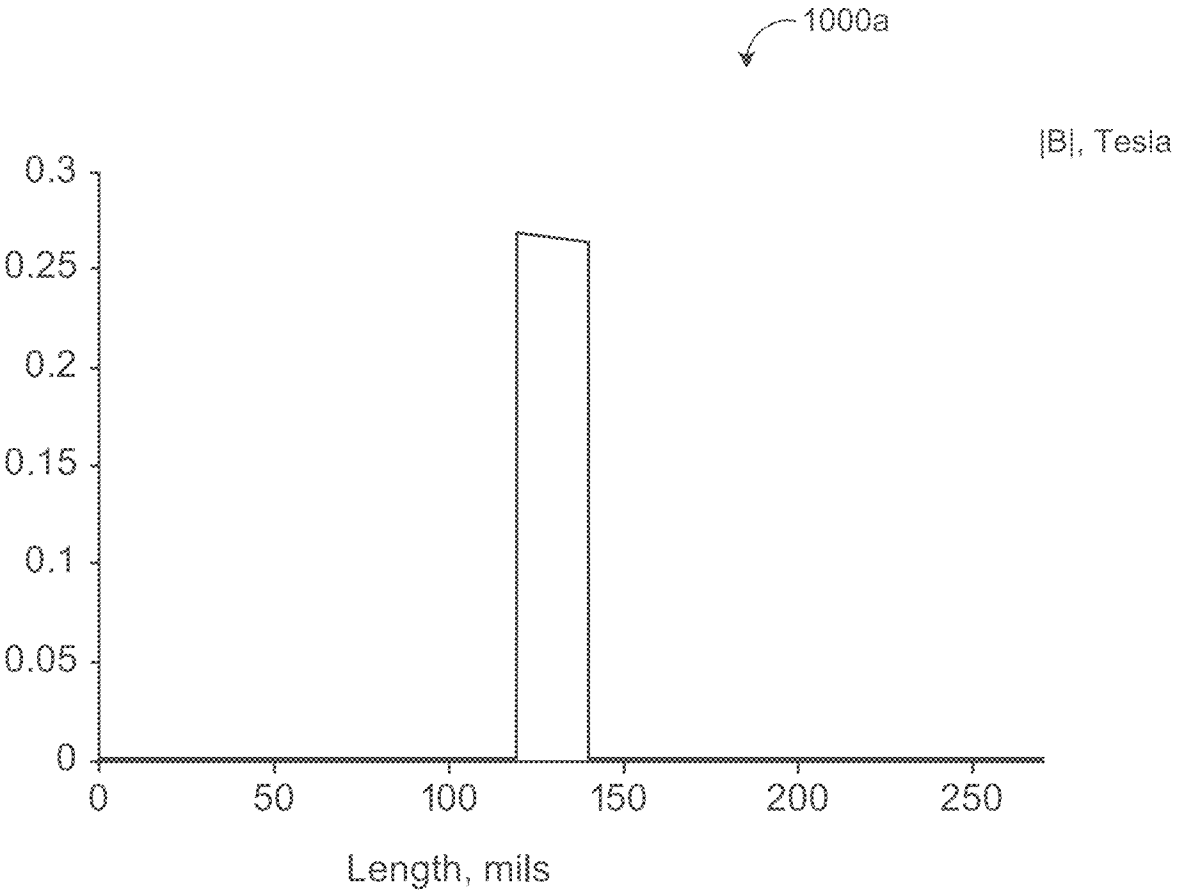
FIG. 10A is a schematic view of a simulation of the flux density of an ideal supermalloy transformer core with a fixed magnetizing force.
Figure 10B:
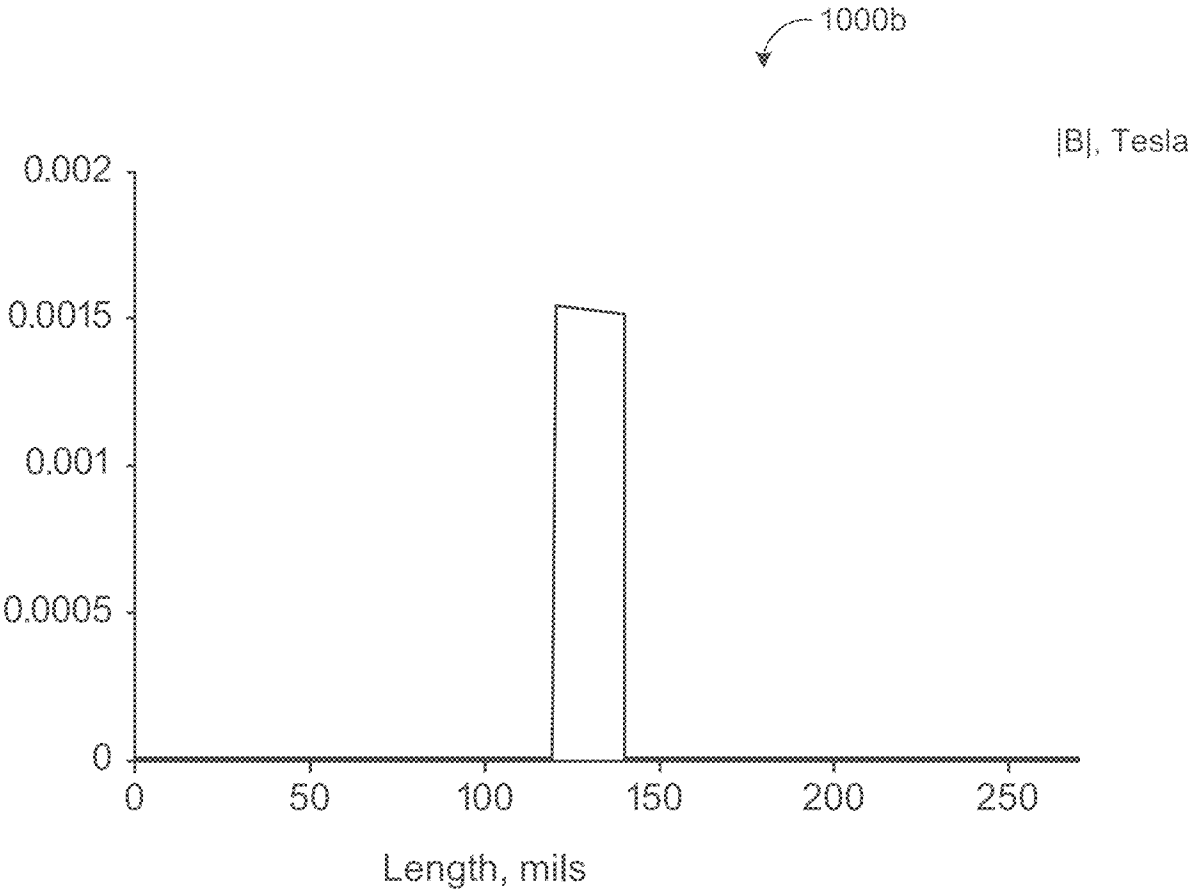
FIG. 10B is a schematic view of a simulation of the flux density of a supermalloy split core with a fixed magnetizing force.

FIG. 10A illustrates an example graph 1000*a* of a flux density simulation of an example CT 300, 500, 800 having a solid supermalloy core with a certain mean magnetic path length, area and a fixed magnetizing force. FIG. 10B illustrates an example graph 1000*b* of a flux density simulation of an example CT 100 having a split supermalloy core with the same mean magnetic path length, area and fixed magnetizing force as in FIG. 10A. As can be seen in the figure, the CT 100 has a peak flux of 0.0015 Teslas, which is considerably lower than the CT 300, 500, 800 having a solid core shown in FIG. 10A.

Figure 11A:
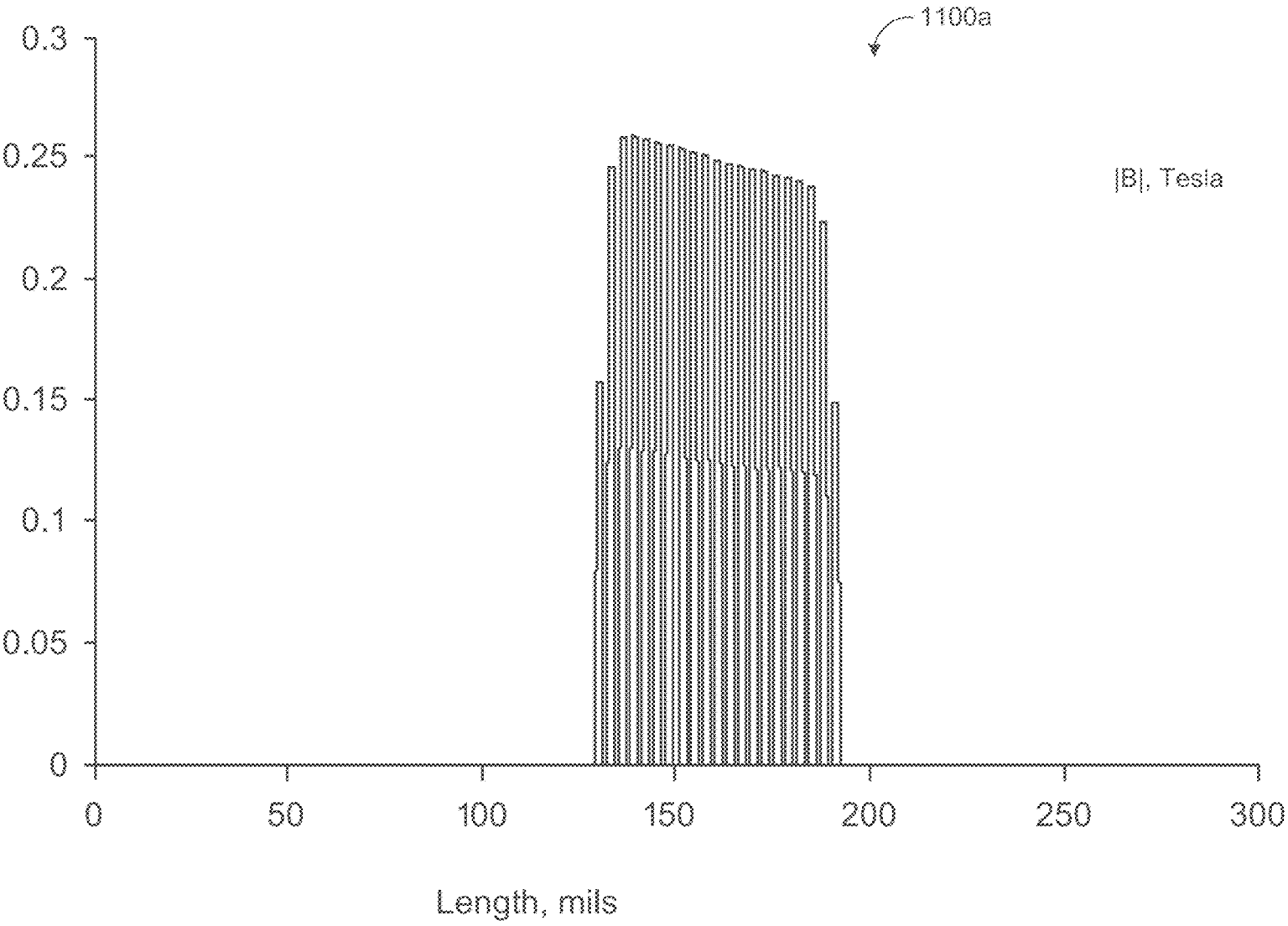
FIG. 11A is a schematic view of a simulation of the flux density of a wrapped core transformer as described in FIGS. 3A-6B, with a 2 mil gap between 1 mil layers.

FIG. 11A illustrates an example graph 1100*a* of flux measurements of an example CT 300, 500, 800 having a 20 turn of a one-mil thick supermalloy foil material 331 that forms the magnetically permeable wrapped transformer core 332, 832. A mean magnetic path length is held constant as is the width of the coil core and the current in the primary conductor 202. The mean magnetic path is a closed path that follows the average magnetic field line around the interior of the magnetically permeable wrapped transformer core 332. As shown, a gap of two mils exists between the roll layers to simulate a loose roll of core wrap 330. As can be seen in the figure, the CT 300, 500, 800 has a peak flux of 0.25 Teslas, which is approximately equal to a CT having a solid core and shown in FIG. 10A.

Figure 11B:
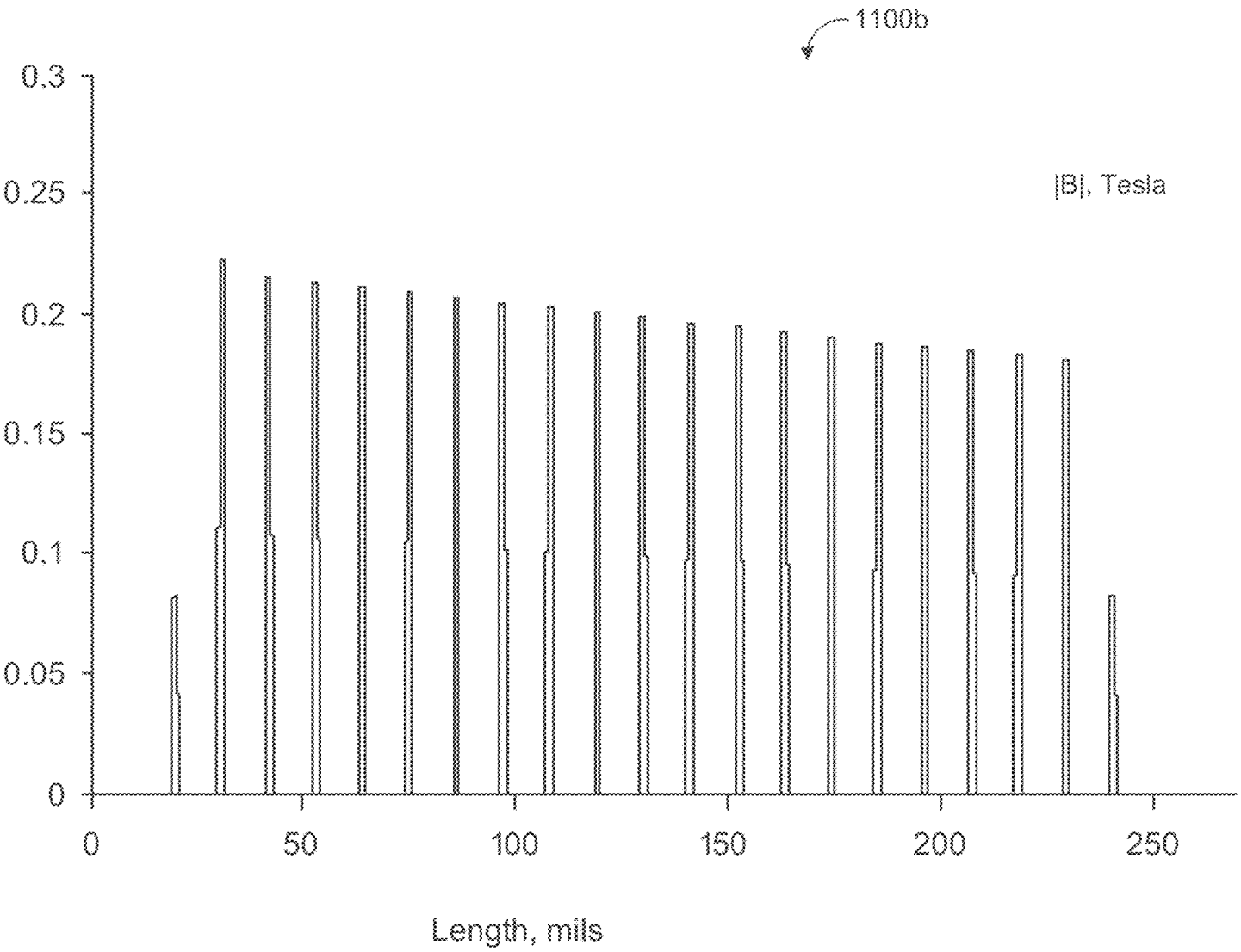
FIG. 11B is a schematic view of a simulation of the flux density of a wrapped core transformer as described in FIGS. 3A-6B, with a 10 mil gap between 1 mil layers.

FIG. 11B illustrates an example graph 1100*b* of flux measurements of an example CT 300, 500, 800 having a 10 mil gap between the layers of the foil material 331. In addition, the mean magnetic path length is the same as in a solid core CT. As can be shown in the graph, a peal flux is 0.2 Teslas, which is slightly worse than the performance of a CT having a solid core, however, the results are better than a split core CT shown in FIG. 10B.

FIGS. 12A-12D provide example graphs 1200*a*-1200*d* of Magnetic Flux Density (B) versus the Magnetic Field Strength (H) curve, i.e., the BH curve, of four CTs 300, 500, 800. The BH curve 1200*a*-1200*d* is used to select the materials for the CTs 300, 500, 800. The BH curve shows the change in the Flux density B (y-axis) of a material as the magnetic field strength (x-axis) is increased. When the magnetic field strength is increased gradually, the domains inside the material exposed to the field get aligned gradually, resulting in an increasing flux density of the material. As the magnetic field strength is increased further, the curve flattens. This means that the magnetization is complete and any further increase in the flux density is not possible. At this point, maximum positive saturation b has occurred.

Figure 12A:
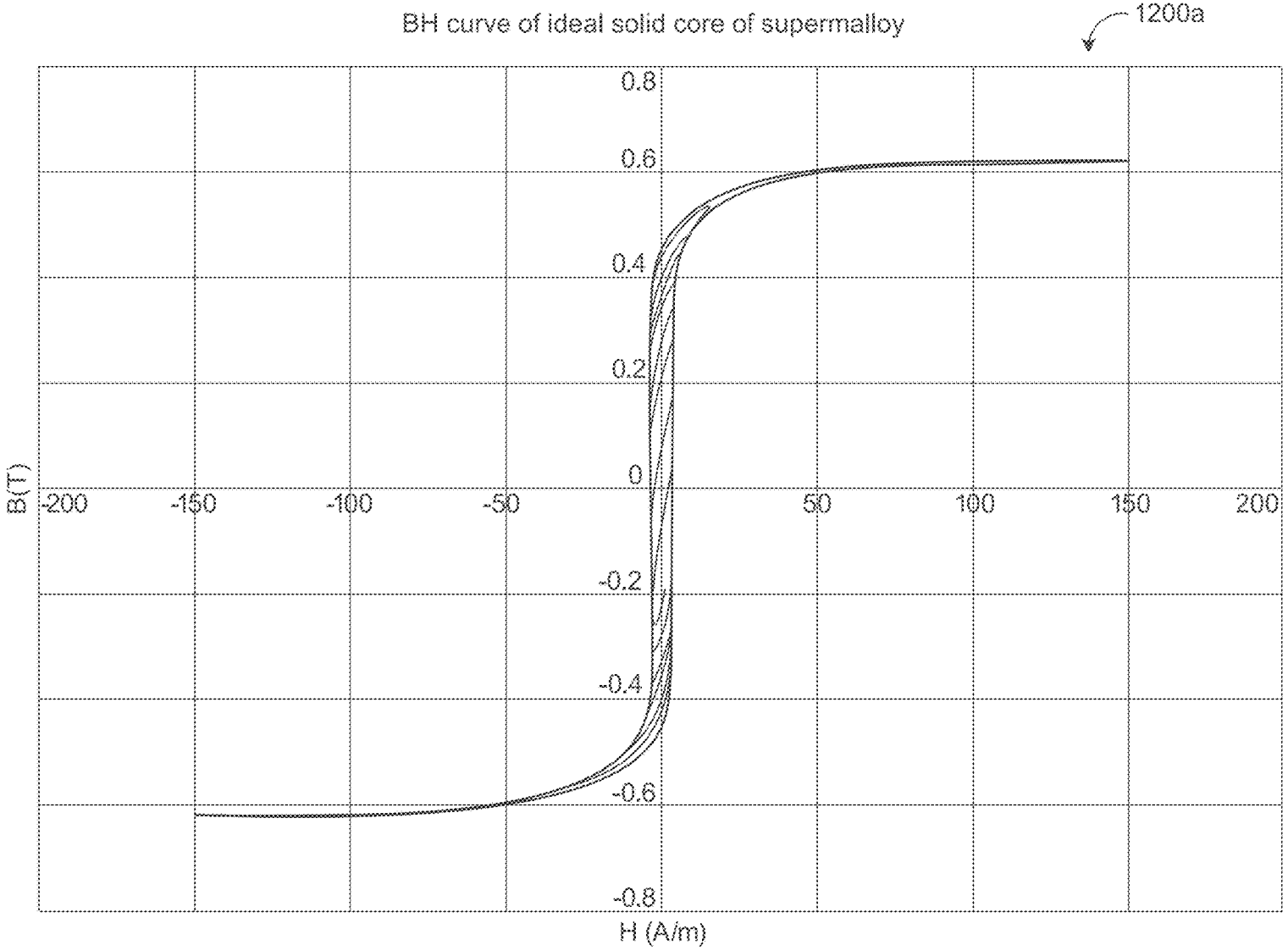
FIGS. 12A-12D are schematic graphs of BH curves of current transformers.
Figure 12B:
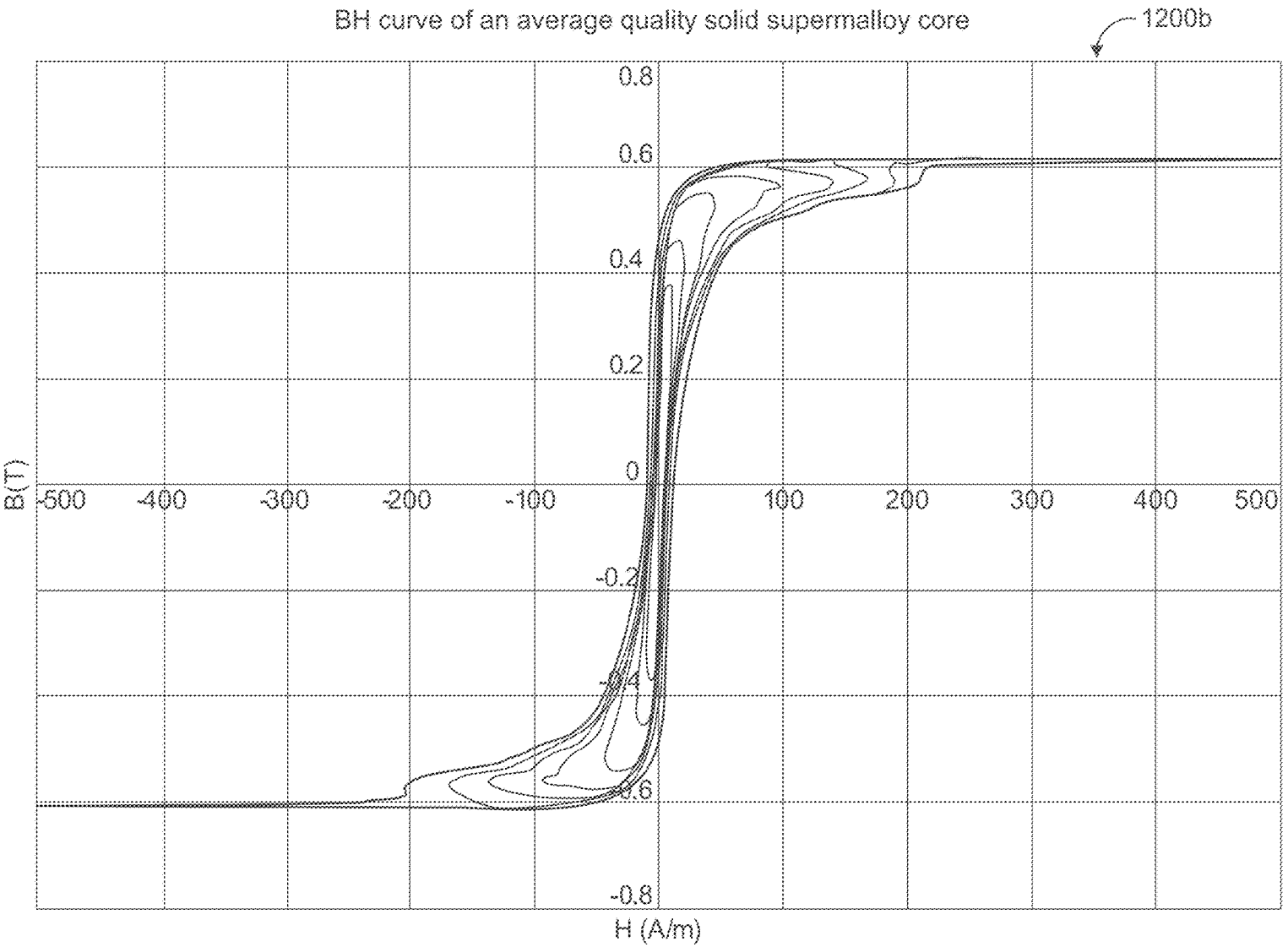
Figure 12C:
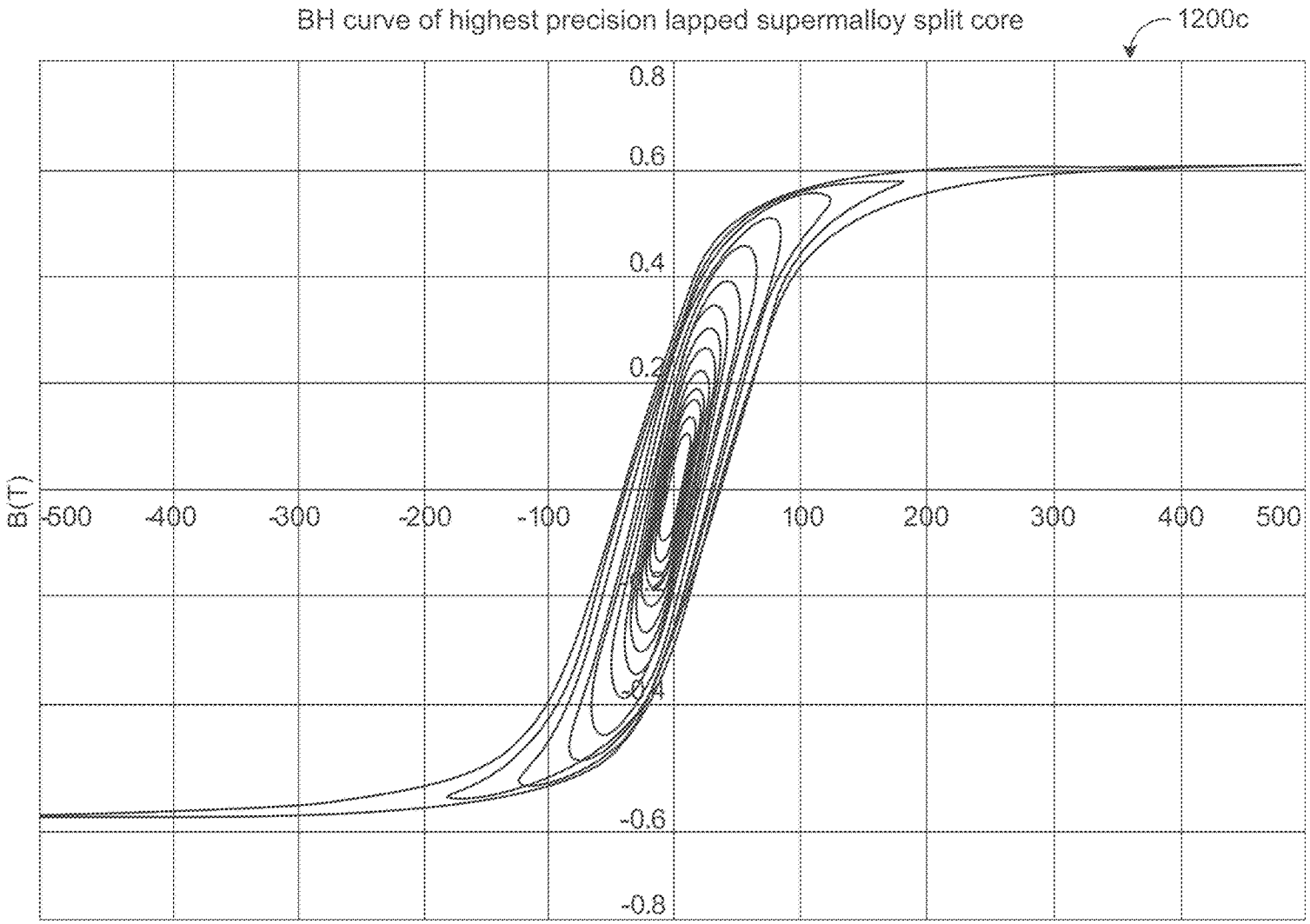
Figure 12D:
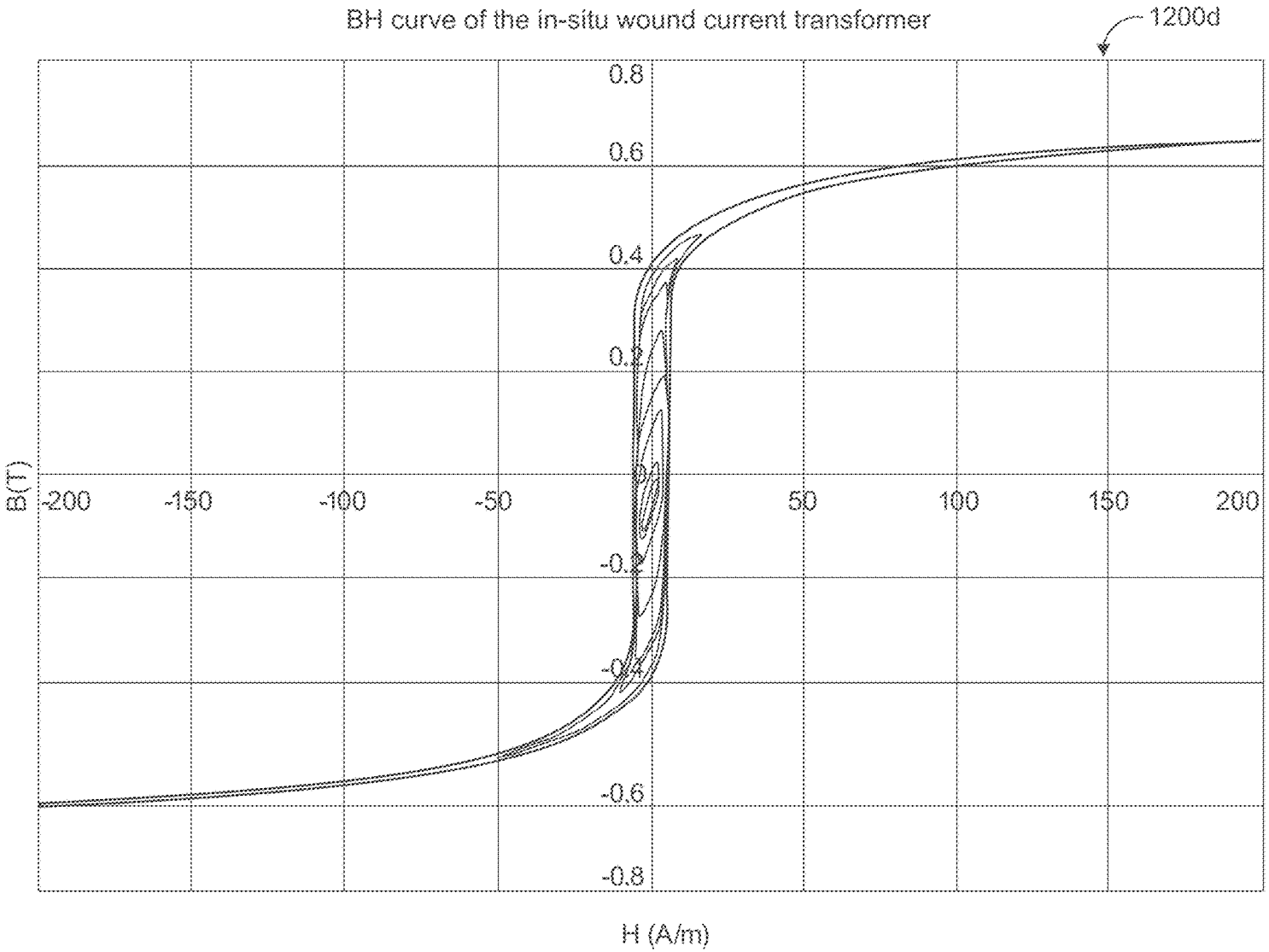

For example, referring to FIG. 12A, the BH curve 1200*a* is associated with an ideal solid core of supermalloy. FIG. 12B illustrates a BH curve 1200*b* of an average quality supermalloy core. FIG. 10C illustrates a BH curve 1200*c* of a highest precision lapped supermalloy having a split core. FIG. 10D illustrates a BH curve 1200*d* of the CT 300, 500 described. As can be seen, FIG. 10D provides the closed BH curve 1200*d* to the ideal BH curve 1200*a* shown in FIG. 10A.

A number of implementations have been described. Nevertheless, it will be understood that various modifications may be made without departing from the spirit and scope of the disclosure. Accordingly, other implementations are within the scope of the following claims.

What is claimed is:

1. A method of installing a current transformer, the method comprising:

disposing a first bobbin on an electric line, the first bobbin comprising:

a first tube having first and second ends and defining a first longitudinal axis;

a first flange disposed on the first end of the first tube;

a second flange disposed on the second end of the first tube, wherein the first tube, the first flange, and the second flange collectively define a first slit along the first longitudinal axis, the first slit configured to allow receipt of the electric line into the first tube; and a secondary winding wound about the first bobbin, the secondary winding extending along the first longitudinal axis, passing through the first tube and over the first and second flanges;

disposing a second bobbin on the first bobbin disposed on the electric line, the second bobbin comprising:

a second tube having first and second ends, the second tube defining:

a second longitudinal axis; and a second slit along the second longitudinal axis, the second slit configured to receive the first tube into the second tube, wherein when the first tube is received into the second tube, the first longitudinal axis is substantially coincident with the second longitudinal axis and the second bobbin can spin about the second longitudinal axis relative to the first bobbin; and winding a core wrap about the second bobbin disposed on the first bobbin in a direction substantially perpendicular to the second longitudinal axis by rotating the second bobbin relative to the first bobbin while feeding the core wrap onto the second bobbin.

2. The method of claim 1, wherein the second bobbin is sized for receipt over the first tube and between the first and second flanges.

3. The method of claim 2, wherein the second bobbin comprises:

a third flange disposed on the first end of the second tube; and a fourth flange disposed on the second end of the second tube, wherein the second tube, the third flange, and the fourth flange collectively define the second slit.

4. The method of claim 1, wherein the secondary winding passes through the first flange and/or the second flange.

* * * * *